US009744411B2

(12) United States Patent
Sander

(10) Patent No.: US 9,744,411 B2
(45) **Date of Patent: *Aug. 29, 2017**

(54) RELEASABLE AND INTERCHANGEABLE CONNECTIONS FOR GOLF CLUB HEADS AND SHAFTS

(71) Applicant: NIKE, Inc., Beaverton, OR (US)

(72) Inventor: Raymond J. Sander, Benbrook, TX (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/660,090

(22) Filed: Mar. 17, 2015

(65) Prior Publication Data

US 2015/0290506 A1 Oct. 15, 2015

Related U.S. Application Data

(63) Continuation of application No. 13/593,058, filed on Aug. 23, 2012, now Pat. No. 9,050,506.

(60) Provisional application No. 61/577,660, filed on Dec. 19, 2011, provisional application No. 61/526,325, filed on Aug. 23, 2011.

(51) Int. Cl.

| | |
|---|---|
| ***A63B 53/02*** | (2015.01) |
| ***A63B 53/14*** | (2015.01) |
| ***A63B 53/16*** | (2006.01) |

(52) U.S. Cl.

CPC ..... *A63B 53/02* (2013.01); *A63B 53/14* (2013.01); *A63B 53/16* (2013.01); *A63B 2053/023* (2013.01); *A63B 2053/025* (2013.01); *A63B 2053/026* (2013.01)

(58) Field of Classification Search

CPC ..... A63B 53/02; A63B 53/16; A63B 53/14; A63B 2053/023; A63B 2053/026; A63B 2053/027

See application file for complete search history.

(56) References Cited

U.S. PATENT DOCUMENTS

| | | | |
|---|---|---|---|
| 1,266,529 | A | 5/1918 | Mattern |
| 1,623,523 | A | 4/1927 | Bourke |
| 1,634,082 | A | 6/1927 | Rigby |
| 1,850,843 | A | 3/1932 | Lagerblade |
| 2,067,556 | A | 1/1937 | Wettlaufer |

(Continued)

FOREIGN PATENT DOCUMENTS

| | | | |
|---|---|---|---|
| GB | 392493 | A | 5/1933 |
| GB | 443439 | A | 2/1936 |

(Continued)

OTHER PUBLICATIONS

Mar. 6, 2013 (WO) ISR—App. PCT/US2012/052101.
Jan. 31, 2014 (WO)—ISR—App. PCT/US2013/067525.

*Primary Examiner* — Stephen Blau

(57) ABSTRACT

Golf club heads are releasably engaged with shafts so that the club heads and shafts can be readily interchanged and/or so that the shaft position with respect to the club head can be readily changed. Assemblies for connecting the club head and shaft may include: a shaft adapter, a collet, a ferrule, and a club head having an interior chamber. The club head and shaft may be changed by releasing the securing system and exchanging the original parts with different parts.

19 Claims, 55 Drawing Sheets

(56) References Cited

U.S. PATENT DOCUMENTS

| | | | |
|---|---|---|---|
| 2,219,670 | A | 10/1940 | Wettlaufer |
| 2,451,262 | A | 10/1948 | Watkins |
| 3,206,206 | A | 9/1965 | Santosuosso |
| 3,516,697 | A | 6/1970 | Hahn |
| 3,524,646 | A | 8/1970 | Wheeler |
| 3,891,212 | A | 6/1975 | Hill |
| 4,253,666 | A | 3/1981 | Murphy |
| 4,420,272 | A | 12/1983 | Ingalls et al. |
| 4,664,382 | A | 5/1987 | Palmer et al. |
| 4,854,582 | A | 8/1989 | Yamada |
| 4,948,132 | A | 8/1990 | Wharton |
| 4,984,794 | A | 1/1991 | Pernelle et al. |
| 5,165,688 | A | 11/1992 | Schmidt et al. |
| 5,232,224 | A | 8/1993 | Zeider |
| 5,275,399 | A | 1/1994 | Schmidt et al. |
| 5,275,408 | A | 1/1994 | Desbiolles et al. |
| 5,429,355 | A | 7/1995 | Schmidt et al. |
| 5,433,442 | A | 7/1995 | Walker |
| 5,626,528 | A | 5/1997 | Toulon |
| 5,839,973 | A | 11/1998 | Jackson |
| 5,851,155 | A | 12/1998 | Wood et al. |
| 5,855,526 | A | 1/1999 | Honma |
| 5,906,549 | A | 5/1999 | Kubica |
| 6,203,443 | B1 | 3/2001 | Britton |
| 6,251,028 | B1 | 6/2001 | Jackson |
| 6,270,425 | B1 | 8/2001 | Dyer |
| 6,273,828 | B1 | 8/2001 | Wood et al. |
| 6,287,215 | B1 | 9/2001 | Fisher |
| 6,319,146 | B1 | 11/2001 | Mills |
| 6,368,230 | B1 | 4/2002 | Helmstetter et al. |
| 6,447,404 | B1 | 9/2002 | Wilbur |
| 6,547,673 | B2 | 4/2003 | Roark |
| 6,575,843 | B2 | 6/2003 | McCabe |
| 6,652,388 | B1 | 11/2003 | Lenhof et al. |
| 6,669,573 | B2 | 12/2003 | Wood et al. |
| 6,769,994 | B2 | 8/2004 | Boone |
| 7,083,529 | B2 | 8/2006 | Cackett et al. |
| 7,115,046 | B1 | 10/2006 | Evans |
| 7,210,693 | B2 | 5/2007 | Ingalls et al. |
| 7,300,359 | B2 | 11/2007 | Hocknell et al. |
| 7,326,126 | B2 | 2/2008 | Holt et al. |
| 7,331,589 | B2 | 2/2008 | Ingalls et al. |
| 7,335,113 | B2 | 2/2008 | Hocknell et al. |
| 7,344,449 | B2 | 3/2008 | Hocknell et al. |
| 7,699,717 | B2 | 4/2010 | Morris et al. |
| 7,704,156 | B2 | 4/2010 | Stites et al. |
| 7,997,997 | B2 | 8/2011 | Bennett et al. |
| 8,182,357 | B2 | 5/2012 | Moore |
| 8,540,589 | B2 | 9/2013 | Bezilla et al. |
| 8,632,417 | B2 | 1/2014 | Sander et al. |
| 8,668,597 | B2 | 3/2014 | Yamamoto |
| 8,684,859 | B1 | 4/2014 | Aguinaldo et al. |
| 8,727,905 | B2 | 5/2014 | Murphy et al. |
| 2002/0037773 | A1 | 3/2002 | Wood et al. |
| 2003/0045371 | A1 | 3/2003 | Wood et al. |
| 2005/0280229 | A1 | 12/2005 | Ingalls et al. |
| 2007/0173344 | A1 | 7/2007 | Burch |
| 2008/0051211 | A1 | 2/2008 | Hocknell et al. |
| 2008/0058114 | A1 | 3/2008 | Hocknell et al. |
| 2008/0070717 | A1 | 3/2008 | Hocknell et al. |
| 2008/0280693 | A1 | 11/2008 | Chai |
| 2009/0286618 | A1 | 11/2009 | Beach et al. |
| 2010/0041491 | A1* | 2/2010 | Thomas ..... A63B 53/00 473/288 |
| 2010/0197423 | A1 | 8/2010 | Thomas et al. |
| 2010/0197424 | A1 | 8/2010 | Beach et al. |
| 2011/0105242 | A1 | 5/2011 | Beach et al. |
| 2011/0111881 | A1 | 5/2011 | Sander et al. |
| 2011/0195798 | A1 | 8/2011 | Sander et al. |
| 2012/0071262 | A1 | 3/2012 | Beach et al. |
| 2012/0077614 | A1 | 3/2012 | Moore |
| 2012/0149488 | A1 | 6/2012 | Swist |
| 2015/0151172 | A1 | 6/2015 | Bezilla et al. |

FOREIGN PATENT DOCUMENTS

| | | | |
|---|---|---|---|
| JP | 2000024143 | A | 1/2000 |
| JP | 2000157650 | A | 6/2000 |
| JP | 2006042951 | A1 | 4/2006 |
| JP | 2009-545393 | A | 12/2009 |
| JP | 2009291602 | A | 12/2009 |
| WO | 9000424 | A1 | 1/1990 |
| WO | 2007022671 | A1 | 3/2007 |
| WO | 2009032533 | A1 | 3/2009 |
| WO | 2009035345 | A1 | 3/2009 |

* cited by examiner

Fig. 13A
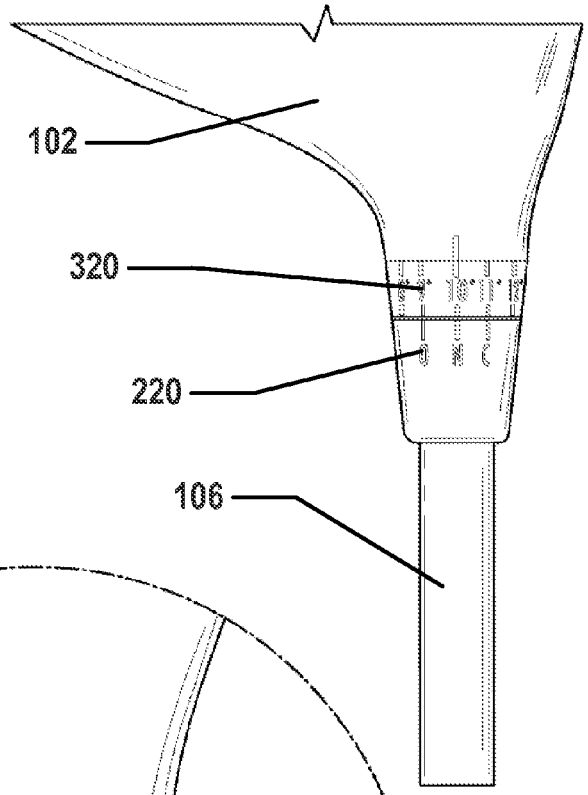
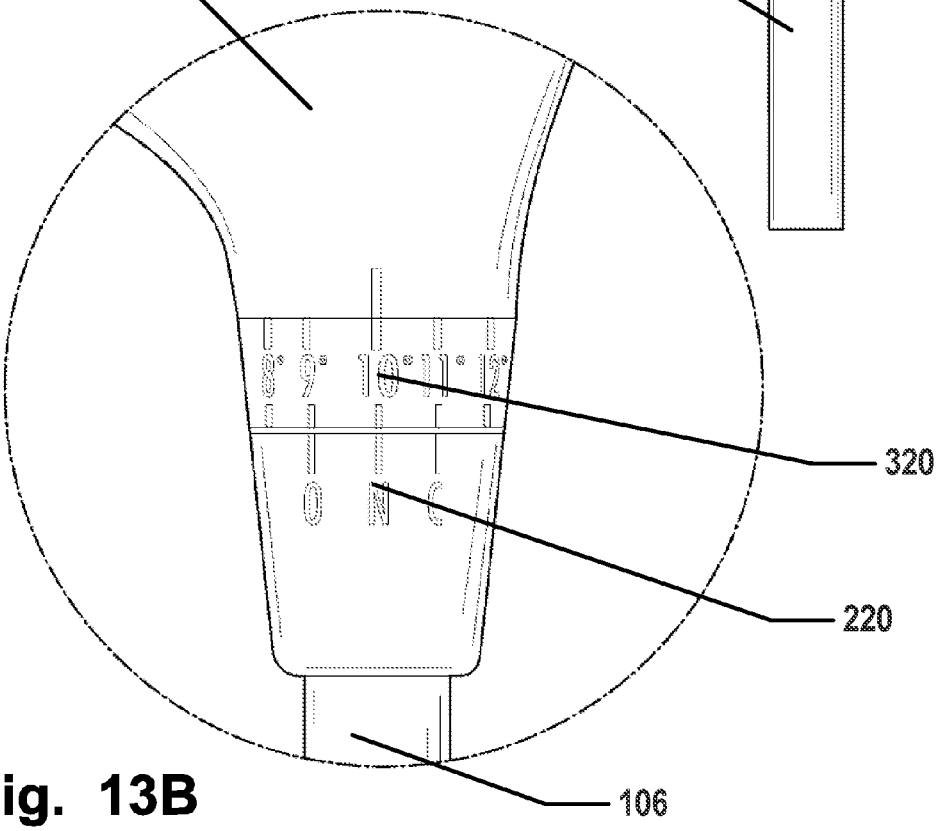
Fig. 13B

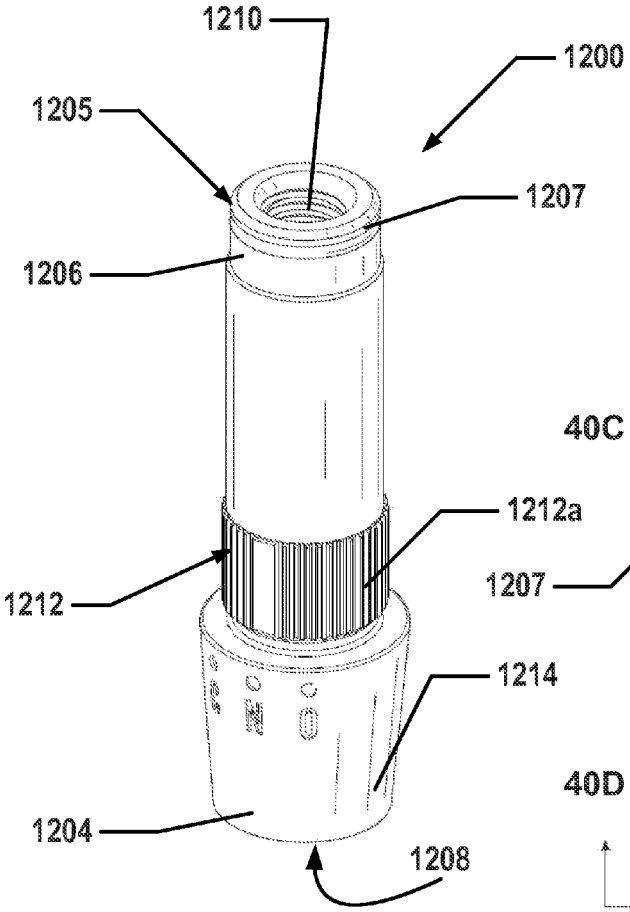
Fig. 40A
Fig. 40B
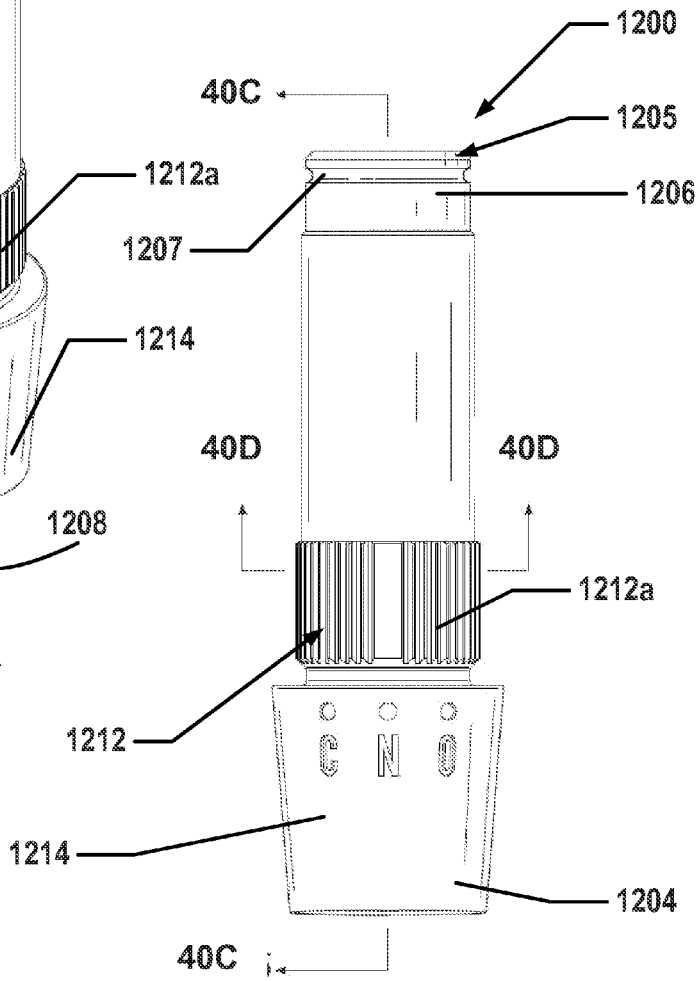

RELEASABLE AND INTERCHANGEABLE CONNECTIONS FOR GOLF CLUB HEADS AND SHAFTS

RELATED APPLICATIONS

This application is a continuation application of Non-Provisional Application, U.S. Ser. No. 13/593,058, filed Aug. 23, 2012 which claims the benefit of and priority to Provisional Application, U.S. Ser. No. 61/577,660, filed Dec. 19, 2011, and Provisional Application, U.S. Ser. No. 61/526,325, filed Aug. 23, 2011, which are incorporated herein by reference in their entirety.

FIELD OF THE INVENTION

This invention relates generally to golf clubs and golf club heads. More particularly, aspects of this invention relate to golf clubs having releasable connections between the golf club head and the shaft and/or head/shaft position adjusting features to allow easy interchange of shafts and heads and/or to allow easy modification of the head/shaft positioning properties.

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well-known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. A host of swing and/or teaching aids also are available on the market that promise to help lower one's golf scores.

Being the sole instrument that sets a golf ball in motion during play, golf clubs also have been the subject of much technological research and advancement in recent years. For example, the market has seen dramatic changes and improvements in putter designs, golf club head designs, shafts, and grips in recent years. Additionally, other technological advancements have been made in an effort to better match the various elements and/or characteristics of the golf club and characteristics of a golf ball to a particular user's swing features or characteristics (e.g., club fitting technology, ball launch angle measurement technology, ball spin rates, etc.).

Given the recent advances, there is a vast array of golf club component parts available to the golfer. For example, club heads are produced by a wide variety of manufacturers in a variety of different models. Moreover, the individual club head models may include multiple variations, such as variations in the loft angle, lie angle, face angle, offset features, weighting characteristics, etc. (e.g., including draw biased club heads, fade biased club heads, neutrally weighted club heads, etc.). Additionally, the club heads may be combined with a variety of different shafts, e.g., from different manufacturers; having different stiffnesses, flex points, kick points, or other flexion characteristics, etc.; made from different materials; etc. Many different grip variations and models also are now available on the market. Between the available variations in grips, shafts, and club heads, there are literally hundreds of different club head/shaft combinations available to the golfer.

Club fitters and golf professionals can assist in fitting golfers with a golf club head/shaft combination that suits their swing characteristics and needs. Conventionally, however, golf club heads are permanently mounted to shafts using cements or adhesives. Therefore, to enable a golfer to test a variety of head/shaft combinations, the club fitter or professional must carry a wide selection of permanently mounted golf club head/shaft combinations (which takes up a considerable amount of storage space and inventory costs) or the club fitter or professional must build new clubs for the customer as the fitting process continues (which takes a substantial amount of time and inventory costs). The disadvantages associated with these conventional options serve to limit the choices available to the golfer during a fitting session and/or significantly increase the expense and length of such a session. The present invention seeks to overcome certain of the limitations of the prior art and other drawbacks of the prior art, and to provide new features no heretofore available.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

Aspects of this invention relate to a golf club head/shaft connection assembly that includes a shaft adapter, a hosel adapter, a hosel ring, and a securing system. The shaft adapter may be generally cylindrical in shape having a first end and an opposite second end. The first end may include a first opening that provides access to a cylindrical interior chamber for receiving a golf club shaft. An exterior surface of the cylindrical structure may include a first rotation-inhibiting structure. The second end may include a securing structure. The hosel adapter may be generally cylindrical in shape with an internal bore on a first end of the hosel adapter that includes a second rotation-inhibiting structure that engages the first rotation-inhibiting structure and a second end of the hosel adapter that includes a first opening for receiving a securing member. An exterior surface of the hosel adapter may include a third rotation-inhibiting structure. The hosel ring may be generally cylindrical in shape. An internal bore of the hosel ring may include a fourth rotation-inhibiting structure that engages the third rotation-inhibiting structure. The securing system may releasably engage the securing structure.

Additionally, the engagement between the first rotation-inhibiting structure and the second rotation-inhibiting structure may limit the adjustment of one of a face angle or a loft angle of a club head. The engagement between the third rotation-inhibiting structure and the fourth rotation-inhibiting structure may limit the adjustment of the other of the face angle or the loft angle of the club head.

Another aspect of the invention relates to a golf club that includes a golf club head, a shaft adapter, a hosel adapter, a hosel ring, a shaft, and a securing system. The golf club head may have a hosel area that provides access to a club head chamber defined in the club head. The club head chamber may extend completely through the club head and includes a first opening for receiving a securing member. The shaft adapter may be generally cylindrical in shape having a first end and an opposite second end. The first end may include a second opening providing access to a cylindrical interior chamber. An exterior surface of the cylindrical structure may include a first rotation-inhibiting structure, and wherein the second end includes a securing structure. The hosel adapter may be generally cylindrical in shape with an internal bore on a first end of the hosel adapter that includes a second rotation-inhibiting structure that engages the first rotation-inhibiting structure and a second end of the hosel adapter includes a first opening for receiving a securing member. An exterior surface of the hosel adapter may include a third rotation-inhibiting structure. The hosel ring may be generally cylindrical in shape and located within the club head chamber. The internal bore of the hosel ring may include a fourth rotation-inhibiting structure that engages the third rotation-inhibiting structure. The shaft may be engaged in the cylindrical interior chamber of the shaft adapter. The securing system may releasably engage the securing structure. The engagement between the first rotation-inhibiting structure and the second rotation-inhibiting structure may limit the adjustment of one of a face angle or a loft angle of a club head. The engagement between the third rotation-inhibiting structure and the fourth rotation-inhibiting structure may limit the adjustment of the other of the face angle or the loft angle of the club head.

Another aspect of this invention relates to a golf club head/shaft connection assembly that includes a shaft adapter, a hosel adapter, a hosel ring, and a securing system. The shaft adapter may be generally cylindrical in shape having a first end and an opposite second end. The first end may include a first opening providing access to a cylindrical interior chamber for receiving a golf club shaft. An exterior surface of the cylindrical structure may include a first rotation-inhibiting structure. The second end may include a securing structure and a stop ring extending radially from the second end of the shaft adapter. The hosel adapter may be generally cylindrical in shape with an internal bore on a first end of the hosel adapter that includes a second rotation-inhibiting structure that engages the first rotation-inhibiting structure and a second end of the hosel adapter that includes a first opening for receiving a securing member. An exterior surface of the hosel adapter may includes a third rotation-inhibiting structure. The stop ring may maintain the continual engagement of the hosel adapter with the shaft adapter. The hosel ring may be generally cylindrical in shape. An internal bore of the hosel ring may include a fourth rotation-inhibiting structure that engages the third rotation-inhibiting structure. The securing system may releasably engage the securing structure. The engagement between the first rotation-inhibiting structure and the second rotation-inhibiting structure may limit the adjustment of one of a face angle or a loft angle of a club head. The engagement between the third rotation-inhibiting structure and the fourth rotation-inhibiting structure may limit the adjustment of the other of the face angle or the loft angle of the club head.

Another aspect of this invention relates to a golf club that includes golf club head, a shaft adapter, a hosel adapter, a hosel ring, a shaft, and a securing system. The golf club head may have a hosel area that provides access to a club head chamber defined in the club head. The club head chamber may extend completely through the club head and include a first opening for receiving a securing member. The shaft adapter may be generally cylindrical in shape having a first end and an opposite second end. The first end may include a first opening providing access to a cylindrical interior chamber for receiving a golf club shaft. An exterior surface of the cylindrical structure may include a first rotation-inhibiting structure. The second end may include a securing structure and a stop ring extending radially from the second end of the shaft adapter. The hosel adapter may be generally cylindrical in shape with an internal bore on a first end of the hosel adapter that includes a second rotation-inhibiting structure that engages the first rotation-inhibiting structure and a second end of the hosel adapter that includes a first opening for receiving a securing member. An exterior surface of the hosel adapter may include a third rotation-inhibiting structure. The stop ring may maintain the continual engagement of the hosel adapter with the shaft adapter. The hosel ring may be generally cylindrical in shape and located within the club head chamber. An internal bore of the hosel ring may include a fourth rotation-inhibiting structure that engages the third rotation-inhibiting structure. The shaft may be engaged in the cylindrical interior chamber of the shaft adapter. The securing system may releasably engage the securing structure. The engagement between the first rotation-inhibiting structure and the second rotation-inhibiting structure may limit the adjustment of one of a face angle or a loft angle of a club head. The engagement between the third rotation-inhibiting structure and the fourth rotation-inhibiting structure may limit the adjustment of the other of the face angle or the loft angle of the club head.

Another aspect of the invention may include a golf club having a coupled head and a shaft that includes a connection mechanism to couple the head to the shaft. The connection mechanism may include a hosel adapter having an outer wall insertable into a hosel of the head and rotatable inside the hosel between a first plurality of rotational positions. The hosel adapter may have a first internal inclined bore. A shaft adapter may be coupled to the shaft at a distal end and may have an outer wall configured to fit into said first internal inclined bore. The shaft adapter may be rotatable inside said first internal inclined bore between a second plurality of rotational positions. The shaft adapter may have a second internal inclined bore receiving said distal end of said shaft. The first plurality of rotational positions may be limited by a first spline configuration between the hosel adapter and the hosel of the head. The second plurality of rotational positions may be limited by a second spline configuration between the hosel adapter and the shaft adapter.

Another aspect of the invention relates to a golf club having a coupled head and shaft comprising a connection mechanism to couple the head to the shaft. The connection mechanism may include a pair of radially nested mutually independently rotatable members. One of said members may have an outer wall configured to fit inside said club head and the other of said members may have a bore for receiving said shaft. Both members may have inclined bores whereby two angular relationship parameters between said head and said shaft may be adjusted independently of each other. The rotation of a first member and the head may be limited by a first spline configuration between the first member. The head and the rotation of a second member and the first member may be limited by a second spline configuration between the first member and the second member.

Another aspect of the invention relates to a golf club having a releasably coupled head and that includes a connection mechanism to couple the head to the shaft. The connection mechanism may include a hosel adapter having an outer wall insertable into a hosel of the head and rotatable inside the hosel between a first plurality of rotational positions. The hosel adapter may have a first internal inclined bore with respect to a longitudinal axis of the bore of the hosel adapter. A shaft adapter may be coupled to the shaft at a distal end and may have an outer wall configured to fit into said first internal inclined bore with respect to a longitudinal axis of the bore of the shaft adapter. The shaft adapter may be rotatable inside said first internal inclined bore between a second plurality of rotational positions. The shaft adapter may have a second internal inclined bore receiving said distal end of said shaft. At least one of the hosel adapter or shaft adapter may be releasably connected to either the shaft or the head. The first plurality of rotational positions may change a first angular relationship between the head and the shaft and the second plurality of rotational positions may change a second angular relationship between the head and the shaft. The second angular relationship is independent of the first angular relationship. The first plurality of rotational positions may be limited by a first spline configuration between the hosel adapter and the hosel of the head. The second plurality of rotational positions may be limited by a second spline configuration between the hosel adapter and the shaft adapter.

Another aspect of the invention relates to a golf club having a releasably coupled head and shaft that includes a connection mechanism to couple the head to the shaft. The connection mechanism may include a hosel adapter insertable into a hosel of the head and rotatable inside the hosel between a first plurality of rotational positions associated with a loft angle of the head. The first part may have a first internal inclined bore with respect to a longitudinal axis of the bore of the hosel adapter. A shaft adapter may be coupled to the shaft at a distal end and insertable into the hosel adapter and rotatable inside said hosel adapter between a second plurality of rotational positions associated with a face angle of the head. The shaft adapter may have a second internal inclined bore receiving said distal end of said shaft. At least one of the hosel adapter or the shaft adapter may be releasably connected to either the shaft or the head. The first plurality of rotational positions may change the loft angle of the head and the second plurality of rotational positions may change the face angle of the head and the shaft, wherein changing the face angle is independent of changing the loft angle. The first plurality of rotational positions may be limited by a first spline configuration between the hosel adapter and the hosel of the head. The second plurality of rotational positions may be limited by a second spline configuration between the hosel adapter and the shaft adapter.

Another aspect of the invention relates to a golf club having a coupled head and shaft that includes a connection mechanism to couple the head to the shaft. The connection mechanism may include a hosel adapter having an outer wall insertable into a hosel of the head and rotatable inside the hosel between a first plurality of rotational positions. The hosel adapter may have a first internal inclined bore. A shaft adapter may be coupled to the shaft at a distal end and may have an outer wall configured to fit into said first internal inclined bore. The shaft adapter may be rotatable inside said first internal inclined bore between a second plurality of rotational positions. The shaft adapter may have a second internal inclined bore receiving said distal end of said shaft. The shaft adapter may include a stop ring extending radially from the second end of the shaft adapter such that the stop ring maintains the continual engagement between the hosel adapter and the shaft adapter.

Another aspect of the invention relates to a golf club having a coupled head and shaft that includes a connection mechanism to couple the head to the shaft. The connection mechanism may include a hosel adapter having an outer wall insertable into a hosel of the head and rotatable inside the hosel between a first plurality of rotational positions. The hosel adapter may have a first internal inclined bore. A shaft adapter may be coupled to the shaft at a distal end and may have an outer wall configured to fit into said first internal inclined bore. The shaft adapter may be rotatable inside said first internal inclined bore between a second plurality of rotational positions. The shaft adapter may have a second internal inclined bore receiving said distal end of said shaft. The first plurality of rotational positions may be limited by a first spline configuration between the hosel adapter and the hosel of the head. The second plurality of rotational positions may be limited by a second spline configuration between the hosel adapter and the shaft adapter. A first spline configuration engagement between the hosel adapter and the shaft adapter may limit the adjustability of the loft angle to five different loft angles, wherein the five loft angles are 8.5 degrees, 9.5 degrees, 10.5 degrees, 11.5 degrees, and 12.5 degrees. A second spline configuration engagement between the hosel adapter and the hosel of the head may limit the adjustability of the face angle to three different face angle configurations, wherein the three different face angle configurations open, neutral, and closed.

BRIEF DESCRIPTION OF THE DRAWINGS

A more complete understanding of the present invention and certain advantages thereof may be acquired by referring to the following detailed description in consideration with the accompanying drawings, in which:

FIGS. 13A and 13B illustrate a perspective view and close-up view of another position indicator on a golf club head/shaft connection system in accordance with examples of this invention;

Figure 1:
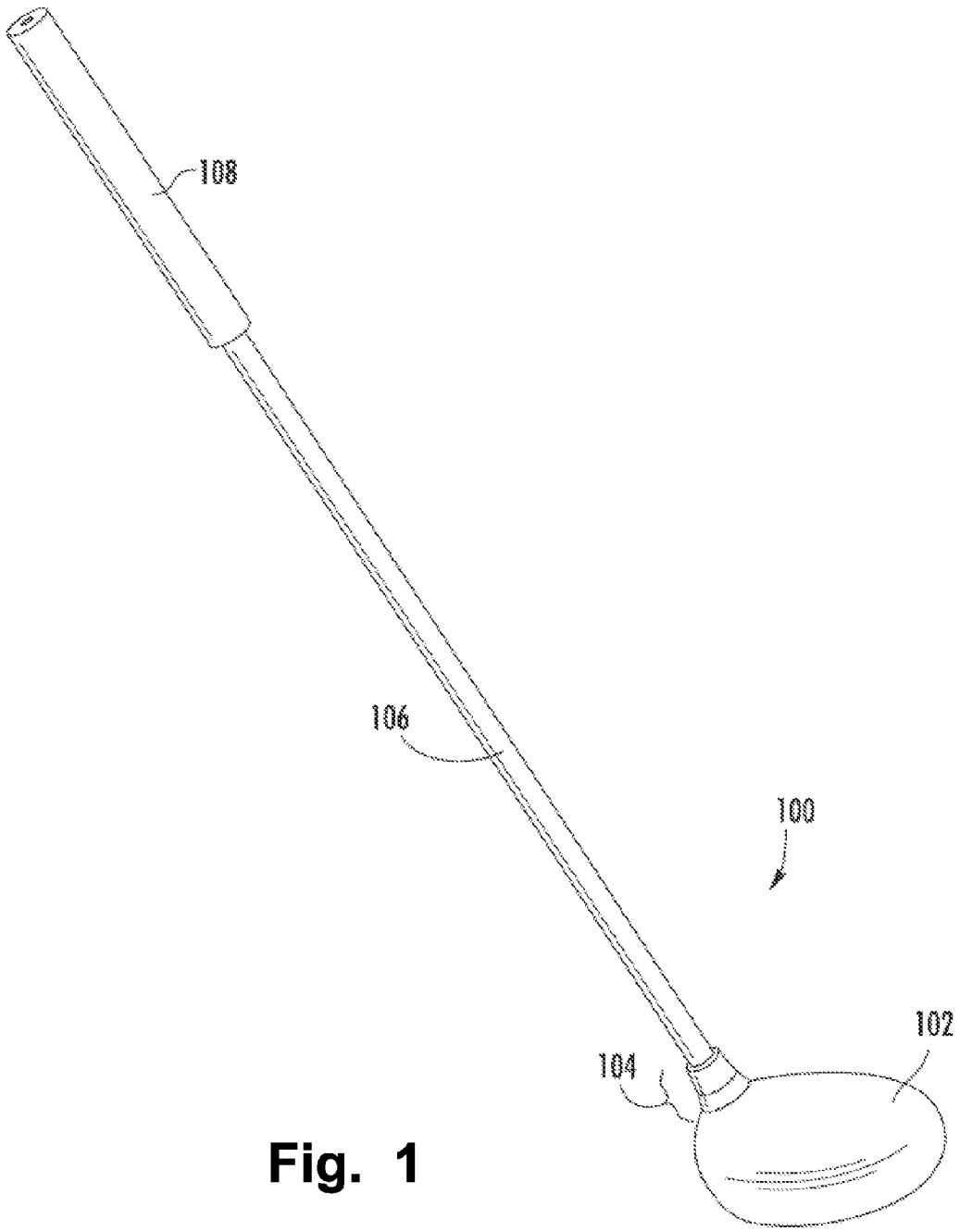
FIG. 1 generally illustrates a perspective view of an example golf club according to this invention.

The reader is advised that the attached drawings are not necessarily drawn to scale.

DETAILED DESCRIPTION

In the following description of various example structures in accordance with the invention, reference is made to the accompanying drawings, which form a part hereof, and in which are shown by way of illustration various example connection assemblies, golf club heads, and golf club structures in accordance with the invention. Additionally, it is to be understood that other specific arrangements of parts and structures may be utilized, and structural and functional modifications may be made without departing from the scope of the present invention. Also, while the terms "top," "bottom," "front," "back," "rear," "side," "underside," "overhead," and the like may be used in this specification to describe various example features and elements of the invention, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of this invention.

A. General Description of Golf Club Head/Shaft Connection Assemblies and Golf Clubs Including Such Assemblies According to Examples of the Invention In general, as described above, aspects of this invention relate to systems and methods for connecting golf club heads to shafts in a releasable manner so that the club heads and shafts can be readily interchanged and/or repositioned with respect to one another. More detailed descriptions of aspects of this invention follow.

1. Example Golf Club Head/Shaft Connection Assemblies and Golf Club Structures According to the Invention One aspect of this invention relates to golf club head/shaft connection assemblies for securely, but releasably, connecting a golf club head and shaft. Such assemblies may include, for example: (a) a shaft adapter being generally cylindrical in shape having a first end and an opposite second end, wherein the first end includes a first opening providing access to a cylindrical interior chamber for receiving a golf club shaft, wherein an exterior surface of the cylindrical structure (e.g., optionally nearer to the first end than the second end) includes a first rotation-inhibiting structure, and wherein the second end includes a securing structure; (b) a hosel adapter being generally cylindrical in shape, wherein an internal bore on a first end of the hosel adapter includes a second rotation-inhibiting structure that engages the first rotation-inhibiting structure and a second end of the hosel adapter includes a first opening for receiving a securing member, and further wherein an exterior surface of the hosel adapter includes a third rotation-inhibiting structure; (c) a hosel ring being generally cylindrical in shape, wherein an internal bore of the hosel ring includes a fourth rotation-inhibiting structure that engages the third rotation-inhibiting structure; and (d) a securing system for releasably engaging the securing structure. While a variety of different securing structures and securing systems may be used without departing from this invention, in some example structures according to this invention, the securing structure will include a threaded hole defined in the second end of the shaft adapter, and the securing system will include a threaded bolt element that engages the threaded hole.

A variety of rotation-inhibiting structures and systems may be used without departing from this invention. In some example structures according to this invention, the rotation-inhibiting structure may include splines and/or teeth.

The exterior surface of the shaft adapter and its cylindrical interior chamber may be coaxial. On the other hand, these cylindrical structures need not be coaxial (e.g., they may extend in different directions, they may extend in parallel but in a non-coaxial direction, etc.). By providing non-coaxial cylindrical interior and exterior surfaces (or through other features of the club head, shaft, etc.), various properties, positions, angles, and the like of the shaft with respect to the club head ball striking face may be changed, as will be explained in more detail below. If desired, the exterior surface of the shaft adapter (e.g., at the first end thereof) may include a rotational position indicator to allow a user to easily see the position of the shaft/club head connection member with respect to the club head when in use.

Additionally, the exterior surface of the hosel adapter and its interior bore may be coaxial. On the other hand, these cylindrical structures need not be coaxial (e.g., they may extend in different directions, they may extend in parallel but in a non-coaxial direction, etc.). By providing non-coaxial interior bore and exterior surfaces (or through other features of the club head, shaft, etc.), various properties, positions, angles, parameters and the like of the shaft with respect to the club head ball striking face may be changed, as will be explained in more detail below. If desired, the exterior surface of the hosel adapter (e.g., at the first end thereof) may include a rotational position indicator to allow a user to easily see the position of the shaft/club head connection member with respect to the club head when in use.

Aspects of this invention further relate to golf clubs in which the shaft is engaged with the golf club head using shaft/club head connection assemblies of the types described above. Such golf clubs may include: (a) a golf club head having a club head chamber that includes a first opening for receiving a securing member; (b) a hosel ring being generally cylindrical in shape, secured within the club head chamber, wherein an internal bore of the hosel ring includes a fourth rotation-inhibiting structure; (c) a shaft adapter being generally cylindrical in shape, the shaft adapter having a first end and an opposite second end, wherein the first end of the shaft adapter includes a second opening that defines a cylindrical interior chamber for receiving a golf club shaft, wherein an exterior surface of the shaft adapter includes a first rotation-inhibiting structure, and wherein the second end includes a securing structure; (d) a hosel adapter extending into the club head chamber of the golf club head, the hosel adapter being generally cylindrical in shape, wherein a first end of the hosel adapter includes a second rotation-inhibiting structure that engages the first rotation-inhibiting structure and a second end of the hosel adapter includes a first opening for receiving a securing member, and further wherein an exterior surface of the hosel adapter includes a third rotation-inhibiting structure that engages the fourth rotation-inhibiting structure of the hosel ring; (e) a shaft engaged in the cylindrical interior chamber of the shaft adapter; (f) a securing member extending into the end of the club head chamber of the golf club head and releasably engaging the securing structure of the shaft adapter to thereby releasably engage the shaft connection member with the golf club head; and/or (g) a grip member engaged with the free end of the shaft. The securing member may be inserted into the club head chamber of the club head through an opening provided in the sole of the club head.

2. Example Methods of Producing and Using Golf Club Head/Shaft Connection Assemblies and Golf Clubs Including Such Assemblies According to the Invention Another aspect of this invention relates to methods of producing club head/shaft connection assemblies in accordance with examples of this invention (e.g., of the types described above). Such methods may include, for example: (a) producing a shaft adapter that is cylindrical in shape, the shaft adapter having a first end and an opposite second end (e.g., via casting or molding processes, via extrusion, etc.); (b) producing an open cylindrical interior chamber for receiving a golf club shaft at the first end of the shaft adapter (e.g., via drilling or machining processes, via casting or molding processes, etc.); (c) forming a rotation-inhibiting structure as part of an exterior surface of the shaft adapter, e.g., nearer to the first end than the second end (e.g., by grinding, machining, molding, casting, etc.); (d) forming a securing structure at the second end of the shaft adapter (e.g., by casting, molding, drilling, tapping, or machining processes, etc.); (e) producing a hosel adapter that is cylindrical in shape, the hosel adapter having a first end and an opposite second end (e.g., via casting or molding processes, via extrusion, etc.); (f) forming a second rotation-inhibiting structure as part of the first end of the hosel adapter that engages the first rotation-inhibiting structure (e.g., by grinding, machining, casting, molding, etc.); (g) producing a hosel ring that is generally cylindrical in shape and secured within a club head chamber; (h) forming a third rotation-inhibiting structure as part of the exterior surface of the hosel adapter that engages a fourth rotation-inhibiting structure as part of an internal bore of the hosel ring (e.g., by grinding, machining, casting, molding, etc.); and (i) providing a securing member for engaging the securing structure (e.g., by manufacturing it, from third party suppliers, etc.). If desired, the securing structure may be formed as a threaded hole defined in the second end of the shaft adapter and the securing member may be provided as a threaded bolt element that is engageable with the threaded hole. The assembly may be formed so as to include any of the various structures and/or configurations described above (and described in more detail below).

Another aspect of this invention relates to methods of assembling golf clubs using club head/shaft connection assemblies in accordance with examples of this invention. Such methods may include: (a) providing a golf club head having a club head chamber (e.g., by manufacturing it, from a third party supplier, etc.), wherein the club head chamber includes a first opening for receiving a securing member; (b) producing a hosel ring that is generally cylindrical in shape and secured within the club head chamber; (c) forming a third rotation-inhibiting structure as part of the exterior surface of the hosel adapter that engages a fourth rotation-inhibiting structure as part of an internal bore of the hosel ring (e.g., by grinding, machining, casting, molding, etc.); (d) engaging a shaft with a shaft adapter, wherein the shaft adapter is cylindrical in shape, the shaft adapter having a first end and an opposite second end (e.g., via cements or adhesives, via other fusing techniques, in a releasable manner, etc.); (e) placing a hosel adapter into the club head chamber of the golf club head, engaging the fourth rotation-inhibiting structure on the hosel ring in a non-rotational manner (e.g., by cements, adhesives, fusing techniques, mechanical connectors, using rotation-inhibiting structures, etc.), wherein the hosel adapter has a first end that includes a second rotation-inhibiting structure and a second end that includes a first opening; (f) placing at least a portion of the shaft adapter into the hosel adapter such that the first rotation-inhibiting structure engages the second rotation-inhibiting structure provided with the hosel adapter to thereby inhibit rotation of the shaft adapter with respect to the hosel adapter and the golf club head; (g) placing a securing member into the second end of the club head chamber; and (h) releasably engaging the securing member with a securing structure provided with the shaft adapter to thereby releasably engage the shaft adapter with the golf club head.

If desired, various characteristics or parameters of the club head may be changed, e.g., by changing a position of the shaft with respect to the club head (e.g., by rotating the shaft and its shaft adapter with respect to the club head when the cylindrical interior shaft receiving chamber of the shaft adapter is non-coaxial with respect to its exterior cylindrical surface) to thereby change the loft angle, lie angle, face angle, offset, inset, or other parameters of the club head. Such methods may include: (a) releasing or disengaging the shaft adapter with respect to the golf club head; (b) changing a position of the shaft adapter with respect to the golf club head (e.g., by rotating them with respect to one another) to thereby alter a position of a free end of the shaft with respect to a ball striking face of the club head; and (c) releasably engaging the securing member with the securing structure of the shaft adapter to thereby releasably engage the shaft adapter with respect to the golf club head at the changed position.

The position of the hosel adapter may be changed with respect to the club head, e.g., by rotating the hosel adapter with respect to the club head. Such methods may include: (a) releasing or disengaging the shaft adapter with respect to the hosel adapter and the golf club head; (b) at least partially releasing or disengaging the hosel adapter with respect to the golf club head; (c) changing a rotational position or other orientation of the hosel adapter with respect to the golf club head; (d) placing at least a portion of the shaft adapter into the hosel adapter such that the rotation-inhibiting structure of the hosel adapter engages the rotation-inhibiting structures provided on the shaft adapter to thereby inhibit rotation of the shaft adapter with respect to the hosel adapter and the golf club head; (e) placing the securing member into the second end of the club head chamber; and (f) releasably engaging the securing member with a securing structure provided with the shaft adapter to thereby releasably engage the shaft adapter with the hosel adapter and the golf club head.

Specific examples of the invention are described in more detail below. The reader should understand that these specific examples are set forth merely to illustrate examples of the invention, and they should not be construed as limiting the invention.

C. Specific Examples of the Invention

FIG. 1 generally illustrates an example golf club 100 in accordance with at least some examples of this invention. This club 100 includes a club head 102, a releasable club head/shaft connection region 104 that connects the club head to a shaft 106 (which will be described in more detail below), and a grip member 108 engaged with the shaft 106. While a driver/wood-type golf club head 102 is illustrated in these figures, aspects of this invention may be applied to any type of club head, including, for example: fairway wood club heads (e.g., 3-woods with loft angles ranging from 13-17 degrees, 5 woods with loft angles ranging from 15-19 degrees); iron type golf club heads (of any desired loft, e.g., from a 0-iron or 1-iron to a wedge); wood or iron type hybrid golf club heads (of any desired loft, e.g., generally from 15-25 degree loft angles); putter heads; and the like. The club heads may be made from any desired materials, in any desired construction and/or in any desired manner, including from conventional materials, in conventional constructions, in conventional manners, as are known and used in the art, optionally modified (if necessary, e.g., in size, shape, inclusion of structures, etc.) to accommodate the releasable club head/shaft connection parts, examples of which will be described in more detail below.

Any desired materials also may be used for the shaft member 106, including conventional materials that are known and used in the art, such as steel, graphite based materials, polymers, composite materials, combinations of these materials, etc. Optionally, if necessary or desired, the shaft 106 may be modified (e.g., in size, shape, etc.) to accommodate the releasable club head/shaft connection parts. The grip member 108 may be engaged with the shaft 106 in any desired manner, including in conventional manners that are known and used in the art (e.g., via cements or adhesives, via mechanical connections, etc.). Any desired materials may be used for the grip member 108, including conventional materials that are known and used in the art, such as rubber, polymeric materials, cork, rubber or polymeric materials with cord or other fabric elements embedded therein, cloth or fabric, tape, etc. Optionally, if desired, the grip member 108 may be releasably connected to the shaft 106 using a releasable connection like releasable connection 104 (examples of which will be described in more detail below).

Figure 2:
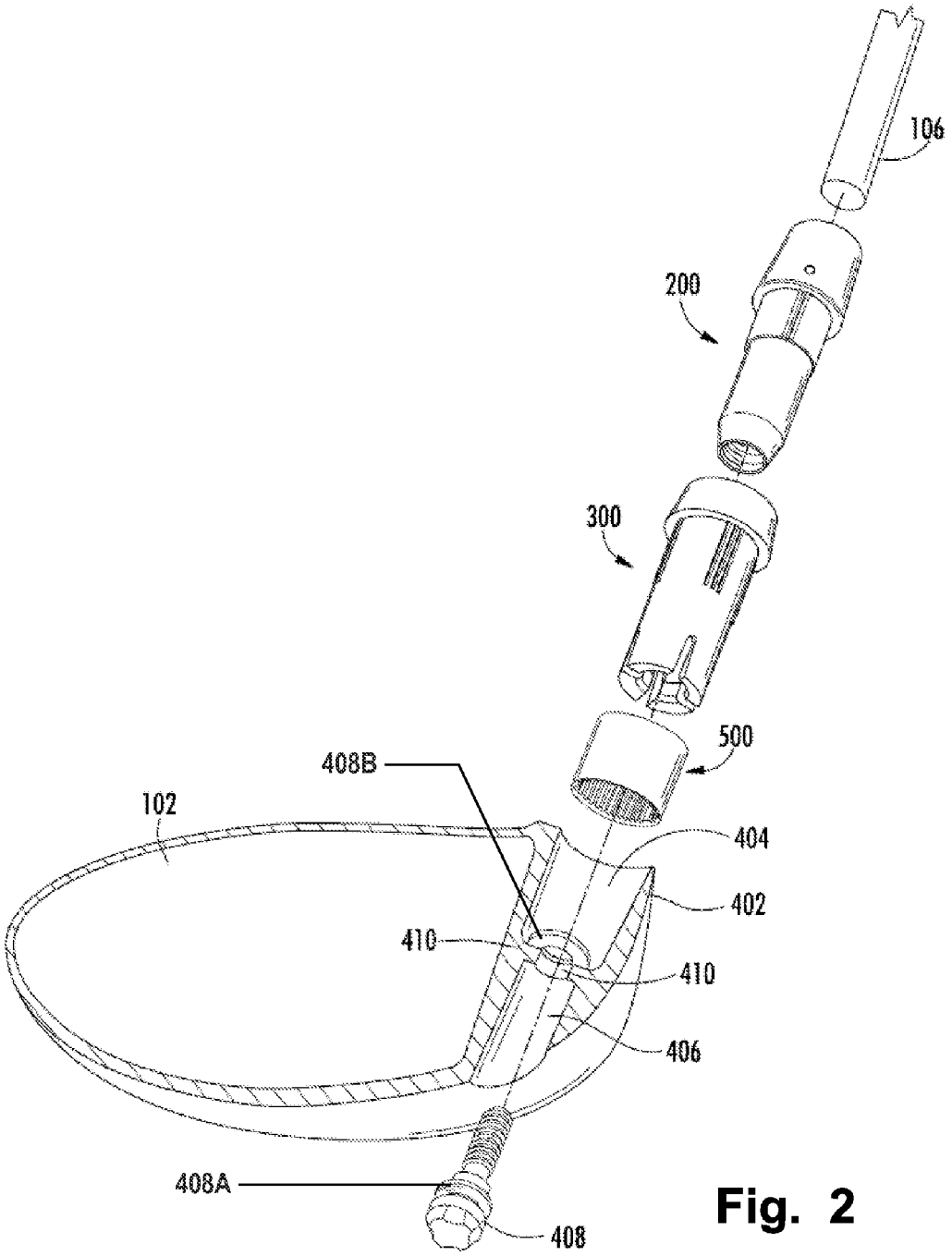
FIG. 2 illustrates an expanded view of a golf club utilizing an example golf club head/shaft connection system in accordance with an example of this invention.

A releasable connection 104 between golf club heads and shafts in accordance with examples of this invention now will be described in more detail in conjunction with FIGS. 2 through 12. FIG. 2 illustrates an exploded view of the releasable connection 104. As illustrated in FIG. 2, this releasable connection 104 between the golf club head 102 and the shaft 106 includes a shaft adapter 200, a hosel adapter 300, and a hosel ring 500. Generally, the hosel ring 500 is configured to engage a club head chamber 404 in the golf club head 102, the hosel adapter 300 is configured to engage in the hosel ring 500 and the golf club head 102, the shaft adapter 200 is configured to engage in the hosel adapter 300, and the shaft 106 is configured to engage the shaft adapter 200. The details of the engagement of these example components/parts will be explained in more detail below.

Figure 3A:
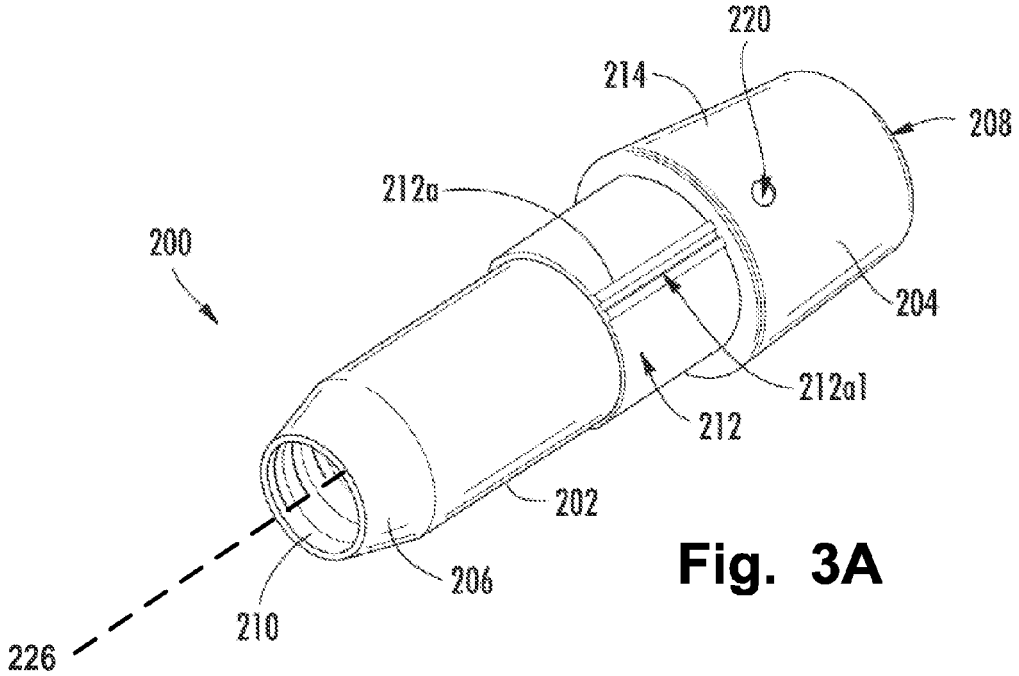
FIGS. 3A and 3B illustrate various views of an example shaft adapter that may be used in accordance with examples of this invention.
Figure 3B:
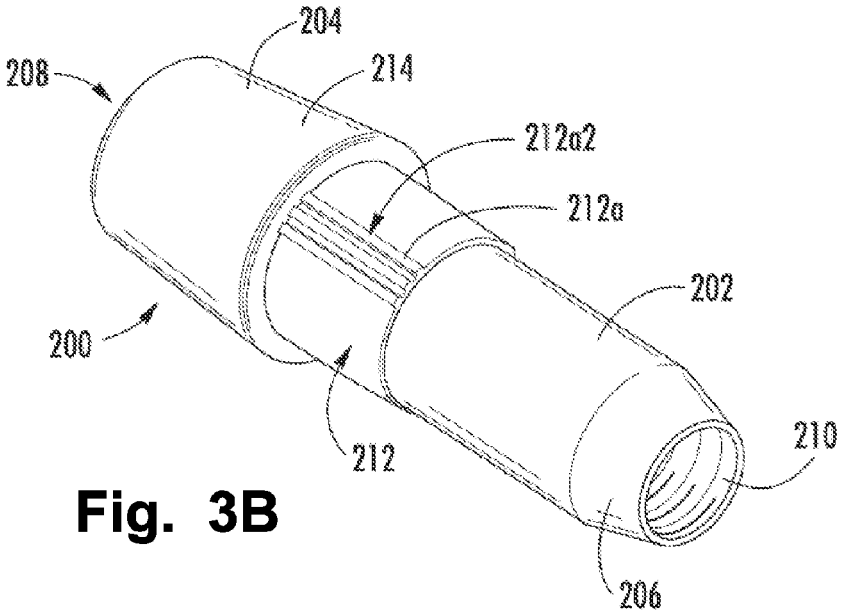

As noted above, the releasable connection 104 may include an example shaft adapter 200 in accordance with this invention. As illustrated in FIGS. 3A and 3B, this example shaft adapter 200 includes a generally cylindrical body 202 having a first end 204 and an opposite second end 206. The first end 204 defines an opening to an interior cylindrical chamber 208 for receiving the end of a golf club shaft 106. The second end 206 includes a securing structure (e.g., a threaded hole 210 in this example structure) that assists in securely engaging the shaft adapter 200 to a club head body 102 as will be explained in more detail below. In this example structure, as shown in FIGS. 3A and 3B, the interior chamber 208 is not open to the threaded hole 210 (i.e., it is a blind hole), but if desired, the threaded hole 210 may extend to and open in to the interior chamber 208 in some structures in accordance with this invention.

As shown, at least a portion of the first end 204 of the shaft adapter 200 includes a first rotation-inhibiting structure 212. While a variety of rotation-inhibiting structures may be provided without departing from this invention, in this example structure, the rotation-inhibiting structure 212 constitutes splines 212*a* extending along the longitudinal axis 226 of the exterior surface of the shaft adapter 200. The splines 212*a* of the shaft adapter 200 may prevent rotation of the shaft adapter 200 with respect to the member into which it is fit (e.g., a hosel adapter, as will be explained in more detail below).

While a variety of rotation-inhibiting structures may be used without departing from the invention, in the illustrated example, a portion of the first end 204 of the cylindrical body 202 has a set of splines 212*a*. In the example as illustrated in FIGS. 3A and 3B, the rotation-inhibiting structure 212 on the shaft adapter 200 includes a set of two splines 212*a*1 (the set of two splines 212*a*1 may be located underneath or inline with a rotational indicator 220 as will be described below) located on the cylindrical body 202 with a set of three splines 212*a*2 located on the opposite side of the cylindrical body 202. The interaction between these splines and the hosel adapter cylindrical interior will be discussed more below. Other configurations of splines may be utilized without departing from this invention.

The first rotation-inhibiting structure 212 may extend along any desired portion of the overall longitudinal length of the shaft adapter 200. For example, the length of the first rotation-inhibiting structure 212 may be less than 65% of the overall length of the shaft adapter 200, and in some examples, it may be less than 50%, less than 35%, or even less than 25% of the overall axial length. On the other hand, the first rotation-inhibiting structure 212 may extend along any desired portion of the overall longitudinal length of the shaft adapter 200. For example, the rotation-inhibiting structure 212 should be of sufficient length to enable strong and secure engagement with the hosel adapter 300 and the club head 102 in a non-rotational manner. As some more specific examples, the length may be at least 2% of the overall length of the shaft adapter 200, and in some examples at least 5%, at least 10%, or even least 20% of the overall axial length. If desired, the rotation-inhibiting structure 212 may extend from 2-65% of the overall axial length of the shaft adapter 200, or even from 5-50% or 10-35% of the overall length. If desired, the rotation-inhibiting structure 212 may extend all or substantially all of the overall longitudinal length L.

FIGS. 3A and 3B further illustrate that the first end 204 of the shaft adapter 200 includes an expanded portion 214. As will be more apparent from FIGS. 4A and 4B, this expanded portion 214 provides a stop that prevents the shaft adapter 200 from extending into the hosel adapter 300 and the club head body 102 and provides a strong base for securing the shaft adapter 200 to the hosel adapter 300 and the club head body 102. Also, the exterior shape of the first end 204 may be tapered to provide a smooth transition between the shaft 106, the hosel adapter 300, and the club head 102 and a conventional aesthetic appearance.

Figure 6A:
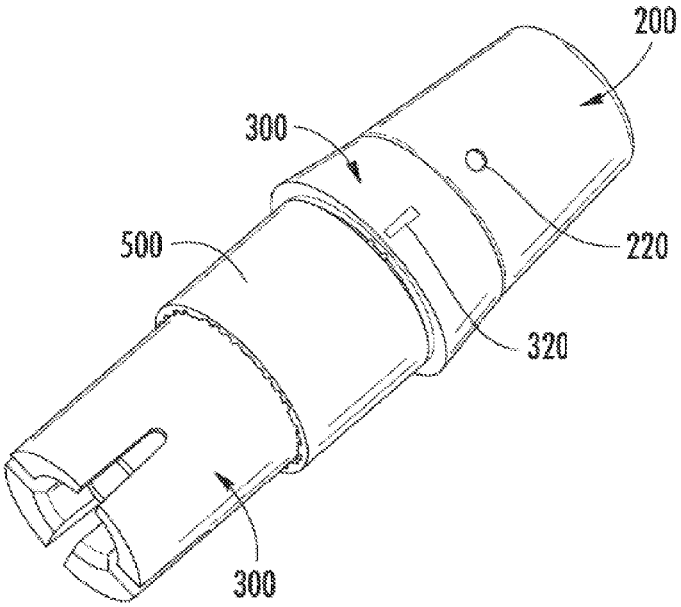
FIG. 6A illustrates an example assembled golf club head/shaft connection system in accordance with examples of this invention.
Figure 6B:
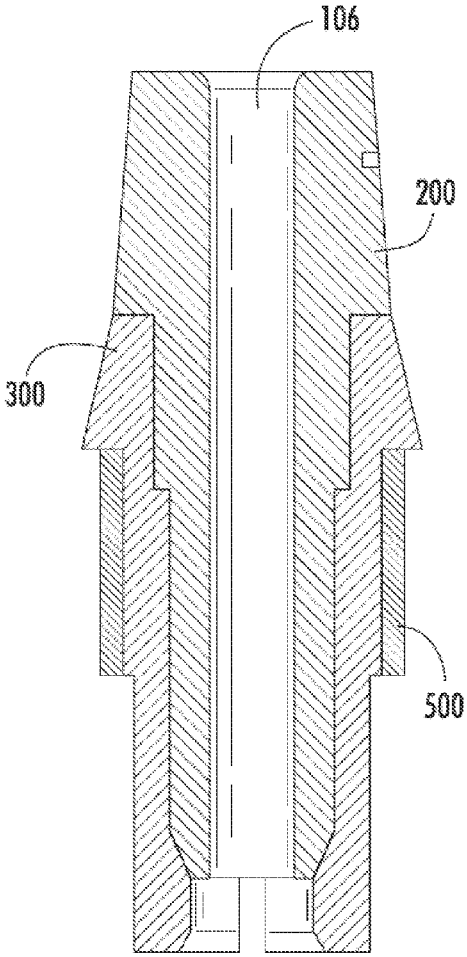
FIG. 6B illustrates an cutaway view of an example assembled golf club head/shaft connection system in accordance with examples of this invention.
Figure 7A:
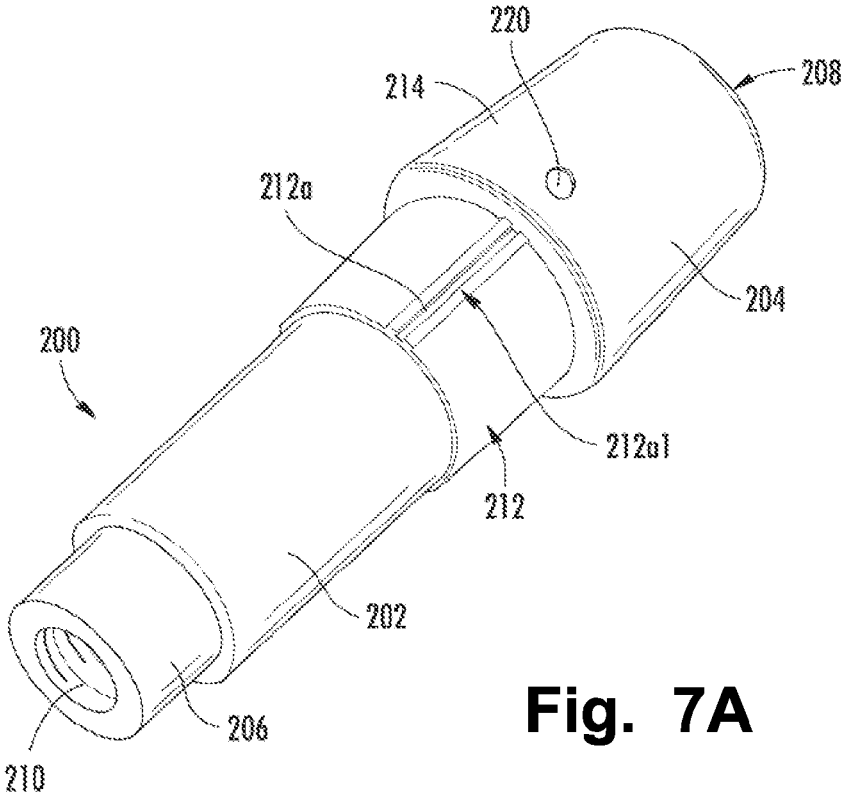
FIGS. 7A and 7B illustrate various views of another example shaft adapter that may be used in accordance with examples of this invention.
Figure 7B:
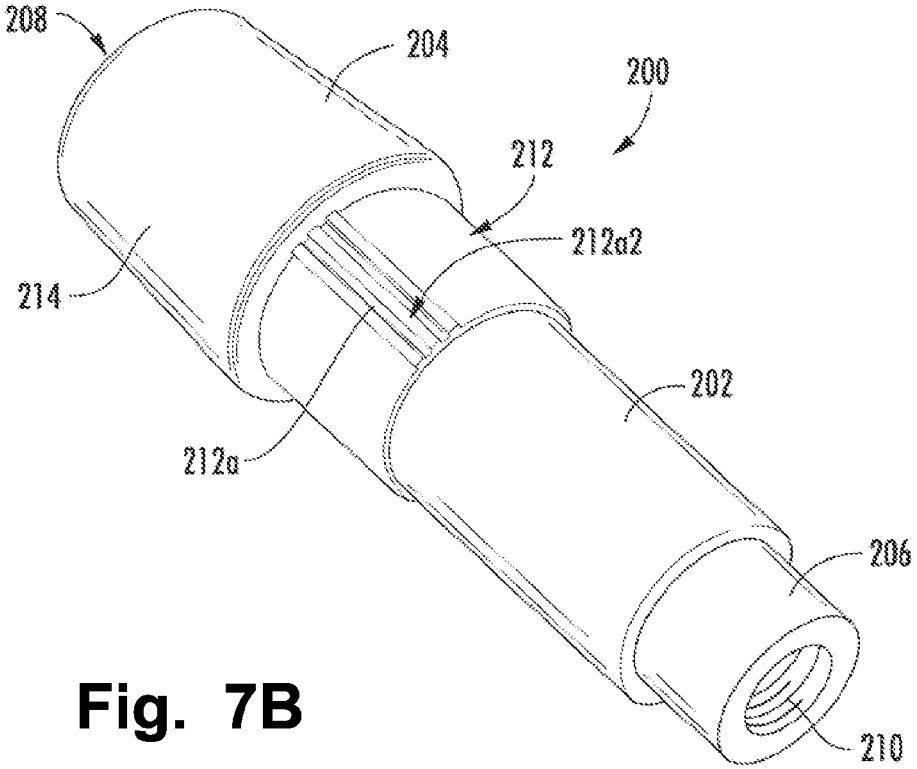
Figure 11A:
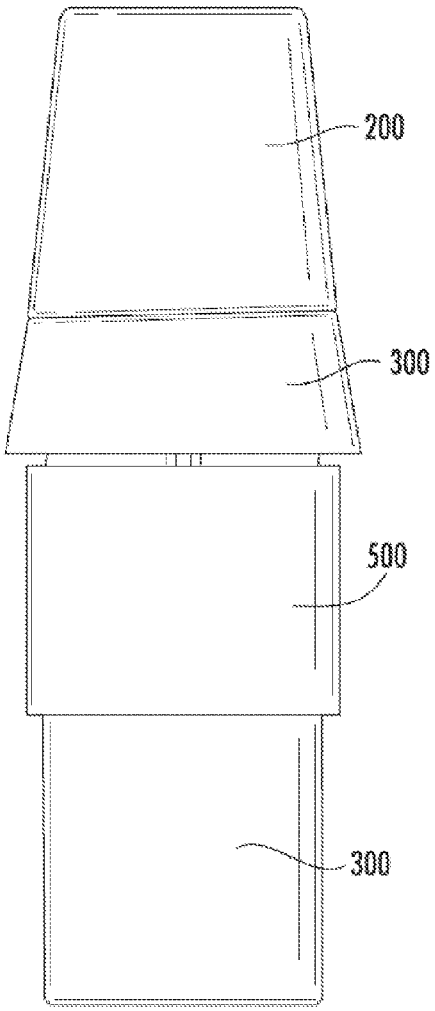
FIG. 11A illustrates another example assembled golf club head/shaft connection system in accordance with examples of this invention.
Figure 11B:
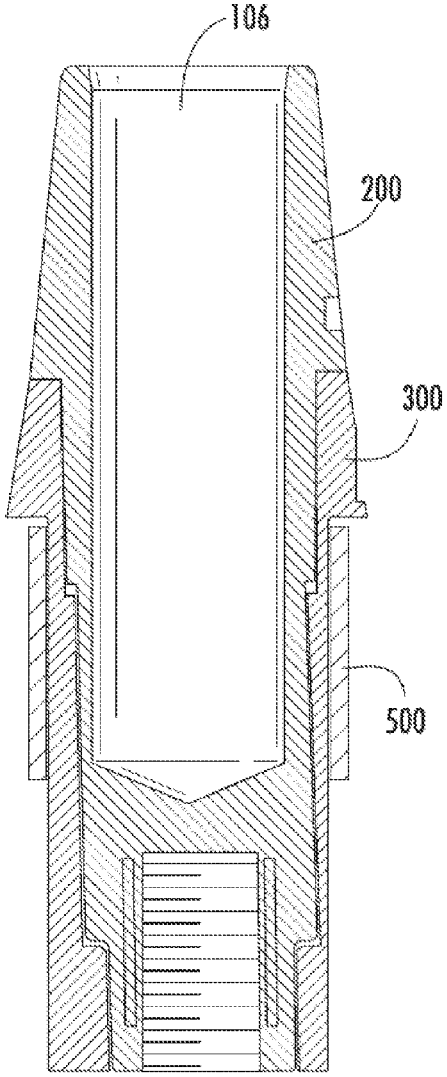
FIG. 11B illustrates an cutaway view of another example assembled golf club head/shaft connection system in accordance with examples of this invention.

Other features of this example shaft adapter 200 may include an "off-axis" or angled bore hole or interior chamber 208 in which the shaft 106 is received as illustrated, for example, in FIGS. 6B and 11B. More specifically, in this illustrated example, the outer cylindrical surface of the shaft adapter 200 extends in a first axial direction, and the interior cylindrical surface of the bore hole 208 extends in a second axial direction that differs from the first axial direction, thereby creating a shaft adapter offset angle. In this manner, while the shaft adapter 200 exterior maintains a constant axial direction corresponding to that of the interior of the hosel adapter 300 and the openings, the shaft 106 extends away from the club head 102 and the hosel adapter 300 at a different and adjustable angle with respect to the club head 102, the hosel adapter 300, and the club head's ball striking face. In this given example, the shaft position and/or angle corresponds to a given face angle of the golf club head 102. One rotational position may be neutral face, one rotational position may be open face, and one rotational position may be closed face. Other rotational positions may be utilized without departing from this invention. The shaft position and/or face angle may be adjusted, for example, by rotating the shaft adapter 200 with respect to the hosel adapter 300 and the club head hosel.

While any desired shaft adapter offset angle may be maintained between the first axial direction and the second axial direction, in accordance with some examples of this invention, this shaft adapter offset angle or face angle adjustment may be between 0.25 degrees and 10 degrees, and in some examples between 0.5 degrees and 8 degrees, between 0.75 degrees and 6 degrees, or even between 1 degree and 4 degrees. In more specific examples of the invention, the shaft adapter offset angle or face angle adjustment may by approximately 1.5 degrees offset or 2.0 degrees offset.

Figure 15:
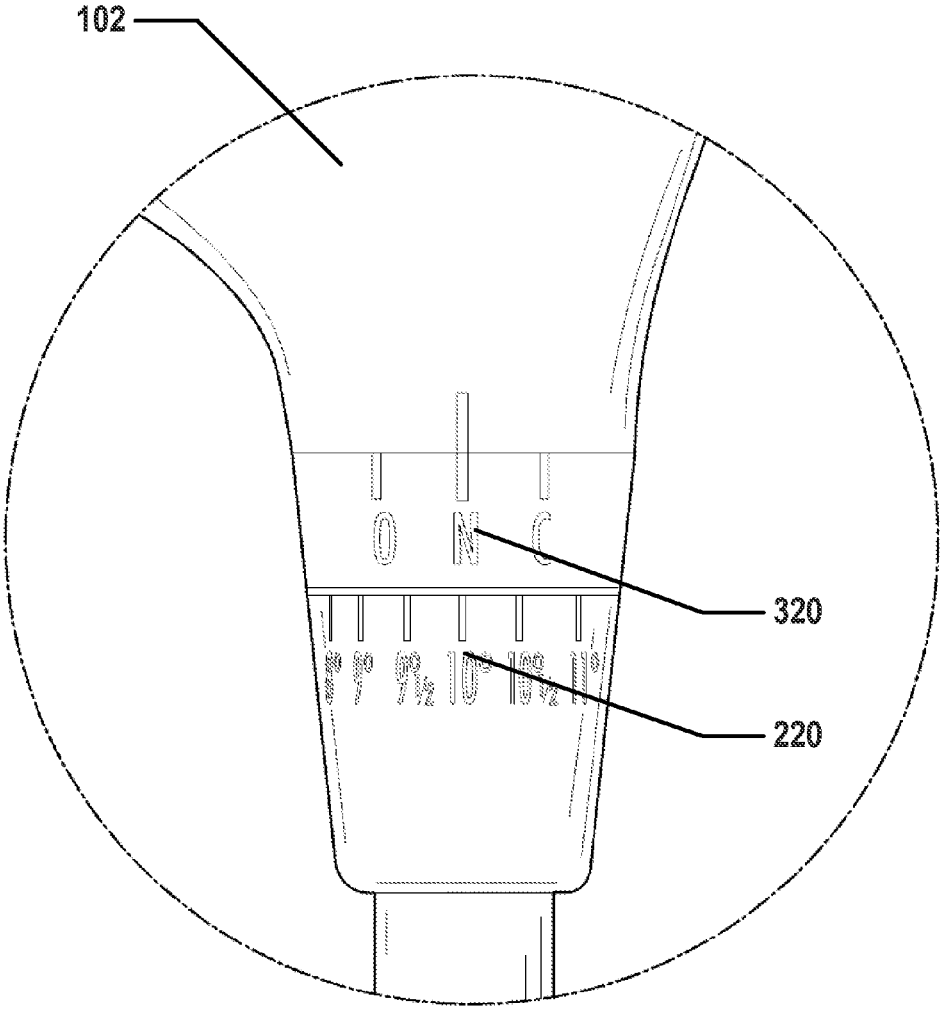
FIG. 15 illustrates a close-up view of another position indicator on a golf club head/shaft connection system in accordance with examples of this invention.
Figure 16:
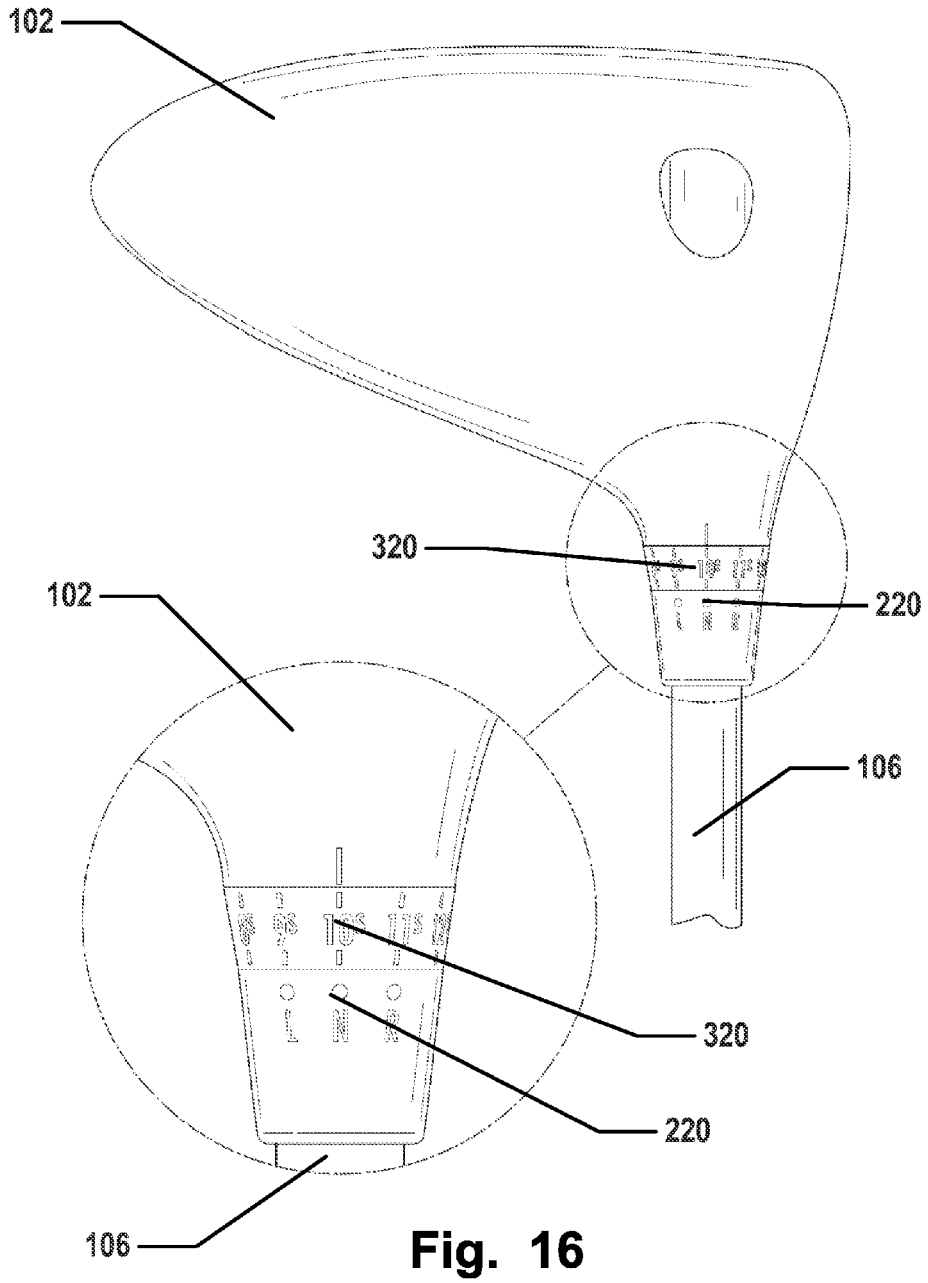
FIG. 16 illustrates a perspective view and a close-up view of another position indicator on a golf club head/shaft connection system in accordance with examples of this invention.

Additionally, the exterior surface of the shaft adapter may include a rotational position indicator 220 to allow the golfer to easily see the position of the shaft/club head connection member with respect to the club head 102 when in use. This rotational position indicator 220 may be located at the first end 204 thereof. The rotational position indicator 220 may include setting adjustments for face angle. The rotational position indicator 220 may include an "O" for open face angle, an "N" for neutral face angle, and a "C" for closed face angle, as illustrated in FIGS. 13A-15. In other configurations, as illustrated in FIG. 16, the rotational position indicator may include an "L" for left face angle, an "N" for neutral face angle, and an "R" for right face angle. Any number of different markings and adjustment configurations may be utilized for the rotational position indicator 220 without departing from this invention. Other annotations or labeling of the for the rotational position indicator 220 may be utilized without departing from the invention. For example, instead of using conventional face annotations of "ONC" or "LNR", the face angle may be visually illustrated using arrows or lines, straight, curved, or angled. Other visual indicators may be utilized without departing from this invention.

The shaft adapter 200 may be made from any desired materials and from any desired number of independent parts without departing from this invention. In this illustrated example, the entire shaft adapter 200 is made as a unitary, one-piece construction from conventional materials, such as metals or metal alloys, plastics, and the like. In at least some example structures according to this invention, the shaft adapter 200 will be made from a titanium, aluminum, magnesium, steel, or other metal or metal alloy material. Additionally, the shaft adapter 200 may be made from a self-reinforced polypropylene (SRP), for example PrimoSpire® SRP. The various holes (e.g., chamber 208 and threaded opening 210) and/or surface structures (e.g., splines 212*a*, expanded portions) may be produced in the material in any desired manner without departing from the invention, including via production methods that are commonly known and used in the art, such as by drilling, tapping, machining, lathing, extruding, grinding, casting, extruding, molding, etc.

Figure 4:
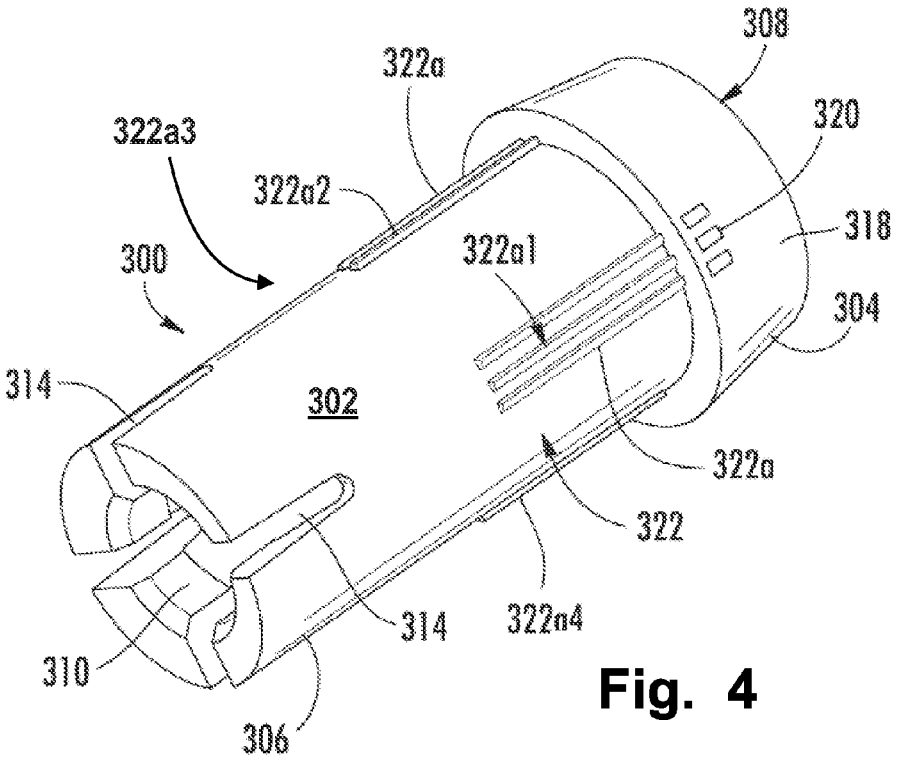
FIG. 4 illustrates a perspective view of an example hosel adapter that may be used in accordance with examples of this invention.
Figure 8A:
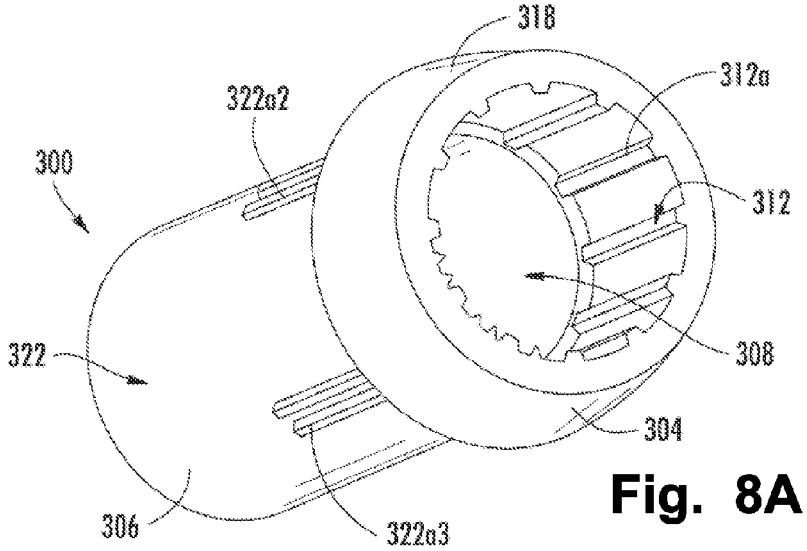
FIGS. 8A and 8B illustrate various views of another example hosel adapter that may be used in accordance with examples of this invention.
Figure 8B:
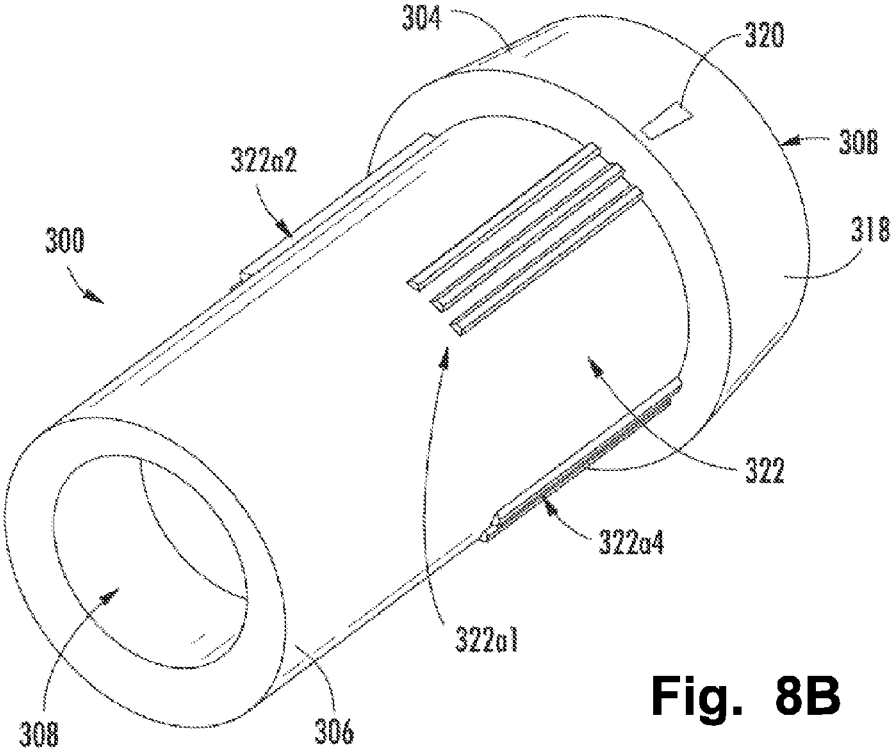

The example releasable connection 104 may further include a hosel adapter 300. FIG. 4 illustrates an example hosel adapter 300 in accordance with this invention. As shown, the hosel adapter 300 is generally cylindrical in shape. The hosel adapter 300 has a first end 304 and an opposite second end 306. The first end 304 defines an opening to a borehole 308 for receiving the shaft adapter 200. Within the first end 304 and along the interior sides of the borehole 308, the first end 304 includes a second rotation-inhibiting structure 312 configured to engage the first rotation-inhibiting structure 212 on the shaft adapter 200 (e.g., in an interlocking manner with respect to rotation). The internal portion of the borehole 308 as illustrated in FIG. 4 does include the second rotation-inhibiting structure 312 as is illustrated in FIG. 8A.

As illustrated in FIG. 4 (and FIG. 8A), at least a portion of the interior of the first end 304 of the hosel adapter 300 includes the second rotation-inhibiting structure 312. While a variety of rotation-inhibiting structures may be provided without departing from this invention, in this example structure, the second rotation-inhibiting structure 312 constitutes splines 312*a* extending along the interior longitudinal axis. The splines 312*a* of the hosel adapter 300 may prevent rotation of the shaft adapter 200 with respect to the hosel adapter 300 into which it is fit (and ultimately with respect to a golf club head). The splines 312*a* of the hosel adapter 300 and the splines 212*a* of the shaft adapter 200 may be configured to interact with each other to thereby limit the number of rotations of the shaft adapter 200 within the hosel adapter 300. This will be explained more below.

Other features of this example hosel adapter 300 may include an "off-axis" or angled bore hole or interior chamber 308 in which the shaft adapter 200 is received as illustrated, for example, in FIGS. 6B and 11B. More specifically, in this illustrated example, the outer cylindrical surface of the hosel adapter 300 extends in a first axial direction, and the interior cylindrical surface of the bore hole 308 extends in a second axial direction that differs from the first axial direction, thereby creating a hosel adapter offset angle. In this manner, while the hosel adapter 300 exterior maintains a constant axial direction corresponding to that of the interior of the club head chamber 404 and hosel ring 500 and the openings, the shaft adapter 200 (and thereby the shaft 106) extends away from the club head 102 at a different and adjustable angle with respect to the club head 102, the hosel adapter 300, and the club head's ball striking face. In this given example, the shaft position and/or angle corresponds to a given loft angle. The rotational positions for loft angle may be defined by loft angles starting from approximately 7.5 degrees to 12.5 degrees. Similar configurations of loft angles starting lower and higher may also be utilized without departing from this invention. The club head position and/or loft angle may be adjusted, for example, by rotating the hosel adapter 300 with respect to the hosel ring 500 and the club head 102.

While any desired hosel adapter offset angle may be maintained between the first axial direction and the second axial direction, in accordance with some examples of this invention, this hosel adapter offset angle or face angle adjustment may be between 0.25 degrees and 10 degrees, and in some examples between 0.5 degrees and 8 degrees, between 0.75 degrees and 6 degrees, or even between 1 degree and 4 degrees. In more specific examples of the invention, the hosel adapter offset angle or face angle adjustment may by approximately 1 degree or one-half degree offset.

The second end 306 of the hosel adapter 300 defines a second opening 310 for receiving a securing member 408. Generally, the second opening 310 is sized such that the securing member 408 is able to freely pass through the second opening 310 to engage the threaded hole 210 in the shaft adapter 200. Alternatively, if desired, the securing member 408 also may engage the hosel adapter 300 at the second opening 310 (e.g., the second opening 310 may include threads that engage threads provided on the securing member 408).

As illustrated in FIG. 4, the second end 306 of the hosel adapter 300 may define one or more notches or grooves 314. The grooves 314 may allow the second end 306 of the hosel adapter 300 to flare outward away from the center of the bore 308. For example, when the hosel adapter 300 is inserted into the club head 102 and club head chamber 404, the grooves 314 help to take up any tolerance within the hosel adapter bore 308 when the second end 306 of the hosel adapter 300 contacts the bottom portion of the club head chamber 404. The grooves 314 may cooperate with the club head 102 (e.g., flaring within the bore 308 and taking up tolerance within the club head chamber 404) to cause the hosel adapter 300 to be stable within the club head 102. The notches or grooves 314 may extend axially along the exterior of the hosel adapter 300 along any desired portion of the overall longitudinal length L2 of the hosel adapter 300. Generally, the grooves 314 are dimensioned for optimum fit and stability for the hosel adapter 300 within the club head 102.

The hosel adapter 300 may also be non-rotatable with respect to the golf club head 102. As illustrated in FIG. 4, the exterior of the first end 304 along an exterior surface 302 of the hosel adapter 300 includes a third rotation-inhibiting structure 322 configured to engage a fourth rotation-inhibiting structure 512 on a hosel ring 500 (e.g., in an interlocking manner with respect to rotation). As shown, at least a portion of the first end 304 of the hosel adapter 300 includes the third rotation-inhibiting structure 322 on the exterior surface 302 of the hosel adapter. While a variety of rotation-inhibiting structures may be provided without departing from this invention, in this example structure, the rotation-inhibiting structure 322 constitutes splines 322*a* extending along the longitudinal axis of the exterior surface of the hosel adapter 300. The splines 322*a* on the exterior surface of the hosel adapter 300 may prevent rotation of the hosel adapter 300 with respect to the member into which it is fit (e.g., a club head or hosel ring 500, as will be explained in more detail below).

In the example as illustrated in FIG. 4, the rotation-inhibiting structure 322 on the exterior surface of the hosel adapter 300 includes a set of three splines 322*a*1 located on the exterior surface 302 (the set of three splines 322*a*1 may be located underneath or inline with the rotational indicator 320 as will be described below), a set of two splines 322*a*2 located a quarter way around the exterior surface 302, a set of two splines 322*a*3 (not shown in FIG. 4) located another quarter way around the exterior surface 302 or on the opposite side of the set of three splines 322*a*1, and a last set of two splines 322*a*4 located another quarter way around the exterior surface 302 or on the opposite side of the set of two splines 322*a*2. The interaction between these splines and the hosel ring 500 will be discussed more below. Other configurations of splines may be utilized without departing from this invention.

The third rotation-inhibiting structure 322 may extend along any desired portion of the overall longitudinal length of the hosel adapter 300. For example, the length of the third rotation-inhibiting structure 322 may be less than 65% of the overall length of the hosel adapter 300, and in some examples, it may be less than 50%, less than 35%, or even less than 25% of the overall axial length. On the other hand, the third rotation-inhibiting structure 322 may extend along any desired portion of the overall longitudinal length of the hosel adapter 300. For example, the rotation-inhibiting structure 322 should be of sufficient length to enable strong and secure engagement with the hosel ring 500 and the club head 102 in a non-rotational manner. As some more specific examples, the length may be at least 2% of the overall length of the hosel adapter 300, and in some examples at least 5%, at least 10%, or even least 20% of the overall axial length. If desired, the rotation-inhibiting structure 322 may extend from 2-65% of the overall axial length of the hosel adapter 300, or even from 5-50% or 10-35% of the overall length. If desired, the rotation-inhibiting structure 322 may extend all or substantially all of the overall longitudinal length.

FIG. 4 further illustrates that the first end 304 of the hosel adapter 300 includes an expanded portion 318. As will be more apparent from FIGS. 2 and 6A, this expanded portion 318 provides a stop that prevents the hosel adapter 300 from extending into the club head body and provides a strong base for securing the hosel adapter 300 to the club head body 102. Also, the exterior shape of the first end 304 may be tapered to provide a smooth transition between the shaft 106 and the club head 102 and a conventional aesthetic appearance.

Additionally, the exterior surface of the hosel adapter 300 may include a rotational position indicator 320 to allow the user to easily see the position of the hosel adapter 300 with respect to the club head 102 when in use. This rotational position indicator 320 may be located at the first end 304 thereof. The rotational position indicator 320 may include setting adjustments for loft angle. In the exemplary embodiment illustrated in FIG. 4, there may be three different loft angle adjustments. In the exemplary embodiment illustrated in FIGS. 13A-14B, there may be five different loft angle adjustments, (i.e., 8 degrees, 9 degrees, 10 degrees, 11 degrees, and 12 degrees). In the exemplary embodiment illustrated in FIG. 16, the may be five different loft angle adjustments (i.e., 8.5 degrees, 9.5 degrees, 10.5 degrees, 11.5 degrees, and 12.5 degrees). In the exemplary embodiment illustrated in FIG. 15, there may be seven different loft angle adjustments (i.e., 8 degrees, 9 degrees, 9.5 degrees, 10 degrees, 10.5 degrees, 11 degrees, and 12 degrees). Any number of different markings and adjustment configurations may be utilized for the rotational position indicator 320 without departing from this invention. Other annotations or labeling of the for the rotational position indicator 320 may be utilized without departing from the invention. For example, instead of using conventional loft angles, such as 8.5 degrees, 9.5 degrees, etc., the loft angle may be visually illustrated by a small up arrow, a large up arrow, a small down arrow, and a large down arrow. In another exemplary embodiment, the loft angle may be visually illustrated by angled arrows. Other visual indicators may be utilized without departing from this invention.

The hosel adapter 300 may be made from any desired materials and from any desired number of independent parts without departing from this invention. In this illustrated example, the entire hosel adapter 300 is made as a unitary, one-piece construction from conventional materials, such as metals or metal alloys, plastics, and the like. In at least some example structures according to this invention, the hosel adapter 300 will be made from a titanium, aluminum, magnesium, steel, or other metal or metal alloy material. Additionally, the hosel adapter 300 may be made from a self-reinforced polypropylene (SRP), for example PrimoSpire® SRP. The bore and/or surface structures (e.g., splines 312*a*, splines 322*a*, and expanded portion 318) may be produced in the material in any desired manner without departing from the invention, including via production methods that are commonly known and used in the art, such as by drilling, tapping, machining, lathing, extruding, grinding, casting, molding, etc. The shaft adapter 200 and hosel adapter 300 and any of the other parts could be metal or plastic, or any other suitable materials in any combination. For example, the hosel adapter 300 may be a high-strength plastic while the shaft adapter 200 is made of a metal. Other combinations may utilized without departing from the invention.

Figure 5:
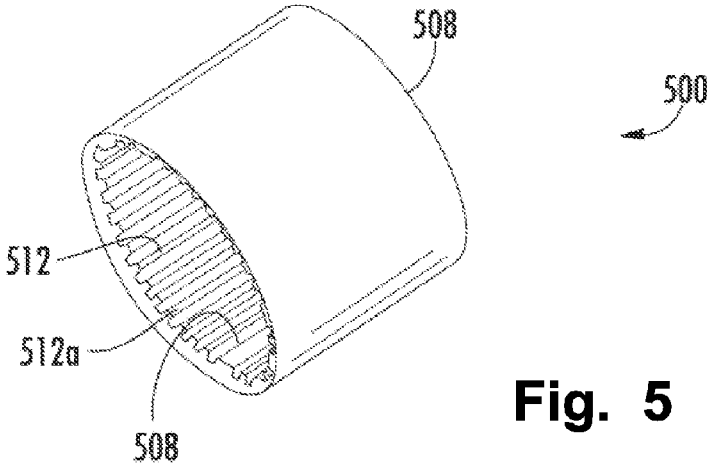
FIG. 5 illustrates a perspective view of an example hosel ring that may be used in accordance with examples of this invention.

The example releasable connection 104 may further include a hosel ring 500. FIG. 5 illustrates an example hosel ring 500 in accordance with this invention. As shown, the hosel ring 500 is generally cylindrical in shape. The hosel ring 500 defines an opening to a borehole 508 for receiving the hosel adapter 300. Along the interior sides of the borehole 508, the hosel ring 500 includes a fourth rotation-inhibiting structure 512 configured to engage the third rotation-inhibiting structure 322 on the hosel adapter 300 (e.g., in an interlocking manner with respect to rotation).

The hosel ring 500 may be other shapes without departing from this invention. For example, the hosel ring 500 may be oval. Another embodiment may include a hosel ring 500 that is oblong, a circle cut in half with two straight-sided sections in connecting the two circles. With an oblong hosel ring 500, the hosel ring 500 may be rotatable between a first and second position and the hosel ring 500 may further include an off-axis bore, such that when it is rotated, a club head parameter is changed. The oblong hosel ring 500 may independently change the lie angle of the club head from an upright lie angle to a downward lie angle. The oblong hosel ring 500 may independently change other club head parameters without departing from this invention.

As illustrated in FIG. 5, at least a portion of the interior of the hosel ring 500 includes the fourth rotation-inhibiting structure 512. While a variety of rotation-inhibiting structures may be provided without departing from this invention, in this example structure, the fourth rotation-inhibiting structure 512 constitutes splines 512*a* extending along the interior longitudinal axis. The splines 512*a* of the hosel ring 500 may prevent rotation of the hosel adapter 300 with respect to the club head 102 into which it is fit. The splines 512*a* of the hosel ring 500 and the exterior splines 322*a* of the hosel adapter 300 may be configured to interact with each other to thereby limit the number of rotations of the hosel adapter 300 within the hosel ring 500. This interaction will be explained more below.

Figure 12:
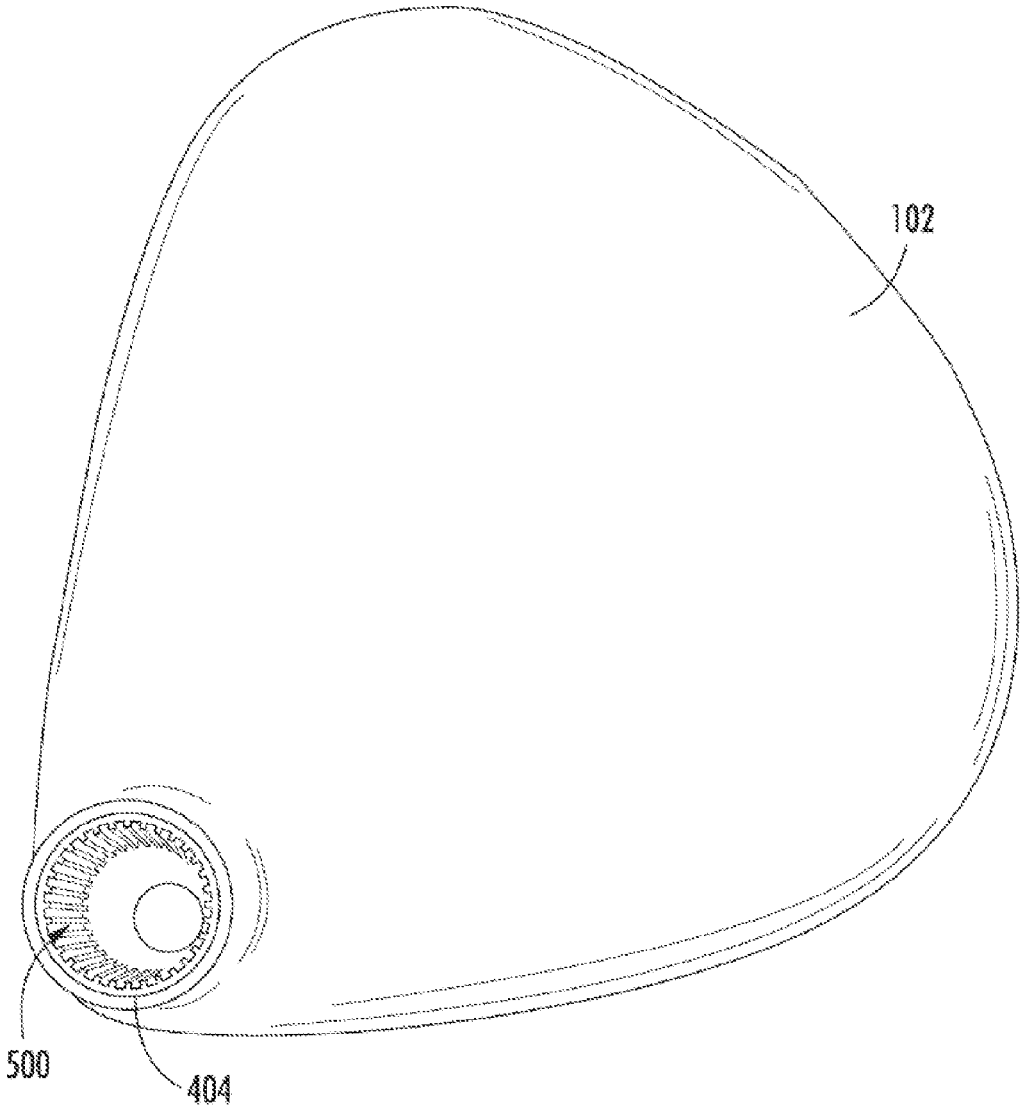
FIG. 12 illustrates a perspective view of a golf club head in accordance with examples of this invention.
Figure 14A:
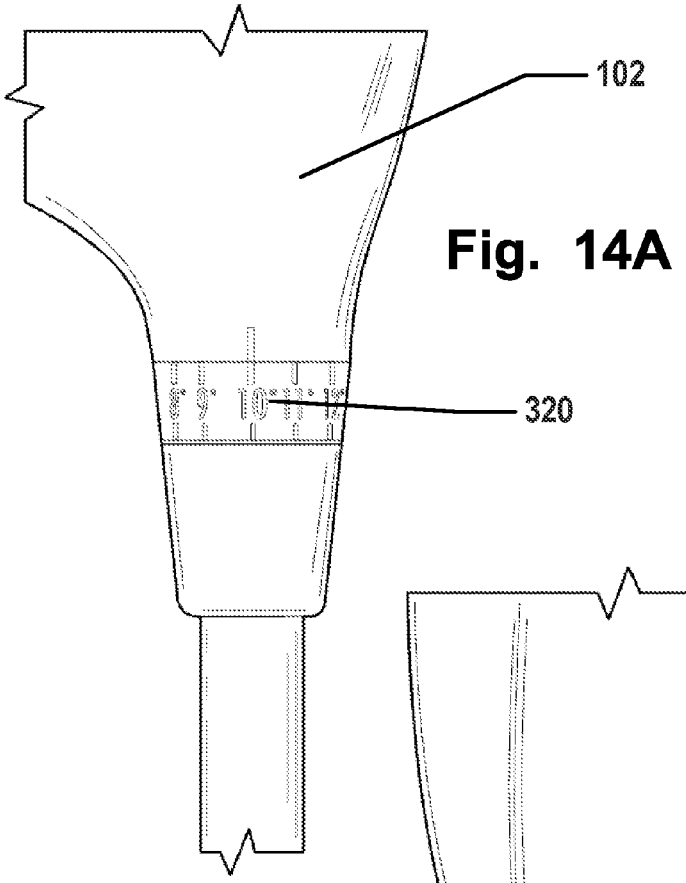
FIGS. 14A and 14B illustrate a perspective view and close-up view of another position indicator on a golf club head/shaft connection system in accordance with examples of this invention.
Figure 14B:
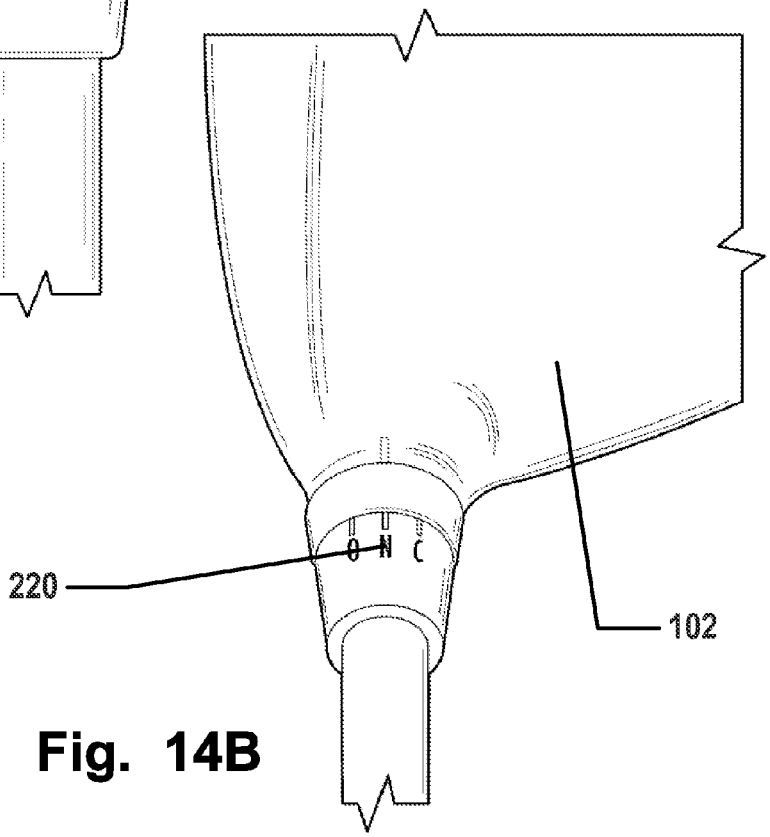

The hosel ring 500 may also be non-rotatable with respect to the golf club head 102. In an exemplary embodiment, the hosel ring 500 may secured to the club head chamber 404 by any means known and used in the art, such as adhesive, glue, epoxy, cement, welding, brazing, soldering, or other fusing techniques, etc. FIG. 12 illustrates the hosel ring 500 secured to the club head 102 in the club head chamber 404. Additionally, the hosel ring 500 may be an integral part of the club head 102, wherein the hosel ring 500 may be molded into the club head chamber 404.

The hosel ring 500 may be made from any desired materials and from any desired number of independent parts without departing from this invention. In this illustrated example, the entire hosel ring 500 is made as a unitary, one-piece construction from conventional materials, such as metals or metal alloys, plastics, and the like. In at least some example structures according to this invention, the hosel ring 500 will be made from a titanium, aluminum, magnesium, steel, or other metal or metal alloy material. The bore and/or surface structures (e.g., splines 512*a*) may be produced in the material in any desired manner without departing from the invention, including via production methods that are commonly known and used in the art, such as by drilling, tapping, machining, lathing, extruding, grinding, casting, molding, etc.

FIGS. 7A-11B illustrate another exemplary embodiment similar to the releasable connection as described above. The same reference numbers have been utilized for these figures as were used for the previous figures for simplicity and understanding. In this embodiment, the shaft adapter 200 and the hosel adapter 300 are illustrated with off-axis bores.

The adjustment of the rotational position of the shaft adapter 200 (and the attached shaft 106) and hosel adapter 300 will be explained in more detail below in conjunction with FIG. 2. Changing the rotational position of the shaft adapter 200 with respect to the hosel adapter 300 may adjust one or more of various parameters, such as loft angle, face angle, or lie angle of the overall golf club. In the exemplary embodiment as illustrated in FIGS. 2-12, changing the rotational position of the shaft adapter 200 with respect to the hosel adapter 300 may adjust the face angle. Other parameters of the club head may be designed to be adjustable, such as inset distance, offset distance, to fade bias, to draw bias, etc). Additionally, changing the rotational position of the hosel adapter 300 with respect to the hosel ring 500 and the club head 102 may adjust one or more of the various parameters of the overall golf club. In the exemplary embodiment as illustrated in FIGS. 2-12, changing the rotational position of the hosel adapter 300 with respect to the hosel ring 500 and the club head 102 may adjust the loft angle. In these specific embodiments, the shaft adapter 200 and the hosel adapter 300 have independent off-axis bores which enable them to independently adjust the face angle (shaft adapter 200) and the loft angle (hosel adapter 300).

To enable users to easily identify the club head's "settings" (e.g., the club head body 102 position and/or orientation with respect to the shaft 106), any or all of the shaft 106, the shaft adapter 200, hosel adapter 300, and/or the club head 102 may include markings or indicators. FIGS. 3A and 3B show an indicator 220 on the shaft adapter 200 (e.g., on the expanded portion 214). FIG. 4 shows an indicator 320 on the hosel adapter 300 (e.g., on the expanded portion 318). By noting the relative positions of the various indicators, a club fitter or other user can readily determine and know the position of the shaft 106 with respect to the club head body 102 and its ball striking face. If desired, the indicators (e.g., indicators 220, or 320) may be associated with and/or include specific quantitative information, such as a specifically identified loft angle and face angle.

Golf club adjustability design has generally included having mating parts and cooperating engagement surfaces allowing for specific adjustability of the golf club head 102. However, these current designs offer many possible adjustable combinations regarding loft angles, face angles, and lie angles. While this adjustability provides some benefits to the golfers, a large number of options to the golfer can also be confusing and cumbersome to the golfer. In certain exemplary embodiments, the present design and specifically the spline configurations of the various rotation-inhibiting structures, provide a limited set of adjustability options that is more user-friendly for the golfer. For example, the adjustability may be limited to only three different adjustable loft angles and three different adjustable face angles. The loft angles may vary from 7.5 degrees to 12.5 degrees. The face angles may be generally referred to as Neutral, Open, and Closed. Therefore, each club head will have a finite number of rotatable positions, such as a total of nine different face angle and loft angle configurations. The configuration of the rotation-inhibiting structures limit the rotational positions of the shaft adapter and the hosel adapter, providing a more simple, streamlined adjustment features for the golfer. Thus from the figures and descriptions herein, the various spline configurations having engagement surfaces structured such that certain positions are allowed to provide desired adjustment while additional positions are prevented (e.g. the respective splines cannot fit together) to specifically limit the adjustability options.

Another exemplary option set is using four different adjustable loft angles and three different adjustable face angles, thereby creating a club head with a total of twelve different face angle and loft angle configurations. Another exemplary option set is using five different adjustable loft angles and three different adjustable face angles, thereby creating club head with a total of fifteen different face angle and loft angle configurations. Another exemplary option set is using seven different adjustable loft angles and three different adjustable face angles, thereby creating club head with a total of twenty-one different face angle and loft angle configurations. Other configurations of adjustable face angles and loft angles may be utilized without departing from this invention.

The exemplary embodiment in FIGS. 13A and 13B illustrates a spline configuration that allows five loft angles and three face angles of adjustability. The adjustable loft angles may include 8 degrees, 9 degrees, 10 degrees, 11 degrees, and 12 degrees. The adjustable face angles may include Open ("O"), Neutral ("N") and Closed ("C"). The exemplary embodiment in FIG. 16 illustrates a spline configuration that allows five loft angles and three face angles of adjustability. This spline configuration allows for the adjustability of loft angles that may include 8.5 degrees, 9.5 degrees, 10.5 degrees, 11.5 degrees, and 12.5 degrees. The adjustable face angles may include Open or Left ("L"), Neutral ("N"), and Closed or Right ("R"). The exemplary embodiment in FIG. 15 illustrates a spline configuration with seven loft angles and three face angles of adjustability. This spline configuration includes adjustable loft angles that may include 8 degrees, 9 degrees, 9.5 degrees, 10 degrees, 10.5 degrees, 11 degrees, and 12 degrees (not shown). The adjustable face angles may include Open ("O"), Neutral ("N") and Closed ("C").

It should be understood that a "Neutral" face angle may be a reference point/reference face angle and not an actual "neutral" face angle of the face or club head. For example, "Neutral" may represent a 1-degree closed face angle of the face. Using a 2-degree face angle adjustment, "Closed" would have a 3-degree closed face and "Open" would have a 1-degree open face. In another example, "Neutral" may represent a 3-degree open face angle of the face. Using a 2-degree face angle adjustment, "Closed" would have a 1-degree open face and "Open" would have a 5-degree open face.

The spline configuration of the embodiment illustrated in FIGS. 2A-6B will be now be described to illustrate how the invention provides for and limits the rotational movement of the shaft adapter 200 and hosel adapter 300 and adjustable face angle and loft angle positions as described above. The embodiment in FIGS. 2A-6B illustrates a three loft angle and three face angle adjustability spline configuration. The internal splines 312*a* of the hosel adapter 300 and the splines 212*a* of the shaft adapter 200 may be configured to engage with each other to thereby limit the number of rotations of the shaft adapter 200 within the hosel adapter 300. Additionally, the splines of the hosel ring 500 and the exterior splines 322 of the hosel adapter 300 may also be configured to engage with each other to thereby limit the number of rotations of the hosel adapter 300 within the hosel ring 500. For example, the spline configuration of the hosel ring 500 and the exterior splines 322 of the hosel adapter 300 illustrated in FIGS. 4 and 5 is limited to be rotated in three different rotational positions (e.g., three different loft angles). And similarly, the spline configuration of the shaft adapter 200 and the hosel adapter 300 illustrated in FIGS. 3A-4 is limited to be rotated into nine different rotational positions (e.g., three different face angles at each of three different loft angles). FIGS. 17A-18E and FIGS. 20A-21C illustrate cross-sectional views of exemplary spline configurations, spline engagements, and spline interactions for the above described shaft adapter 200, hosel adapter 300, and hosel ring 500.

Figure 17A:
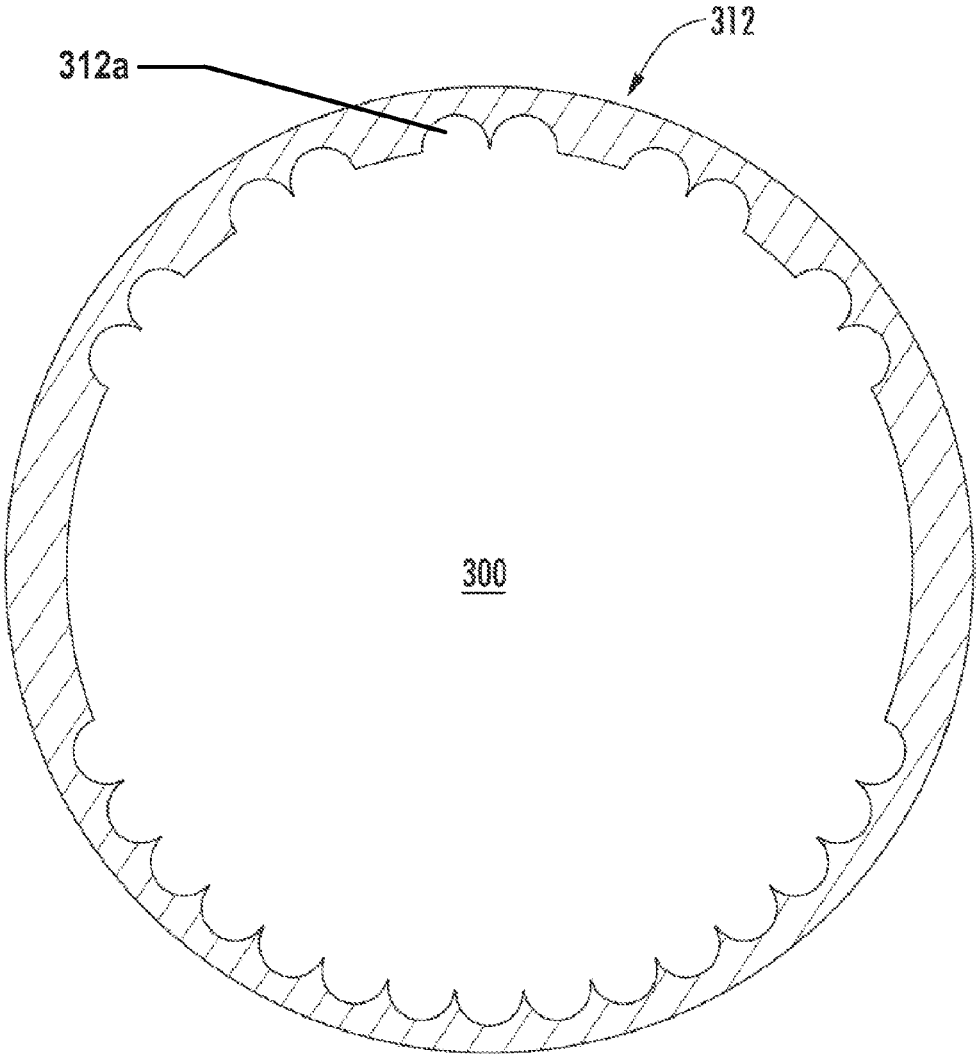
FIG. 17A illustrates a cross-sectional view of an example hosel adapter of a golf club head/shaft connection system in accordance with examples of this invention.

FIG. 17A illustrates a cross-sectional view of the first end 304 of an exemplary hosel adapter 300. The first end 304 of the hosel adapter 300 includes an expanded portion 318. Additionally, the first end 304 of the hosel adapter 300 (and therethrough the hosel adapter 300) includes a bore 308. The first end 304 of the hosel adapter 300 includes an internal rotation-inhibiting structure 312 located within the bore 308. The internal rotation-inhibiting structure 312 includes internal splines 312*a* located within the bore 308 of the first end 304 of the hosel adapter 300. The internal spline 312*a* configuration includes five sets of two splines on one end of the bore 304 and a set of fifteen splines on the opposite end of the bore 304. The internal spline 312*a* configuration may include different configurations without departing from this invention.

Figure 17B:
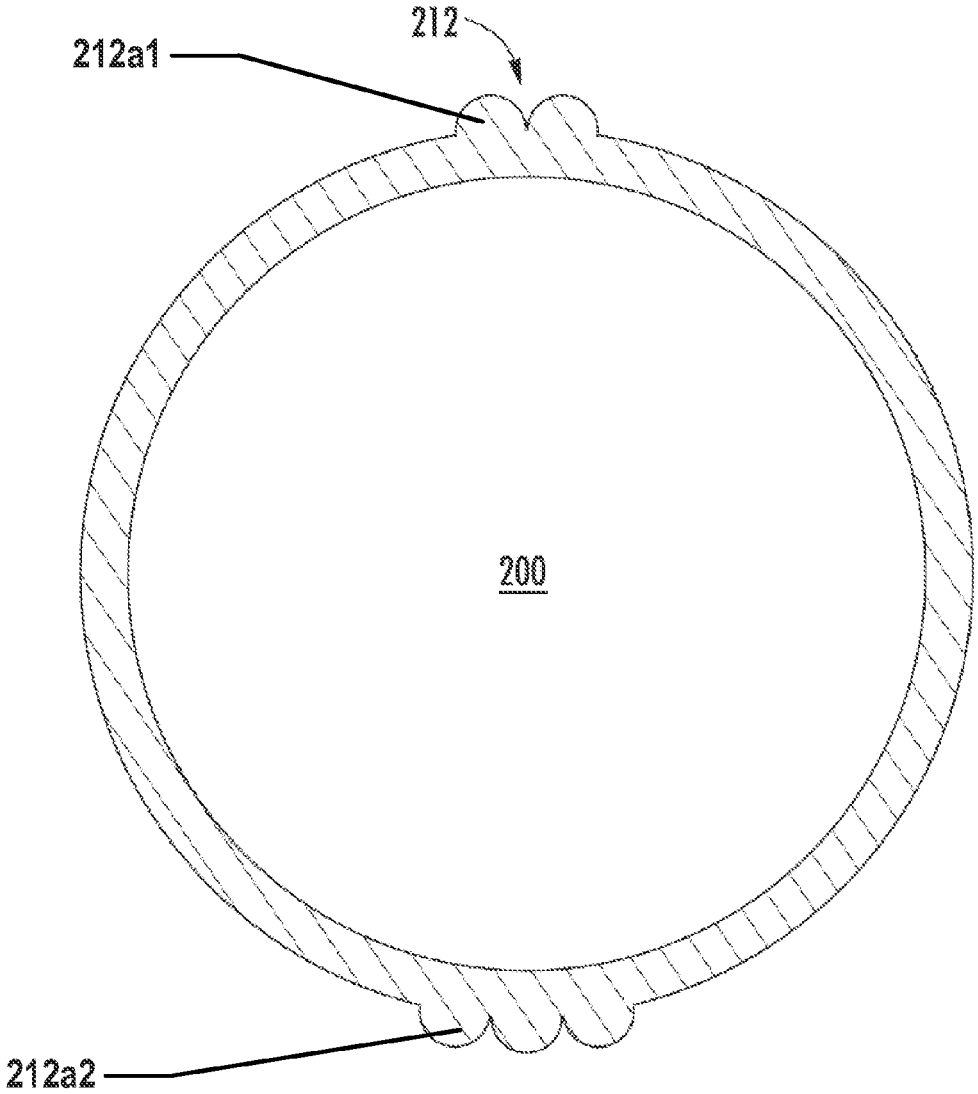
FIG. 17B illustrates a cross-sectional view of an example shaft adapter of a golf club head/shaft connection system in accordance with examples of this invention.

FIG. 17B illustrates a cross-sectional view of the cylindrical body 202 of an exemplary shaft adapter 200. The cylindrical body 202 of the shaft adapter 200 includes an external rotation-inhibiting structure 212. The external rotation-inhibiting structure 212 includes internal splines 212*a* located along an exterior of the cylindrical body 202 of the shaft adapter 200. The internal splines 212*a* includes a set of two splines 212*a*1 located on the cylindrical body 202 with a set of three splines 212*a*2 located on the opposite side of the cylindrical body 202. The interaction between these splines and the bore 308 of the first end 304 of the hosel adapter 300 will be discussed more below. Other configurations of splines may be utilized without departing from this invention.

FIGS. 18A through 18E illustrate the possible rotational configurations and the interaction of the external rotation inhibiting structures 212 on the shaft adapter 200 with the internal rotation inhibiting structures 312 on the hosel adapter 300. FIGS. 19A through 19E illustrate the corresponding club head configuration and loft angle when rotating the shaft adapter 200 within the hosel adapter 300. As was discussed above and will be discussed below, the shaft adapter 200 rotates and engages the hosel adapter 300 by sliding the shaft adapter 200 into the bore 308 of the hosel adapter 300. When the shaft adapter 200 engages the hosel adapter 300, in this exemplary embodiment, there are only five different rotational configurations that the shaft adapter 200 can engage and fit within the bore 308 of the hosel adapter 300. FIGS. 18A through 18E illustrate those five different rotational configurations, while FIGS. 19A through 19E illustrate those five corresponding club head configurations and loft angles.

Figure 18A:
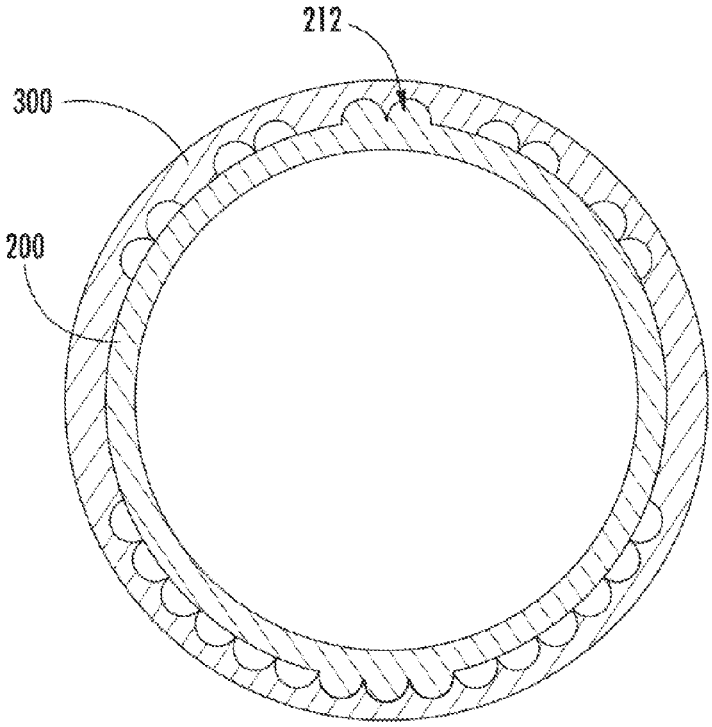
FIGS. 18A through 18E illustrate cross-sectional views of different rotational configurations of the example shaft adapter from FIG. 17B engaged with the example hosel adapter from FIG. 17A in accordance with examples of this invention.
Figure 19A:
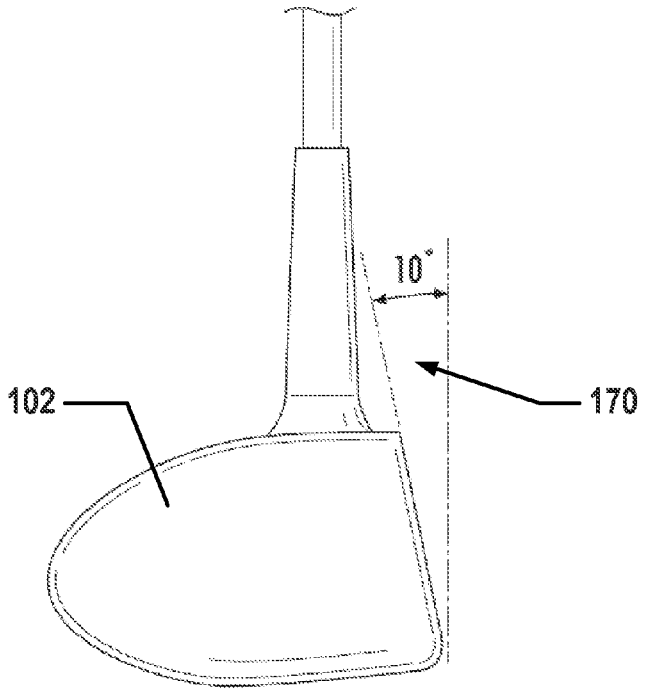
FIGS. 19A through 19E illustrate various club head configurations associated with the different rotational configurations from FIGS. 18A through 18E in accordance with examples of this invention.

Specifically, FIG. 18A illustrates the set of two splines 212*a*1 on the shaft adapter 200 engaging the middle two splines 312*a* on first side of the bore 308 of the hosel adapter 300 with the set of three splines 212*a*2 on the shaft adapter 200 engaging the middle three splines of the fifteen splines 312*a* on the second side of the bore 308 of the hosel adapter 300. In this configuration, the shaft adapter 200 is located at the middle rotational configuration and location within the hosel adapter 300. Additionally, in this configuration, as illustrated in FIG. 19A, the club head 102 may be at a "neutral", "reference", or middle loft angle. In this exemplary illustration, the club head 102 may have a loft angle of 10 degrees.

Figure 18B:
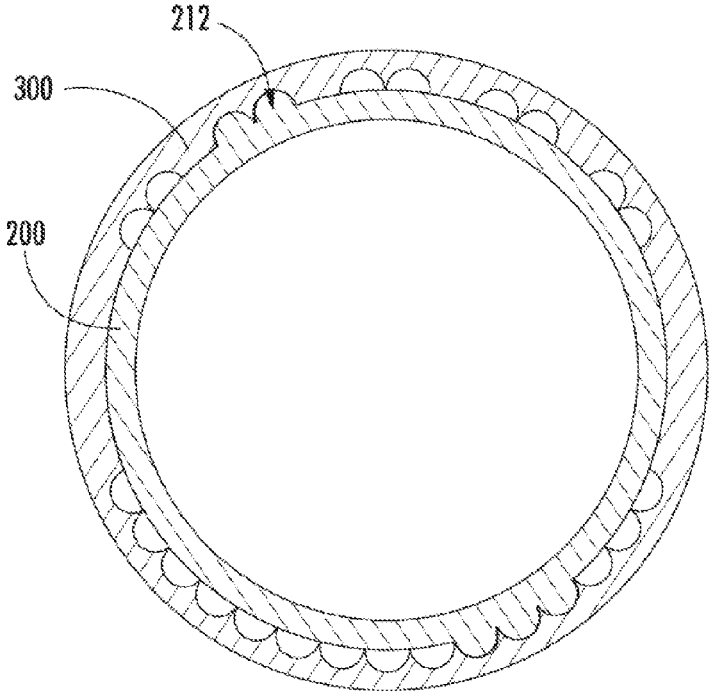
Figure 19B:
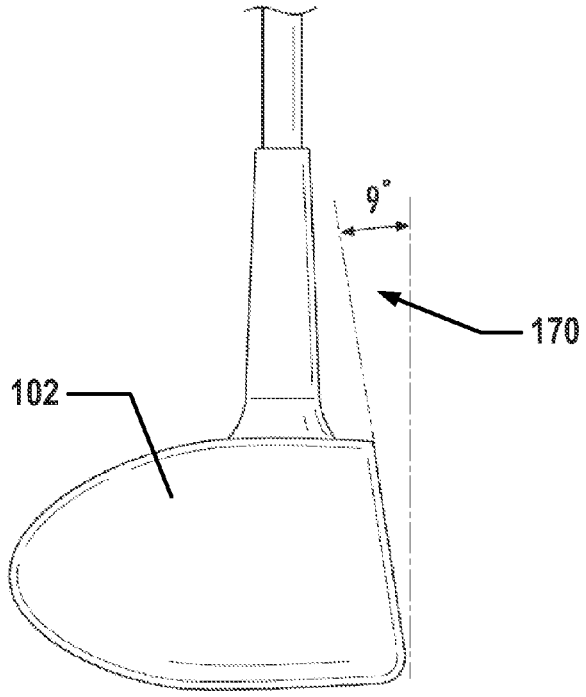

FIG. 18B illustrates the set of two splines 212*a*1 on the shaft adapter 200 engaging the two splines 312*a* counterclockwise of the middle splines on the first side of the bore 308 of the hosel adapter 300 with the set of three splines 212*a*2 on the shaft adapter 200 engaging three splines counterclockwise of the middle splines of the fifteen splines 312*a* on the second side of the bore 308 of the hosel adapter 300. In this configuration, the shaft adapter 200 is rotated and located one rotational configuration and position counterclockwise of middle within the hosel adapter 300. Additionally, in this configuration, as illustrated in FIG. 19B, the club head 102 may be at a lower loft angle. In this exemplary illustration, the club head 102 may have a loft angle of 9 degrees.

Figure 18C:
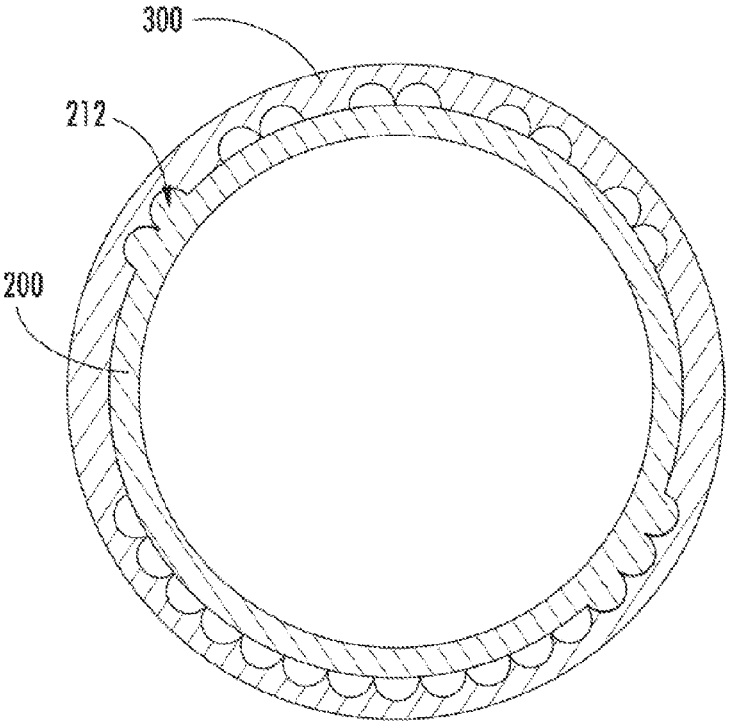
Figure 19C:
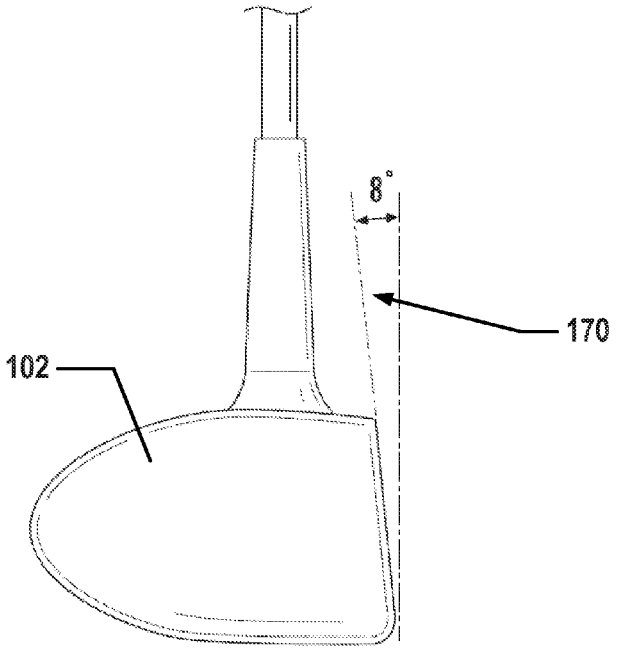

FIG. 18C illustrates the set of two splines 212*a*1 on the shaft adapter 200 engaging the two splines 312*a* two rotations counterclockwise of middle on the first side of the bore 308 of the hosel adapter 300 with the set of three splines 212*a*2 on the shaft adapter 200 engaging the three splines two rotations counterclockwise of middle of the fifteen splines 312*a* on the second side of the bore 308 of the hosel adapter 300. In this configuration, the shaft adapter 200 is rotated and located two rotational configurations and positions counterclockwise of middle within the hosel adapter 300. Additionally, in this configuration, as illustrated in FIG. 19C, the club head 102 may be at a second lower loft angle. In this exemplary illustration, the club head 102 may have a loft angle of 8 degrees. It is understood that any further rotational movement of splines 212*a*1 and/or 212 as would abut the surfaces of the hosel adapter 300 to prevent further options about the hosel.

Figure 18D:
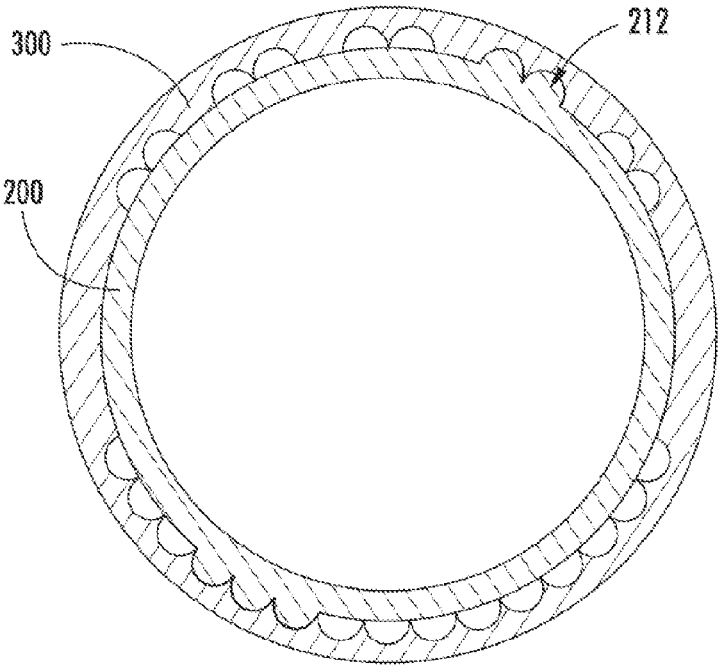
Figure 19D:
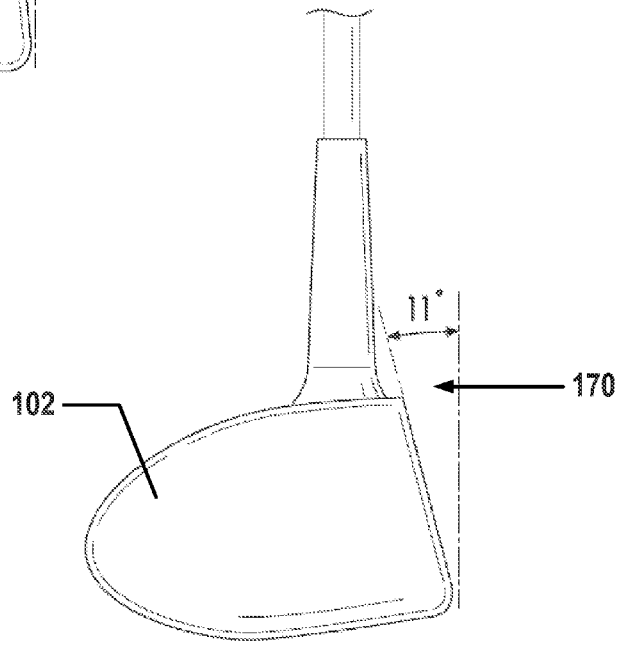

FIG. 18D illustrates the set of two splines 212*a*1 on the shaft adapter 200 engaging the two splines 312*a* clockwise of the middle splines on first side of the bore 308 of the hosel adapter 300 with the set of three splines 212*a*2 on the shaft adapter 200 engaging three splines clockwise of the middle splines of the fifteen splines 312*a* on the second side of the bore 308 of the hosel adapter 300. In this configuration, the shaft adapter 200 is rotated and located one rotational configuration and position clockwise of middle within the hosel adapter 300. Additionally, in this configuration, as illustrated in FIG. 19D, the club head 102 may be at a higher loft angle. In this exemplary illustration, the club head 102 may have a loft angle of 11 degrees.

Figure 18E:
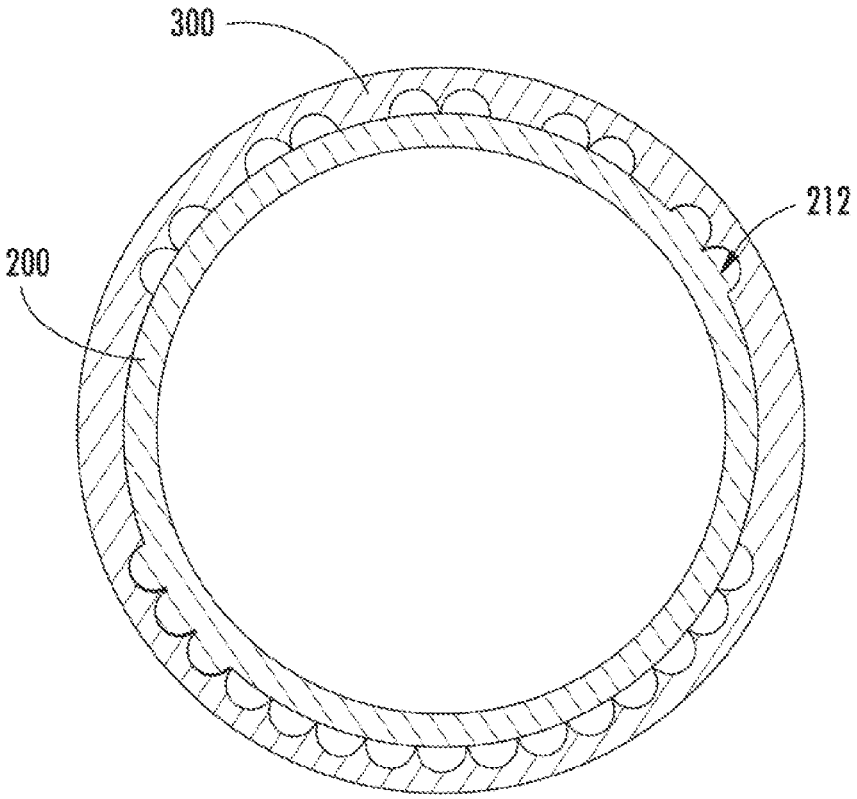
Figure 19E:
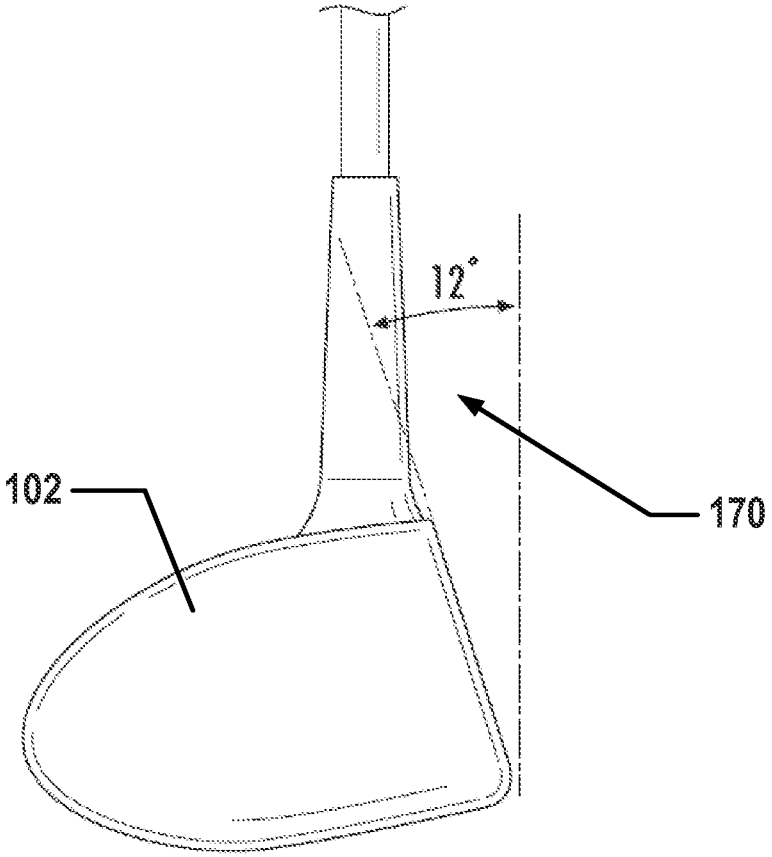

FIG. 18E illustrates the set of two splines 212*a*1 on the shaft adapter 200 engaging the two splines 312*a* clockwise two rotational positions from middle on the first side of the bore 308 of the hosel adapter 300 with the set of three splines 212*a*2 on the shaft adapter 200 engaging the three splines clockwise two rotational positions of middle of the fifteen splines 312*a* on the second side of the bore 308 of the hosel adapter 300. In this configuration, the shaft adapter 200 is rotated and located two rotational configurations and positions clockwise of middle within the hosel adapter 300. Additionally, in this configuration, as illustrated in FIG. 19E, the club head 102 may be at a second higher loft angle. In this exemplary illustration, the club head 102 may have a loft angle of 12 degrees.

The rotational configurations of the shaft adapter 200 within the hosel adapter 300 may include more or less than five different configurations without departing from this invention. For example, there may be three rotational configurations of the shaft adapter 200 within the hosel adapter 300. There may also be four rotational configurations of the shaft adapter 200 within the hosel adapter 300. There may also be more than five rotational configurations of the shaft adapter 200 within the hosel adapter 300, such as six, seven, or eight. Additionally, without departing from this invention, the rotation of the shaft adapter 200 within the hosel adapter 300 may independently affect a different characteristic of the club head instead of the loft angle, such as face angle or lie angle.

Figure 20A:
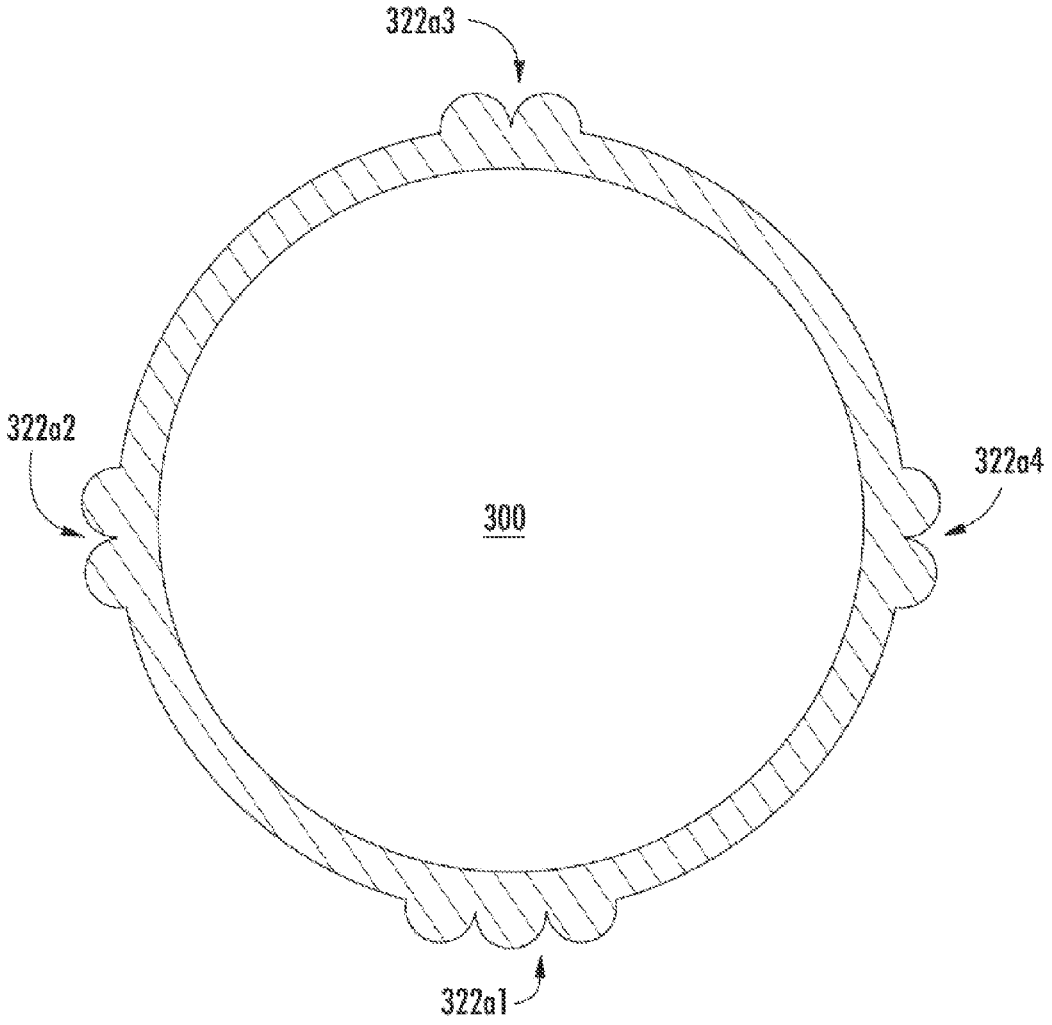
FIG. 20A illustrates a cross-sectional view of an example hosel adapter of a golf club head/shaft connection system in accordance with examples of this invention.

FIG. 20A illustrates a cross-sectional view of the exterior of the first end 304 along an exterior surface 302 of the hosel adapter 300. The exterior of the first end 304 of the hosel adapter 300 includes an external rotation-inhibiting structure 322 located along an exterior surface 302 of the hosel adapter 300. The external rotation-inhibiting structure 322 includes external splines 322*a* located along an exterior surface 302 of the hosel adapter 300. The external spline 312*a* configuration includes a set of three splines 322*a*1 located on the exterior surface 302, a set of two splines 322*a*2 located a quarter way around the exterior surface 302, a set of two splines 322*a*3 located another quarter way around the exterior surface 302 or on the opposite side of the set of three splines 322*a*1, and a last set of two splines 322*a*4 located another quarter way around the exterior surface 302 or on the opposite side of the set of two splines 322*a*2. The external spline 322*a* configuration may include different configurations without departing from this invention.

Figure 20B:
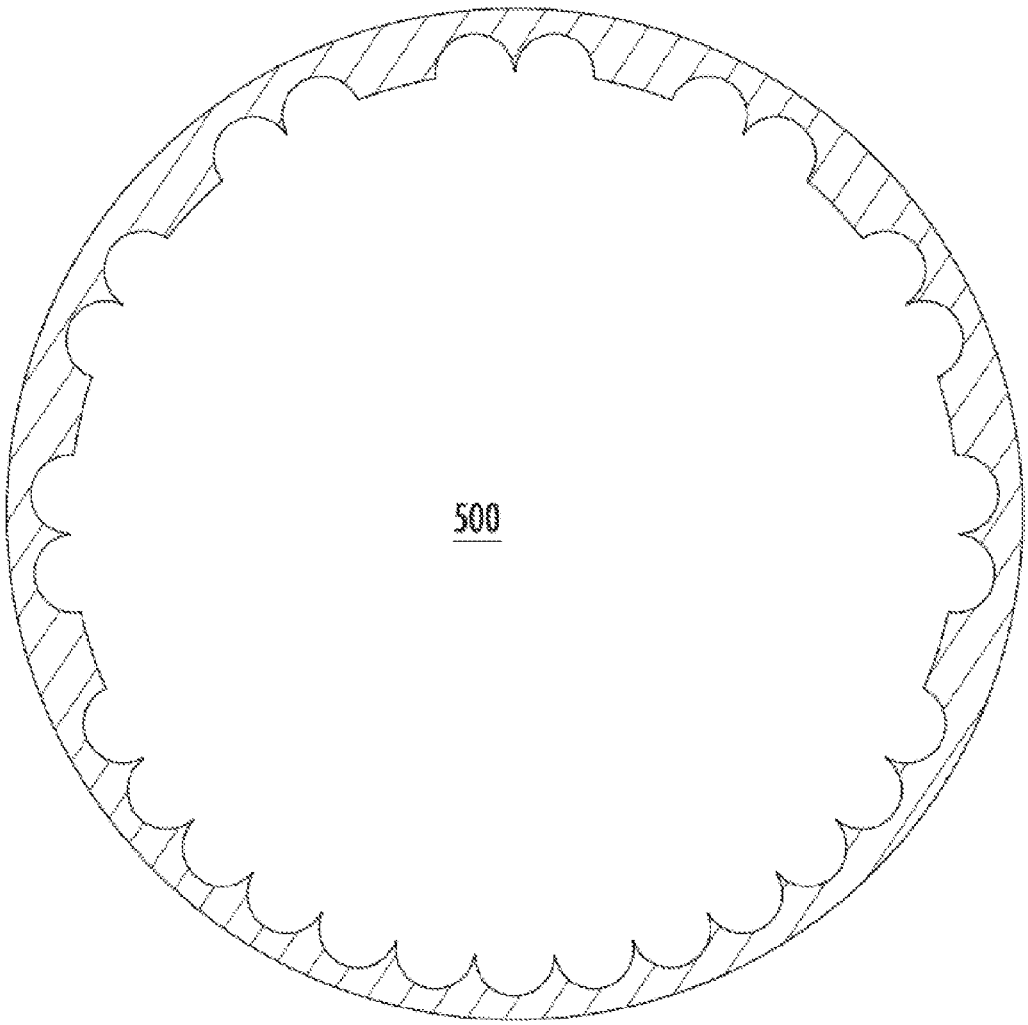
FIG. 20B illustrates a cross-sectional view of an example hosel ring of a golf club head/shaft connection system in accordance with examples of this invention.

FIG. 20B illustrates a cross-sectional view of the hosel ring 500. The hosel ring 500 includes an internal rotation-inhibiting structure 512. The internal rotation-inhibiting structure 512 includes internal splines 512*a* located within the bore 508 of the hosel ring 500. The internal splines 512*a* are configured to engage the external splines 322*a* of the hosel adapter. The interaction between these splines and the exterior surface 302 of the hosel adapter 300 will be discussed more below. Other configurations of splines may be utilized without departing from this invention.

Figure 21A:
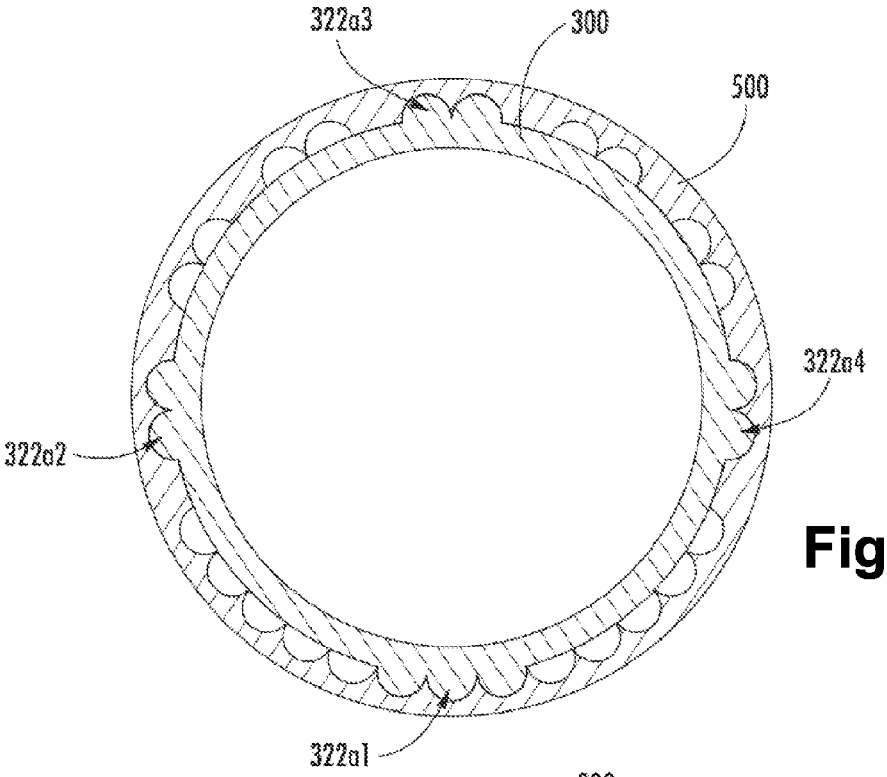
FIGS. 21A through 21C illustrate cross-sectional views of different rotational configurations of the example hosel adapter from FIG. 20A engaged with the example hosel ring from FIG. 20B in accordance with examples of this invention.
Figure 21B:
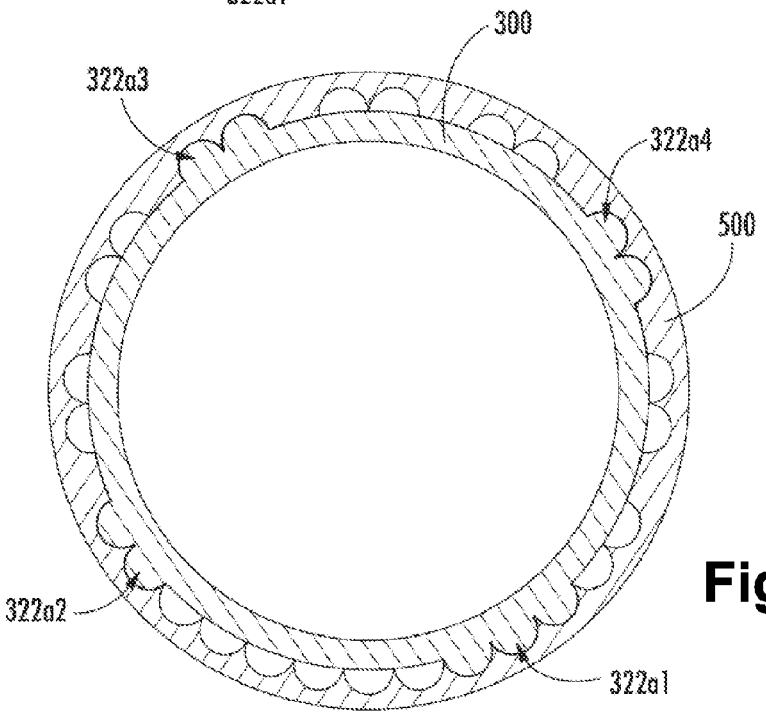
Figure 21C:
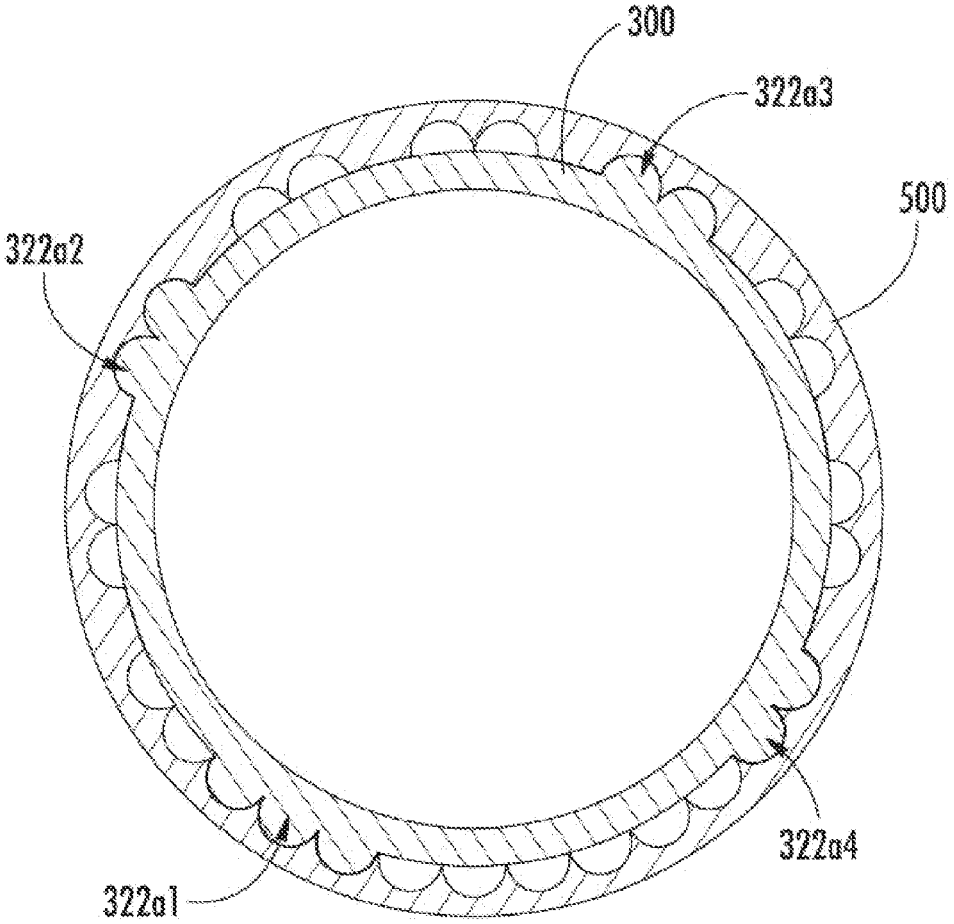
Figure 22A:
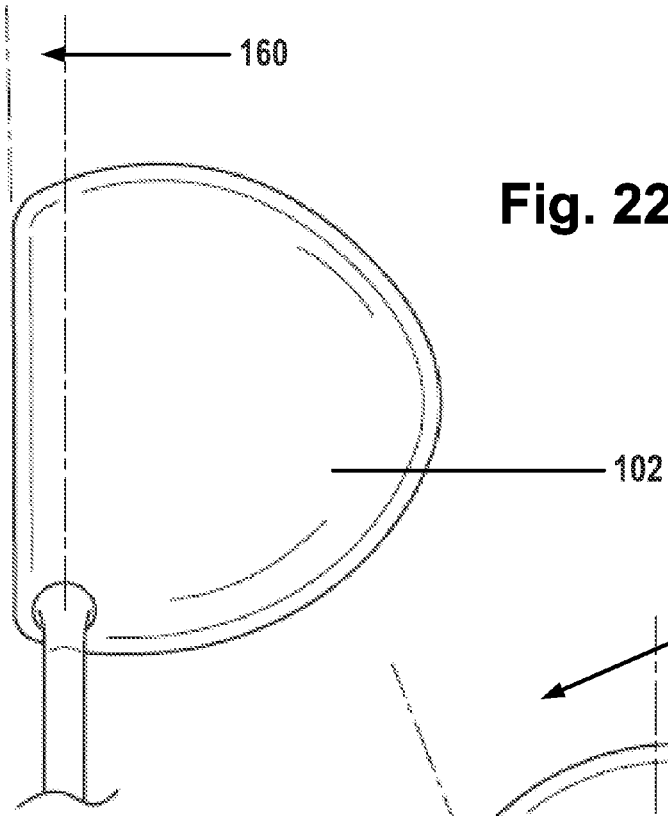
FIGS. 22A through 22C illustrate various club head configurations associated with the different rotational configurations from FIGS. 21A through 21C in accordance with examples of this invention.
Figure 22B:
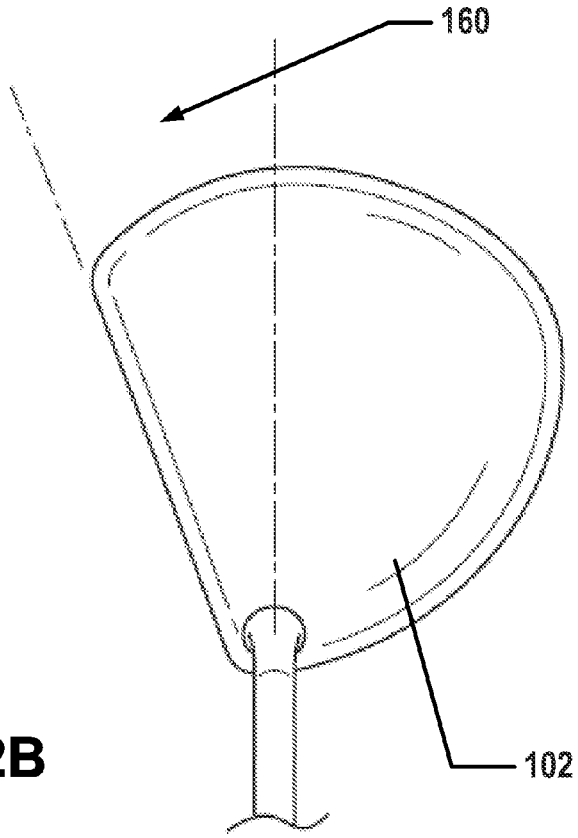
Figure 22C:
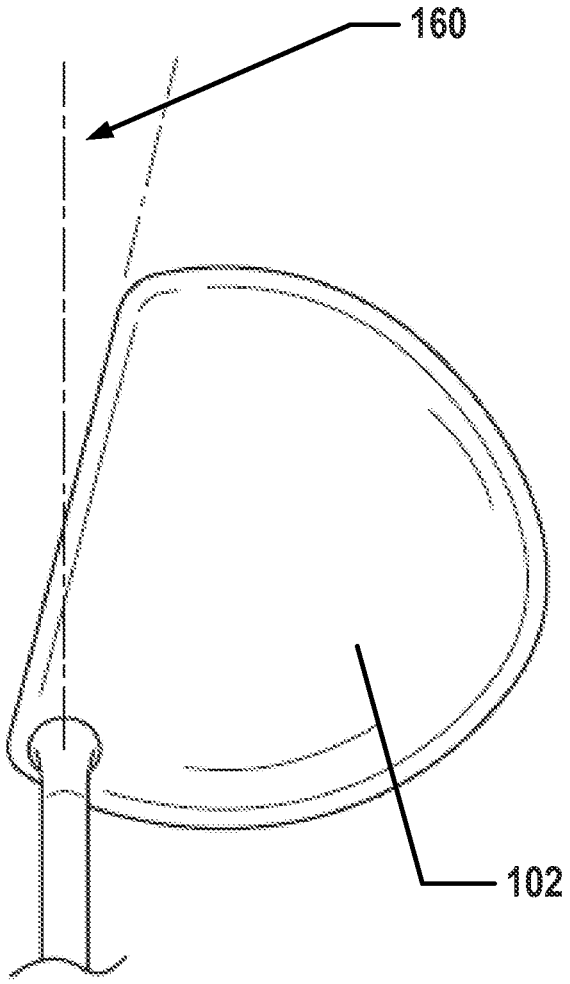

FIGS. 21A through 21C illustrate the possible rotational configurations and the interaction of the external rotation inhibiting structures 322 on the hosel adapter 300 with the internal rotation inhibiting structures 512 on the hosel ring 500. FIGS. 22A through 22C illustrate the corresponding club head configuration and face angle when rotating the hosel adapter 300 within the hosel ring 500. As was discussed above and will be discussed below, the hosel adapter 300 rotates and engages the hosel ring 500 by sliding the hosel adapter 300 into the bore 508 of the hosel ring 500. When the hosel adapter 300 engages the hosel ring 500, in this exemplary embodiment, there are only three different rotational configurations that the hosel adapter 300 can engage and fit within the bore 508 of the hosel ring 500. FIGS. 21A through 21C illustrate those three different rotational configurations, while FIGS. 22A through 22C illustrate those three corresponding club head configurations and face angles.

Specifically, FIG. 21A illustrates the sets of two splines 322*a*2 322*a*3 322*a*4 on the hosel adapter 300 engaging the sets of two splines 512*a* within the bore 508 of the hosel ring 500 with the set of three splines 322*a*1 on the hosel adapter 300 engaging the middle three splines of the thirteen splines 512*a* within the bore 508 of the hosel ring 500. In this configuration, the hosel adapter 300 is located at the middle rotational configuration and location within the hosel ring 500. Additionally, in this configuration, as illustrated in FIG. 22A, the club head 102 may be at a "neutral" face angle.

FIG. 21B illustrates the sets of two splines 322*a*2 322*a*3 322*a*4 on the hosel adapter 300 engaging the sets of two splines 512*a* one rotational configuration counterclockwise of the neutral configuration of the hosel ring 500 with the set of three splines 212*a*2 on the shaft adapter 200 engaging three splines one rotational configuration counterclockwise of the middle splines of the thirteen splines 512*a* within the bore 508 of the hosel ring 500. In this configuration, the hosel adapter 300 is rotated and located one rotational configuration and position counterclockwise of middle within the hosel ring 500. Additionally, in this configuration, as illustrated in FIG. 22B, the club head 102 may be at a closed face angle or negative face angle.

FIG. 21C illustrates the sets of two splines 322*a*2 322*a*3 322*a*4 on the hosel adapter 300 engaging the sets of two splines 512*a* one rotational configuration clockwise of the neutral configuration of the hosel ring 500 with the set of three splines 312*a*1 on the hosel adapter 300 engaging three splines one rotational configuration clockwise of the middle splines of the thirteen splines 512*a* within the bore 508 of the hosel ring 500. In this configuration, the hosel adapter 300 is rotated and located one rotational configuration and position clockwise of middle within the hosel ring 500. Additionally, in this configuration, as illustrated in FIG. 22C, the club head 102 may be at an open face angle or positive face angle.

The rotational configurations of the hosel adapter 300 within the hosel ring 500 may include more or less than three different configurations without departing from this invention. For example, there may be two, four, five, six, eight or more rotational configurations of the hosel adapter 300 within the hosel ring 500. Additionally, without departing from this invention, the rotation of the hosel adapter 300 within the hosel ring 500 may affect a different characteristic of the club head independently instead of the face angle, such as loft angle or lie angle.

One example of the engagement of a golf club shaft 106 with a club head 102 utilizing the shaft adapter 200, the hosel adapter 300, and the hosel ring 500 will be described in more detail in conjunction with FIGS. 2-6B. At some time during the head/shaft connection process, a shaft 106 is engaged within the cylindrical interior chamber 208 of the shaft adapter 200. In this illustrated example structure, the shaft 106 will be permanently engaged in the chamber 208, e.g., via an adhesive or cement bond. Other ways of engaging a shaft 106 with the shaft adapter 200 are possible without departing from this invention, including, for example, mechanical connections (including releasable mechanical connections, such as threaded structures or the like); welding, brazing, soldering, or other fusing techniques; etc. Once connected to the shaft adapter 200, the shaft 106 is ready for engaging a hosel adapter 300 and mounting to a golf club head 102. Alternatively, if desired, the shaft 106 may be connected to the shaft adapter 200 later in the process, even as late as the final step in the connection process.

An example club head structure 102 now will be described in more detail, particularly in conjunction with FIG. 2 which provides an exploded sectional view of the releasable connection. In this example structure, the club head 102 includes a hosel area 402 that provides access to a club head chamber 404 defined in the club head 102. The club head chamber 404 in this example structure extends completely through the club head body 102 and produces an opening 406 at the sole or bottom of the club head 102. This opening 406 allows access for insertion of a securing system 408 (e.g., a threaded bolt member) that helps secure the shaft adapter 200 and hosel adapter 300 to the club head body 102, as will be described in more detail below. The securing system 408 may also include a spherical washer 408A and a screw retention device 408B. Details of the spherical washer 408A will be described below with the description of the spherical washer 1408A in FIG. 42B.

In this example structure, the club head chamber 404 includes a mounting plate 410 with a hole 410*a* defined therein, which provides a support surface for securing the shaft adapter 200 and hosel adapter 300 within the club head body 102, as will be explained in more detail below. If desired, the mounting plate 410 may be integrally formed as part of the club head structure, and it may be located at any desired position along the club head chamber 404, including right at or near the opening 406. Additionally or alternatively, if desired, a plug member may be provided close to opening 406 (optionally a removable plug member) or the sole member may include a countersunk region to allow the bolt member 408 to lie flush or substantially flush with the club head sole.

As illustrated in FIG. 2, the securing system may also include a screw retention device 408B. The screw retention device may be located in the club head chamber 404. Additionally, the screw retention device 408B may be sized such that the screw retention device is bigger than the mounting plate 410. The screw retention device 408B retains the threaded bolt member 408 and not allowing the threaded bolt member 408 to fall out of the club head 102.

Connection of the shaft adapter 200 (optionally with a shaft 106 already engaged with it) to the club head 102 will be described in more detail in conjunction with FIGS. 2 through 6B. As shown, the hosel adapter 300 may be inserted into the club head chamber 404 of the club head body 102 in an appropriate manner, such that the third rotation-inhibiting structure 322 of the hosel adapter 300 aligns with and engages the fourth rotation-inhibiting structure 522 of the hosel ring 500 located in the club head chamber 404. Additionally, the cylindrical body 202 of the shaft adapter 200 may be inserted into the first end 304 and the borehole 308 of the hosel adapter 300 in an appropriate manner such that the first rotation-inhibiting structures 212 of the shaft adapter 200 engage the second rotation-inhibiting structures 312 of the hosel adapter 300. As the hosel adapter 300 is inserted into the hosel ring 500 and the club head chamber 404 of the club head body 102, the second end 306 of the hosel adapter 300 flares against the sides of the club head chamber 404 to take up any tolerances between the hosel adapter 300 and the club head chamber 404. At this location and in this arrangement, the second end 206 of the shaft adapter 200 and the second end 306 of the hosel adapter 300 are seated against the mounting plate 410. Additionally, the expanded portion 318 of the hosel adapter 300 is located adjacent to and/or seated against the top surface of the hosel 402. Further, the expanded portion 214 of the shaft adapter 200 first end 204 is seated against the top surface of the first end 304 of the hosel adapter 300.

Once inserted, the shaft adapter 200 and hosel adapter 300 may be engaged and secured with the club head body 102 by inserting the securing member or bolt member 408 through the opening 406 in the sole of the club head 102, through the opening 310 of the hosel adapter 300, and engaging the securing member 408 with the securing structure 210 provided with the shaft adapter 200. If desired, the locations where the hosel adapter 300 meets the club head 102 (e.g., at mounting plate 410 and/or the hosel opening) and/or where the securing member 408 meets the club head 102 (e.g., at the mounting plate 410) may include a flexible material (such as a washer, a gasket, an o-ring, an elastomeric washer or coating, etc.) to take up any extra space and to provide noise and/or vibration dampening, etc. This illustrated connection system is readily releasable, e.g., by twisting out the bolt member 408, to allow users to interchange different shafts 106 on a given golf club head 102 and/or to allow users to interchange different golf club heads 102 on a given shaft/connection member assembly. Additionally, the releasable connection system allows users to interchange different shaft adapters 200 and/or different hosel adapters 300 for a given golf club head 102 and/or to change the relative positioning of the shaft adapter 200 and/or hosel adapter 300 with respect to the golf club head 102.

If desired, the bolt 408 and mounting plate opening 410*a* may be structured so as to prevent the bolt 408 from completely falling out of the opening 406 when the bolt 408 is released from the shaft adapter 200 and the hosel adapter 300 (e.g., by providing an enlarged ring on the free end of bolt 408). The bolt 408 may include a head having structures for engaging a screwdriver, an allen wrench, or another tool.

Figure 23:
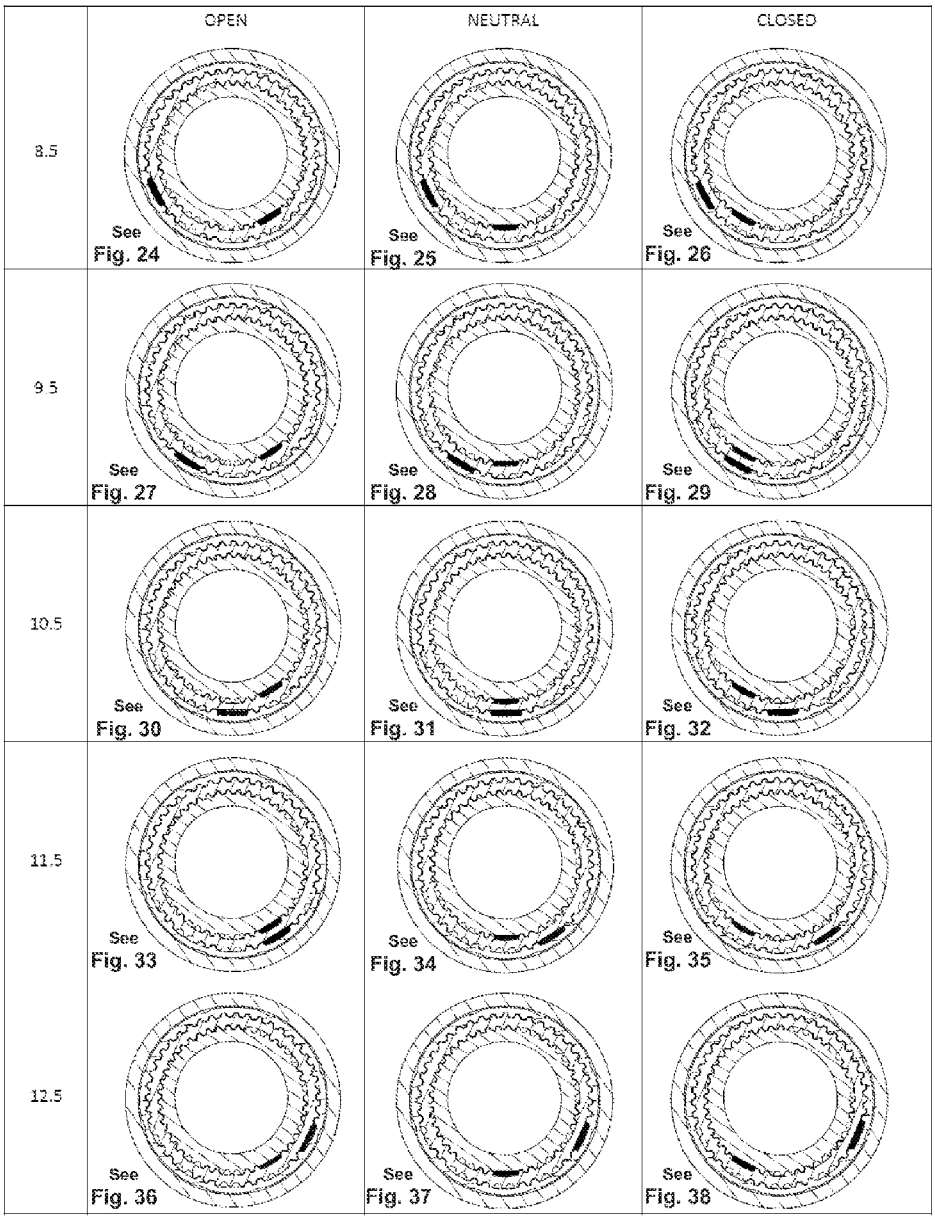
FIG. 23 illustrates a comprehensive summary chart of the cross-section view of the releasable connection and rotational configurations for each of the different club head configurations in accordance with examples of this invention.
Figure 24A:
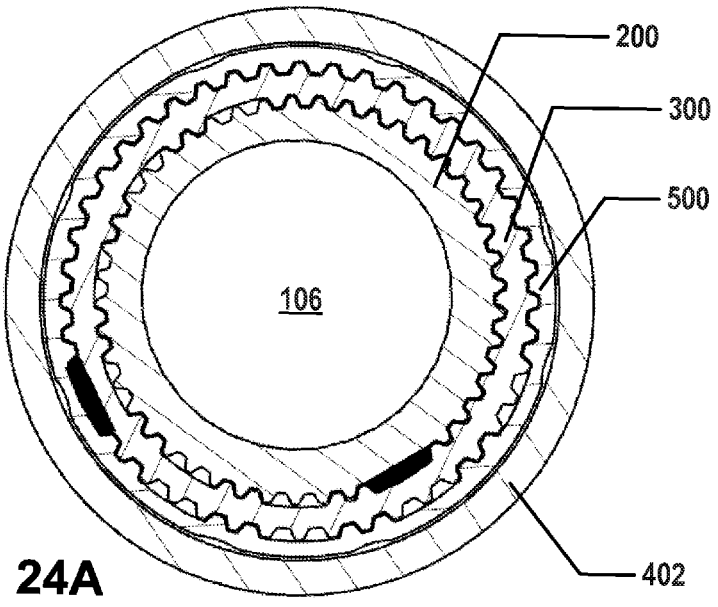
FIG. 24A illustrates a cross-sectional view of the releasable connection for an exemplary rotational configuration in accordance with examples of this invention.
Figure 24B:
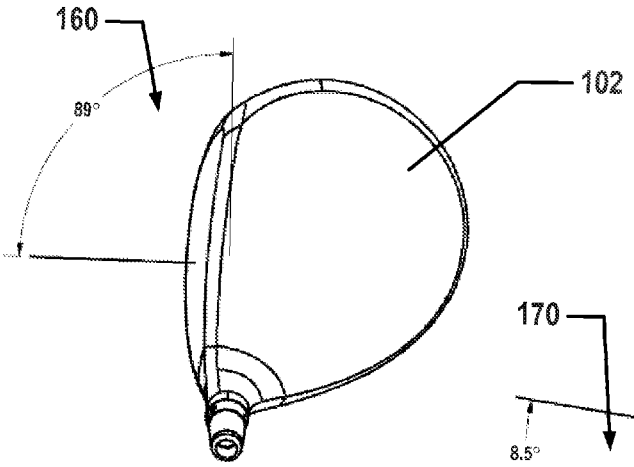
FIG. 24B illustrates an exemplary face angle of the club head for an exemplary rotational configuration in accordance with examples of this invention.
Figure 24C:
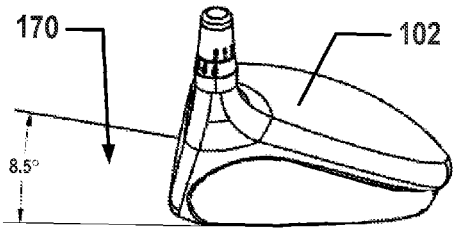
FIG. 24C illustrates an exemplary loft angle of the club head for an exemplary rotational configuration in accordance with examples of this invention.
Figure 25A:
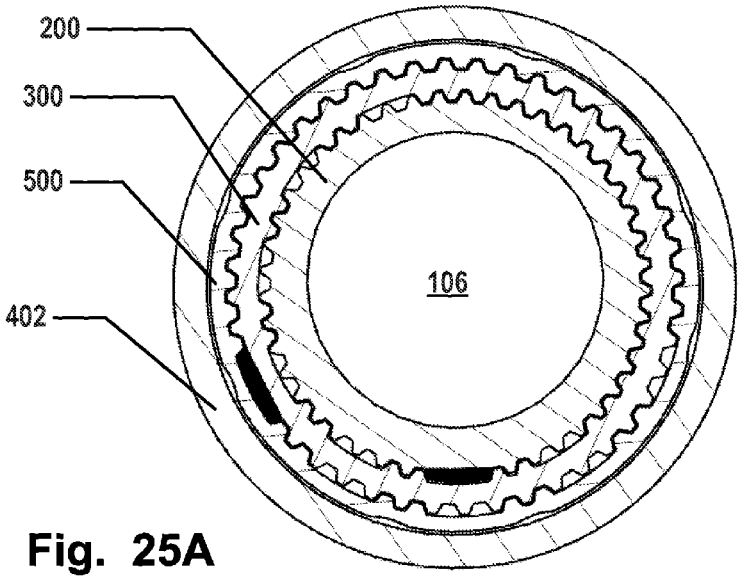
FIG. 25A illustrates a cross-sectional view of the releasable connection for an exemplary rotational configuration in accordance with examples of this invention.
Figure 25B:
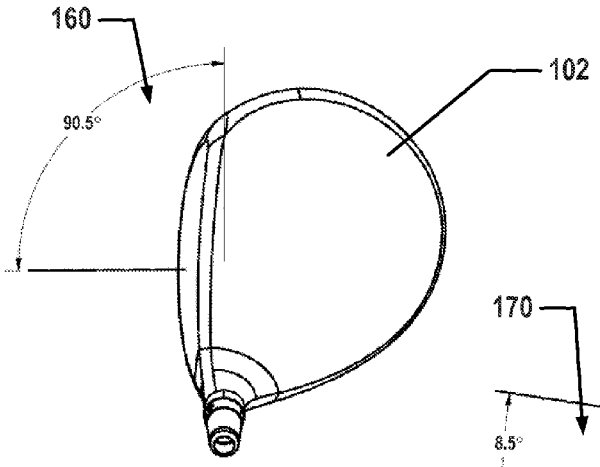
FIG. 25B illustrates an exemplary face angle of the club head for an exemplary rotational configuration in accordance with examples of this invention.
Figure 25C:
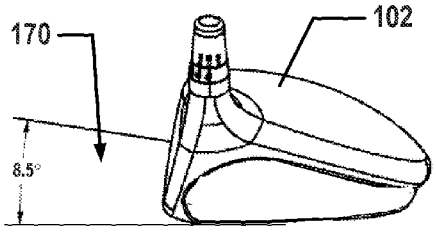
FIG. 25C illustrates an exemplary loft angle of the club head for an exemplary rotational configuration in accordance with examples of this invention.
Figure 26A:
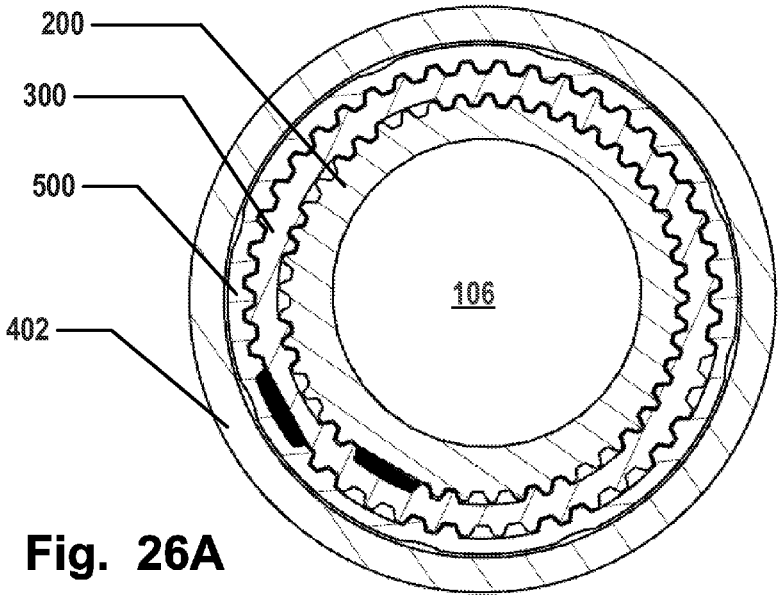
FIG. 26A illustrates a cross-sectional view of the releasable connection for an exemplary rotational configuration in accordance with examples of this invention.
Figure 26B:
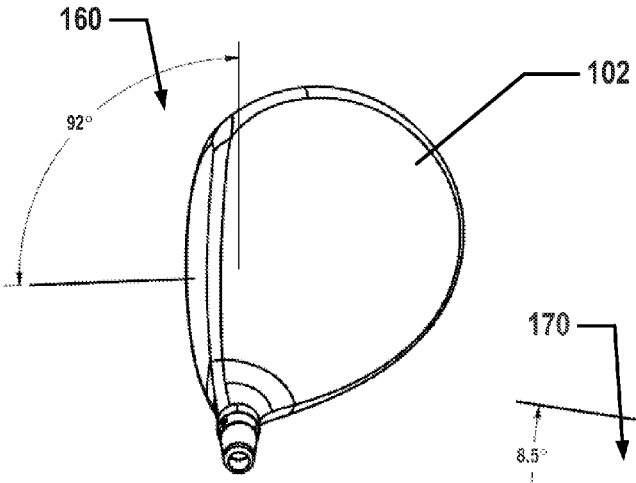
FIG. 26B illustrates an exemplary face angle of the club head for an exemplary rotational configuration in accordance with examples of this invention.
Figure 26C:
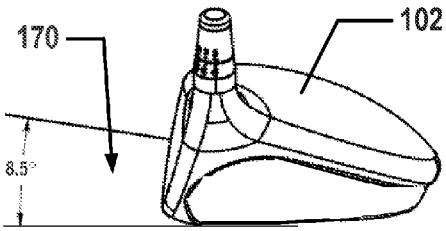
FIG. 26C illustrates an exemplary loft angle of the club head for an exemplary rotational configuration in accordance with examples of this invention.
Figure 27A:
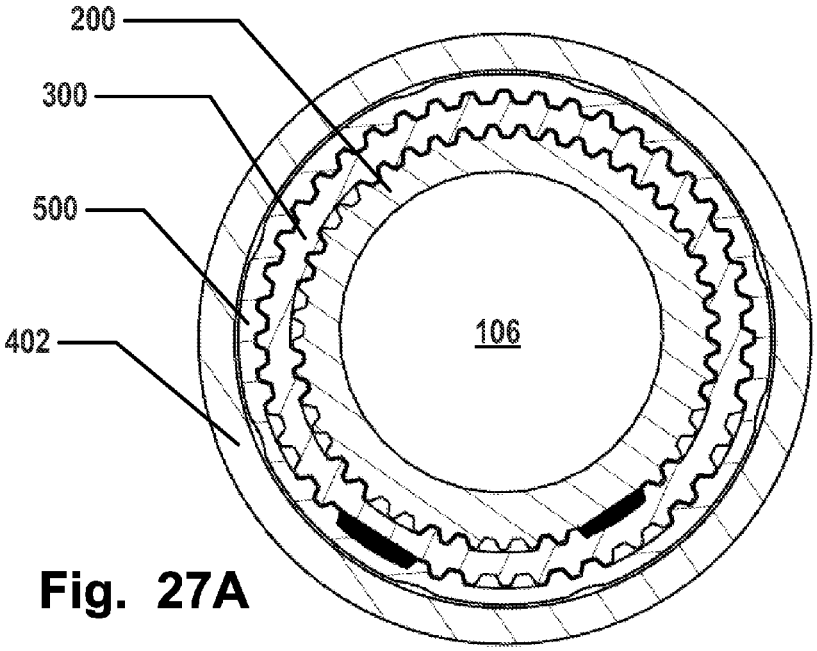
FIG. 27A illustrates a cross-sectional view of the releasable connection for an exemplary rotational configuration in accordance with examples of this invention.
Figure 27B:
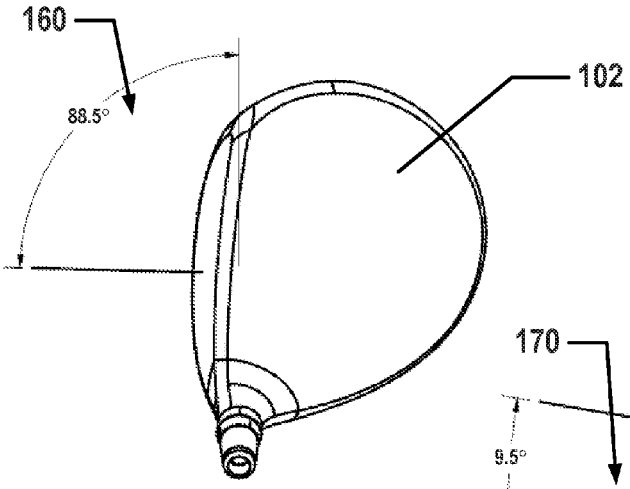
FIG. 27B illustrates an exemplary face angle of the club head for an exemplary rotational configuration in accordance with examples of this invention.
Figure 27C:
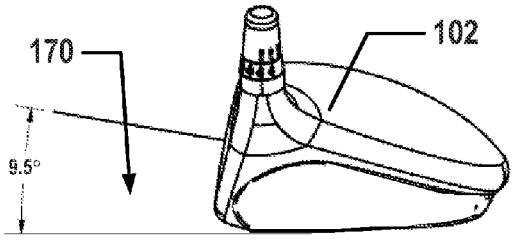
FIG. 27C illustrates an exemplary loft angle of the club head for an exemplary rotational configuration in accordance with examples of this invention.
Figure 28A:
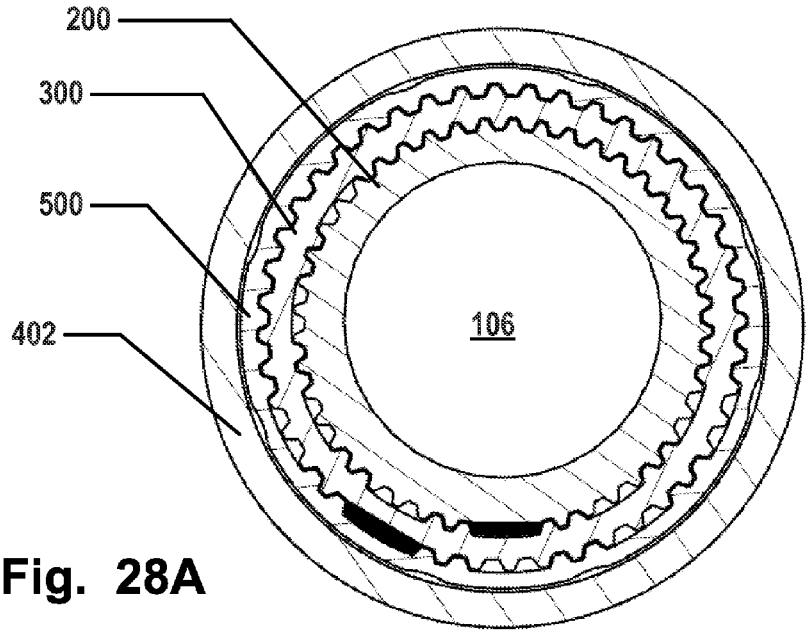
FIG. 28A illustrates a cross-sectional view of the releasable connection for an exemplary rotational configuration in accordance with examples of this invention.
Figure 28B:
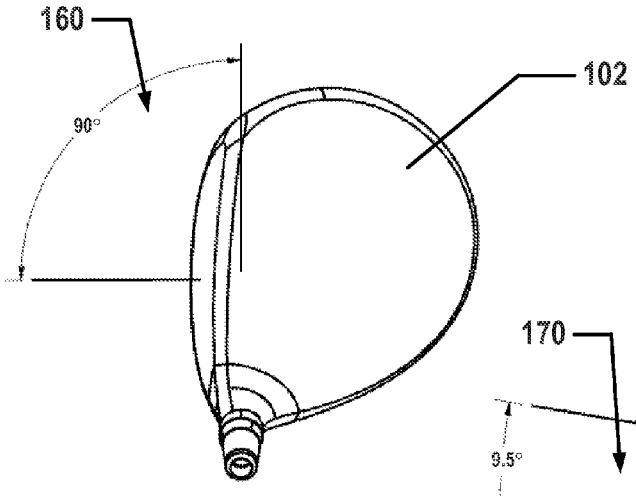
FIG. 28B illustrates an exemplary face angle of the club head for an exemplary rotational configuration in accordance with examples of this invention.
Figure 28C:
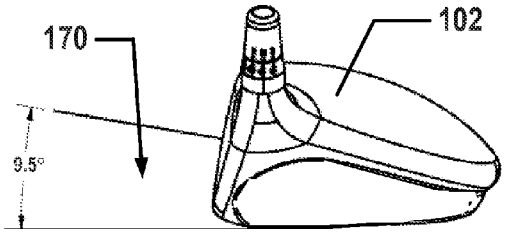
FIG. 28C illustrates an exemplary loft angle of the club head for an exemplary rotational configuration in accordance with examples of this invention.
Figure 29A:
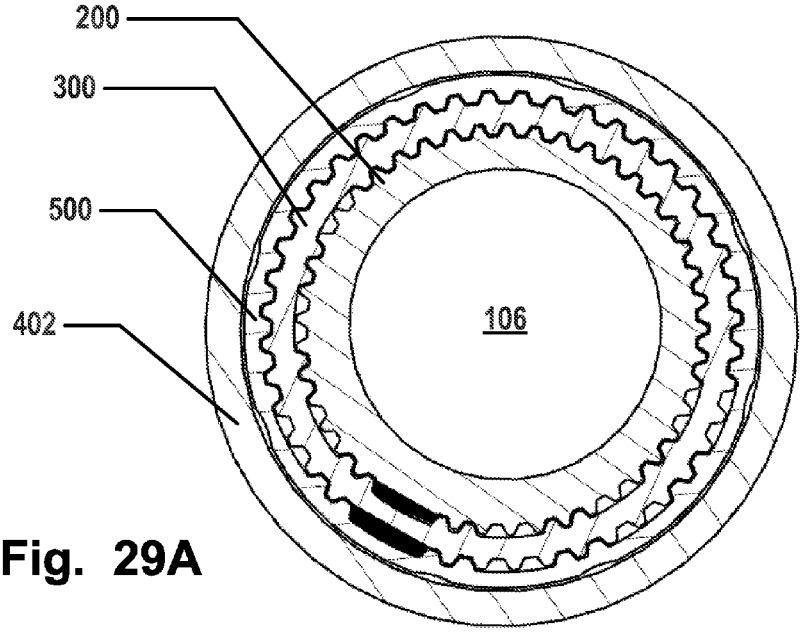
FIG. 29A illustrates a cross-sectional view of the releasable connection for an exemplary rotational configuration in accordance with examples of this invention.
Figure 29B:
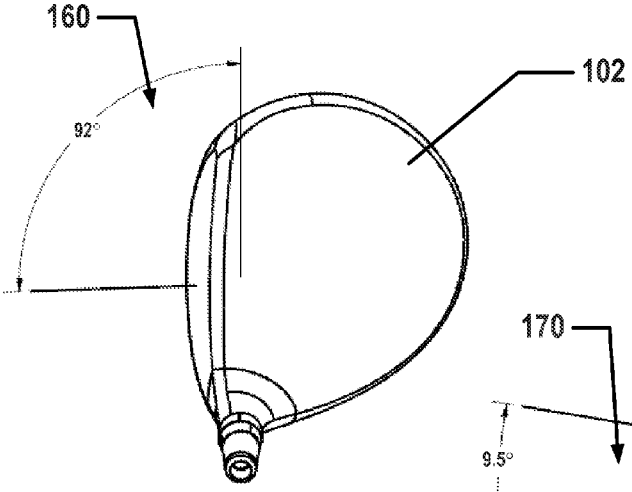
FIG. 29B illustrates an exemplary face angle of the club head for an exemplary rotational configuration in accordance with examples of this invention.
Figure 29C:
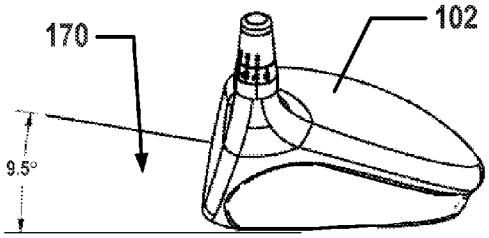
FIG. 29C illustrates an exemplary loft angle of the club head for an exemplary rotational configuration in accordance with examples of this invention.
Figure 30A:
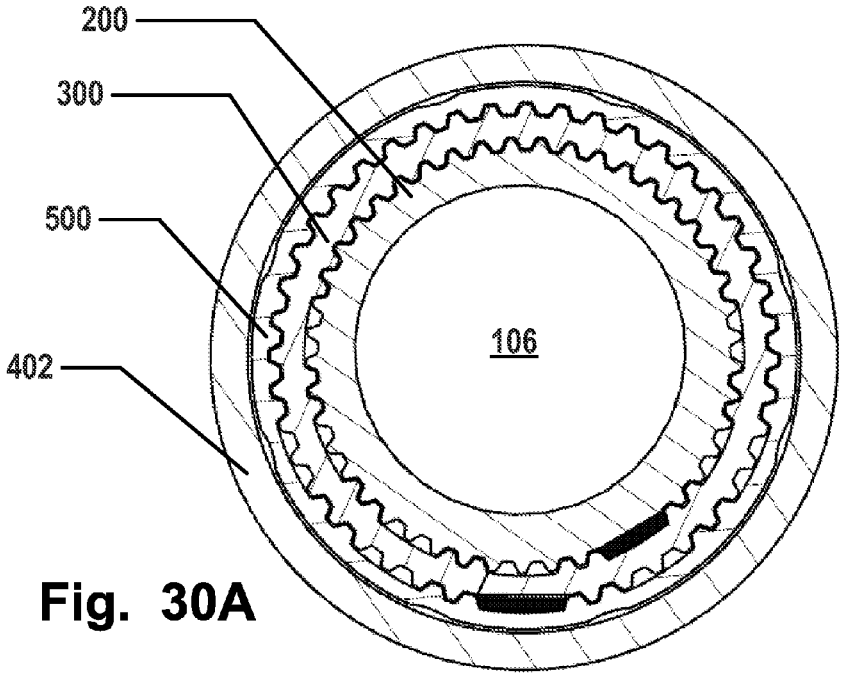
FIG. 30A illustrates a cross-sectional view of the releasable connection for an exemplary rotational configuration in accordance with examples of this invention.
Figure 30B:
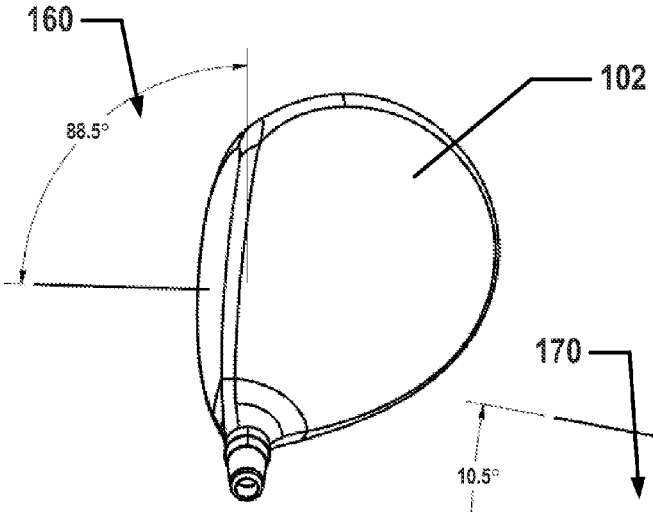
FIG. 30B illustrates an exemplary face angle of the club head for an exemplary rotational configuration in accordance with examples of this invention.
Figure 30C:
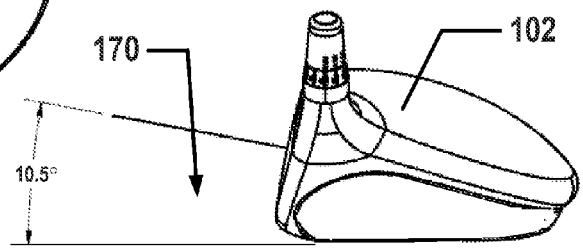
FIG. 30C illustrates an exemplary loft angle of the club head for an exemplary rotational configuration in accordance with examples of this invention.
Figure 31A:
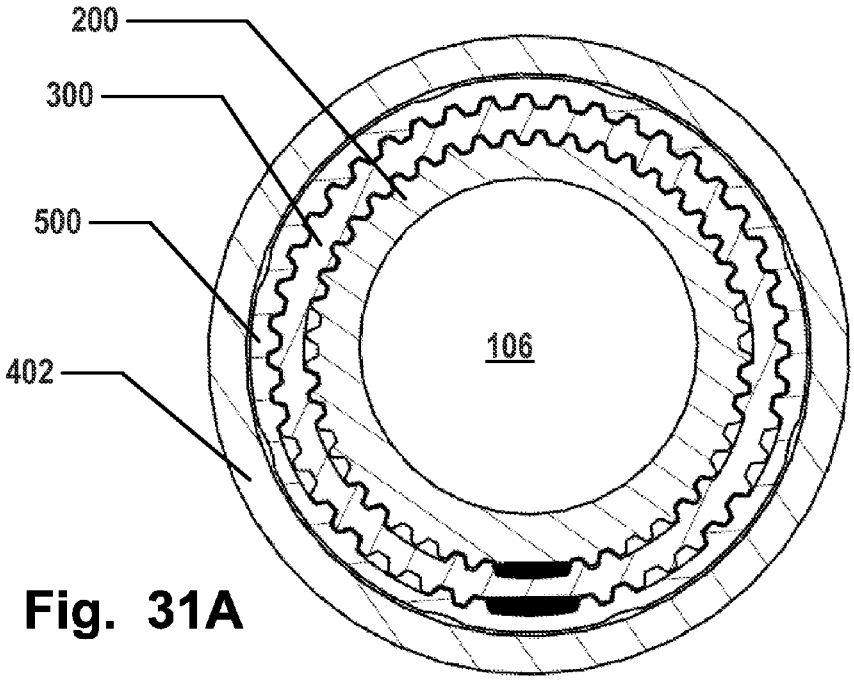
FIG. 31A illustrates a cross-sectional view of the releasable connection for an exemplary rotational configuration in accordance with examples of this invention.
Figure 31B:
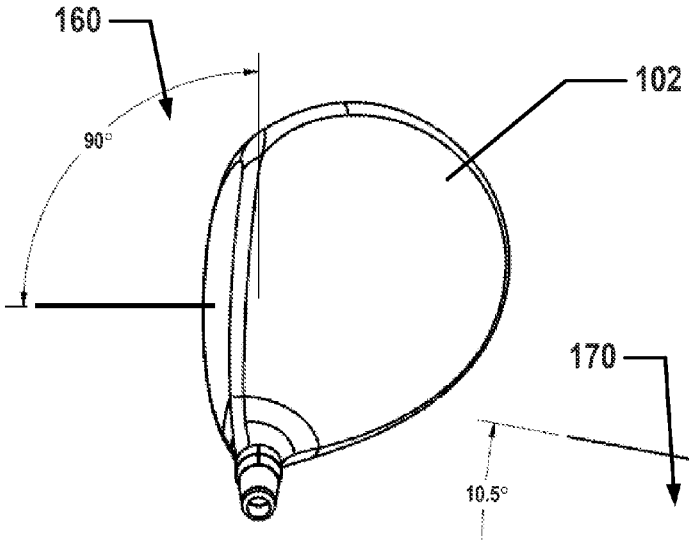
FIG. 31B illustrates an exemplary face angle of the club head for an exemplary rotational configuration in accordance with examples of this invention.
Figure 31C:
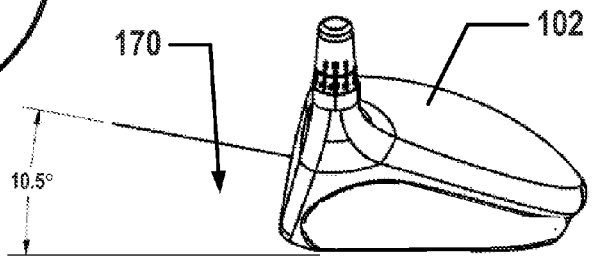
FIG. 31C illustrates an exemplary loft angle of the club head for an exemplary rotational configuration in accordance with examples of this invention.
Figure 32A:
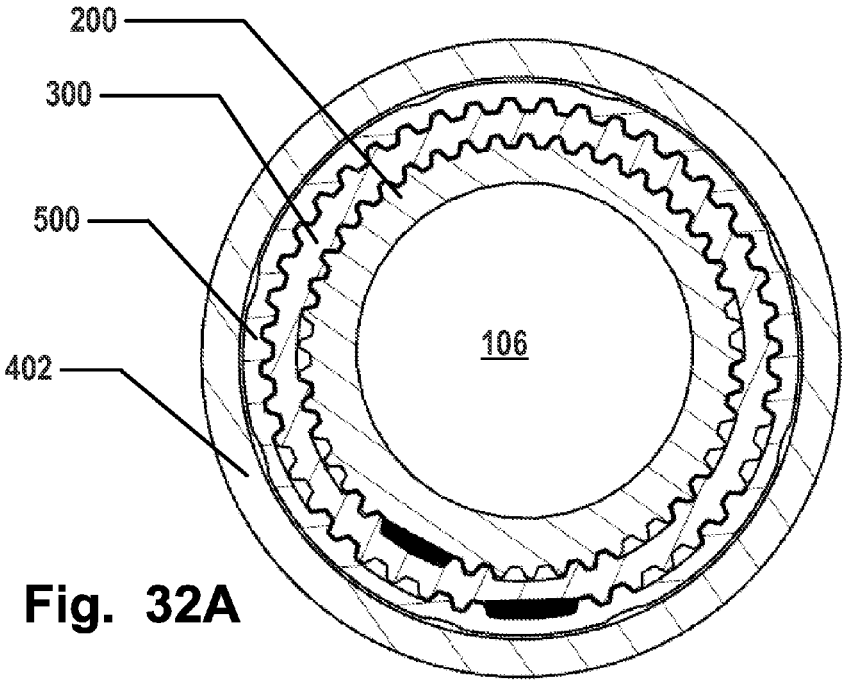
FIG. 32A illustrates a cross-sectional view of the releasable connection for an exemplary rotational configuration in accordance with examples of this invention.
Figure 32B:
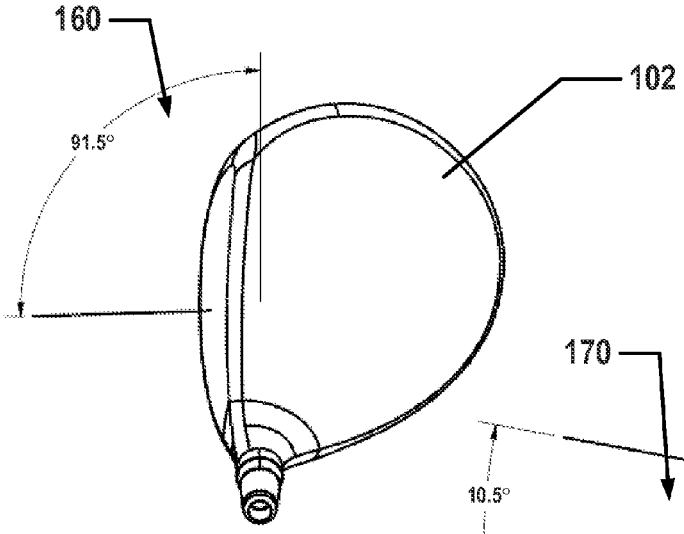
FIG. 32B illustrates an exemplary face angle of the club head for an exemplary rotational configuration in accordance with examples of this invention.
Figure 32C:
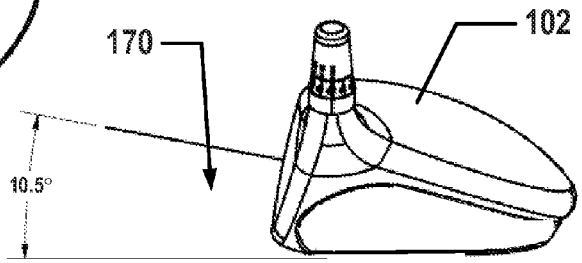
FIG. 32C illustrates an exemplary loft angle of the club head for an exemplary rotational configuration in accordance with examples of this invention.
Figure 33A:
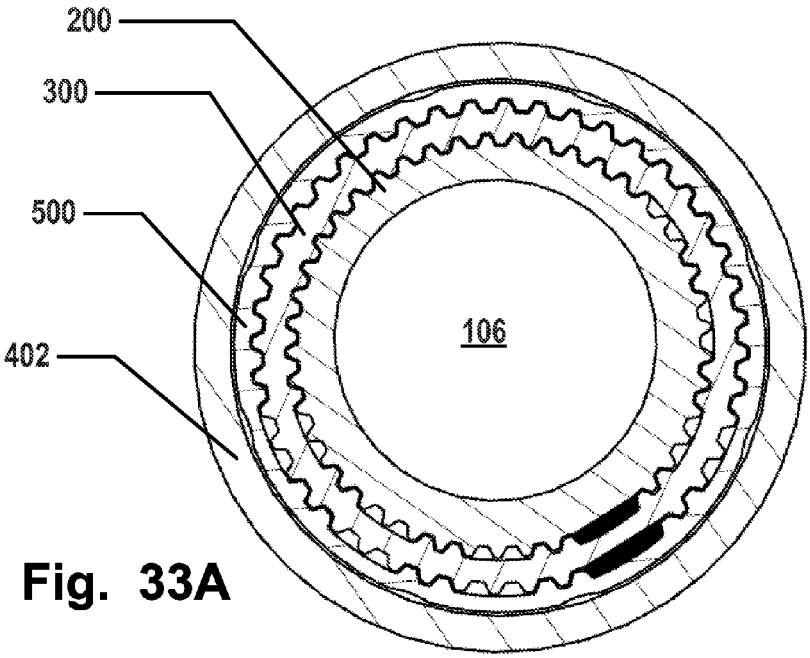
FIG. 33A illustrates a cross-sectional view of the releasable connection for an exemplary rotational configuration in accordance with examples of this invention.
Figure 33B:
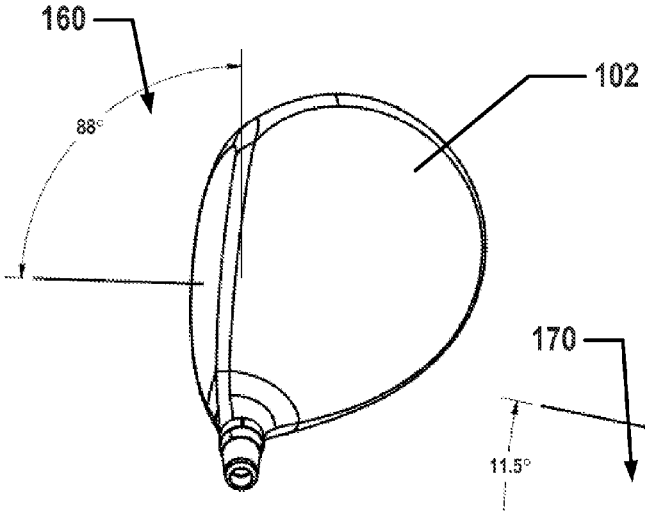
FIG. 33B illustrates an exemplary face angle of the club head for an exemplary rotational configuration in accordance with examples of this invention.
Figure 33C:
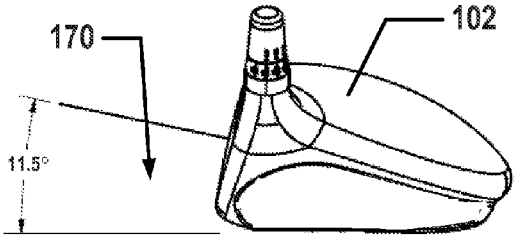
FIG. 33C illustrates an exemplary loft angle of the club head for an exemplary rotational configuration in accordance with examples of this invention.
Figure 34A:
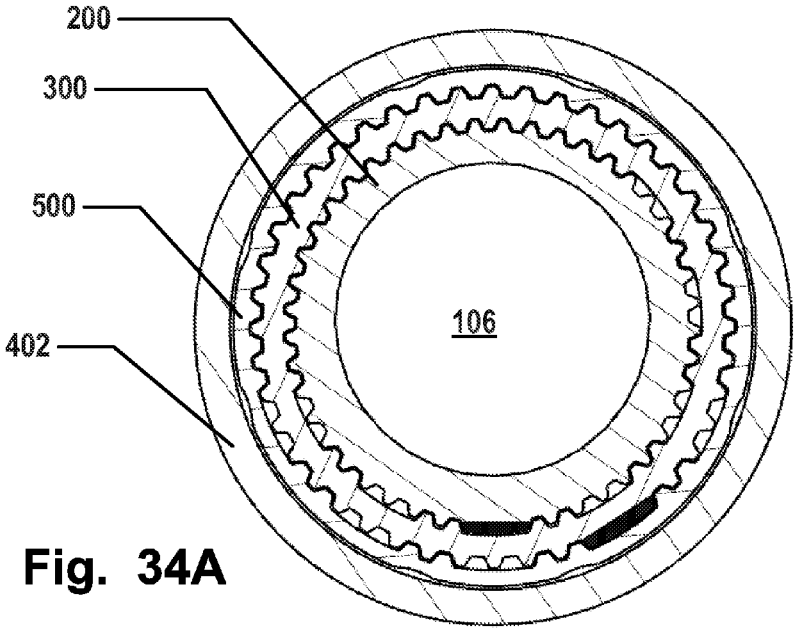
FIG. 34A illustrates a cross-sectional view of the releasable connection for an exemplary rotational configuration in accordance with examples of this invention.
Figure 34B:
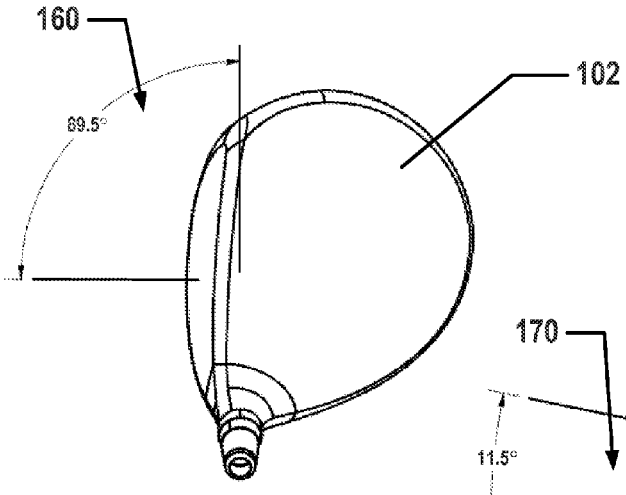
FIG. 34B illustrates an exemplary face angle of the club head for an exemplary rotational configuration in accordance with examples of this invention.
Figure 34C:
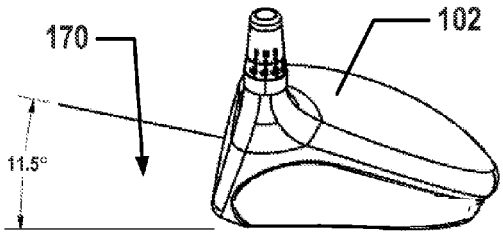
FIG. 34C illustrates an exemplary loft angle of the club head for an exemplary rotational configuration in accordance with examples of this invention.
Figure 35A:
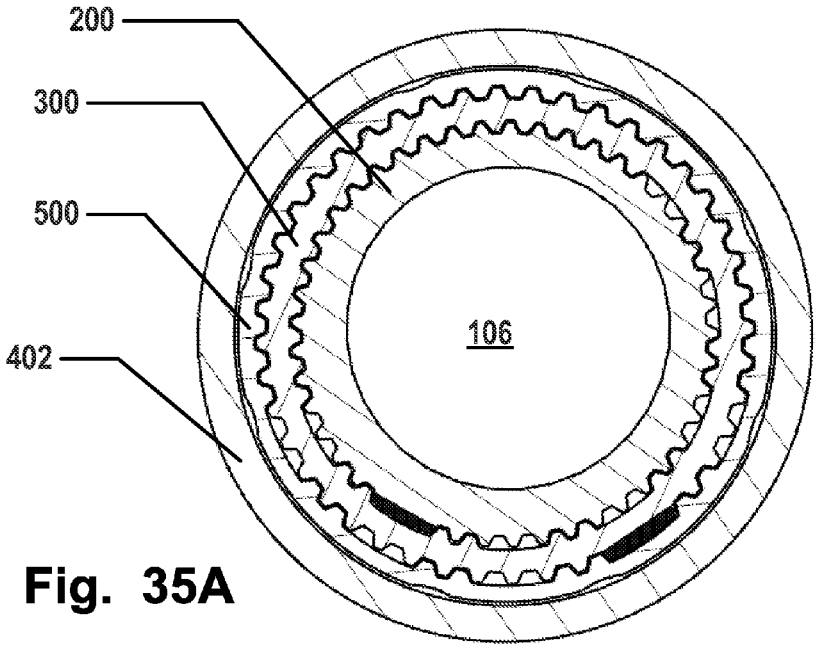
FIG. 35A illustrates a cross-sectional view of the releasable connection for an exemplary rotational configuration in accordance with examples of this invention.
Figure 35B:
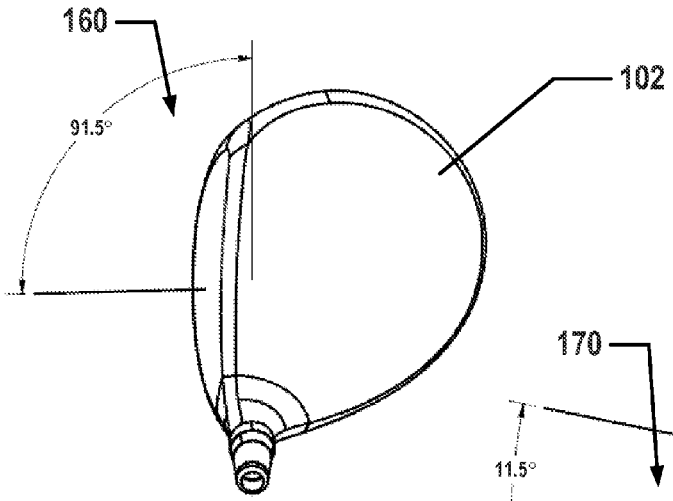
FIG. 35B illustrates an exemplary face angle of the club head for an exemplary rotational configuration in accordance with examples of this invention.
Figure 35C:
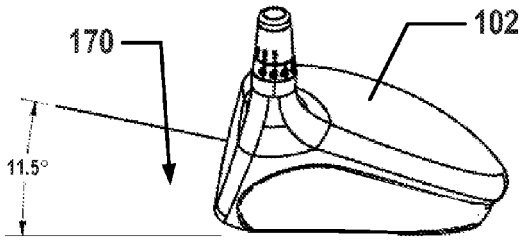
FIG. 35C illustrates an exemplary loft angle of the club head for an exemplary rotational configuration in accordance with examples of this invention.
Figure 36A:
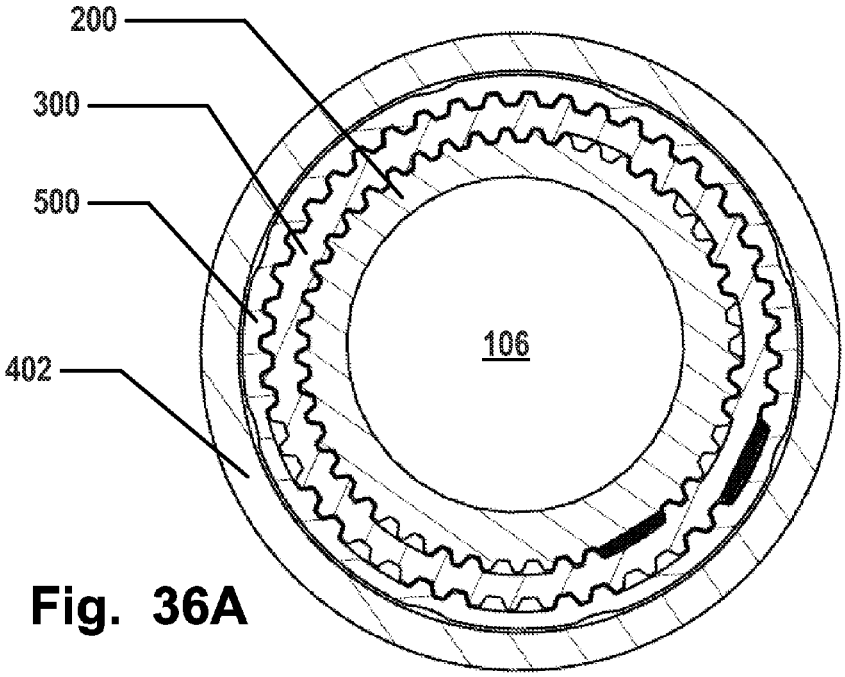
FIG. 36A illustrates a cross-sectional view of the releasable connection for an exemplary rotational configuration in accordance with examples of this invention.
Figure 36B:
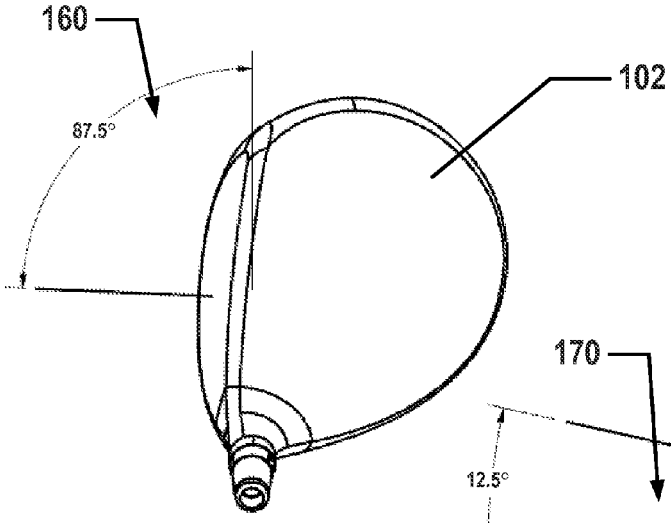
FIG. 36B illustrates an exemplary face angle of the club head for an exemplary rotational configuration in accordance with examples of this invention.
Figure 36C:
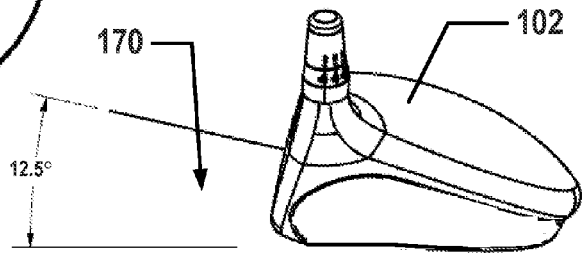
FIG. 36C illustrates an exemplary loft angle of the club head for an exemplary rotational configuration in accordance with examples of this invention.
Figure 37A:
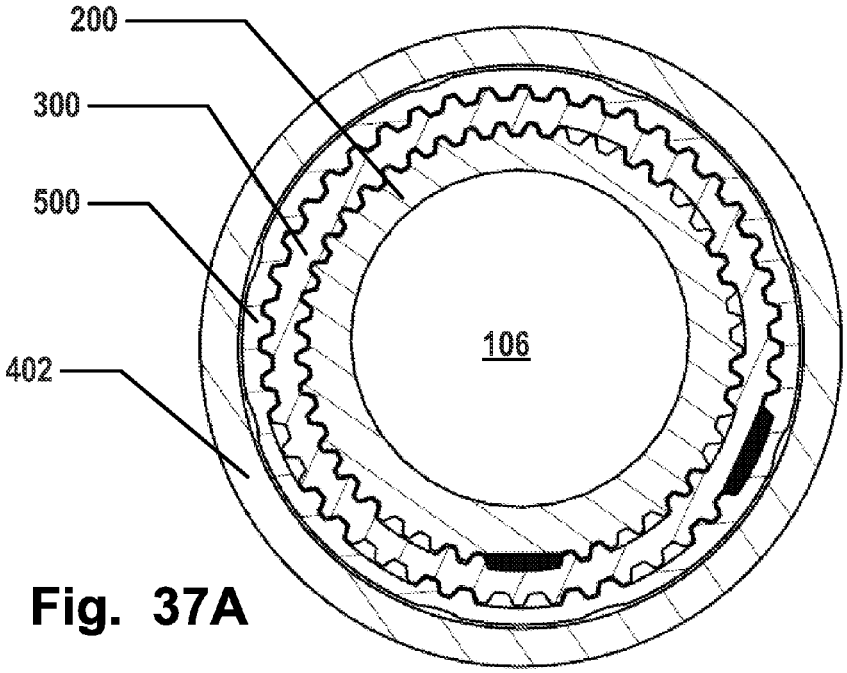
FIG. 37A illustrates a cross-sectional view of the releasable connection for an exemplary rotational configuration in accordance with examples of this invention.
Figure 37B:
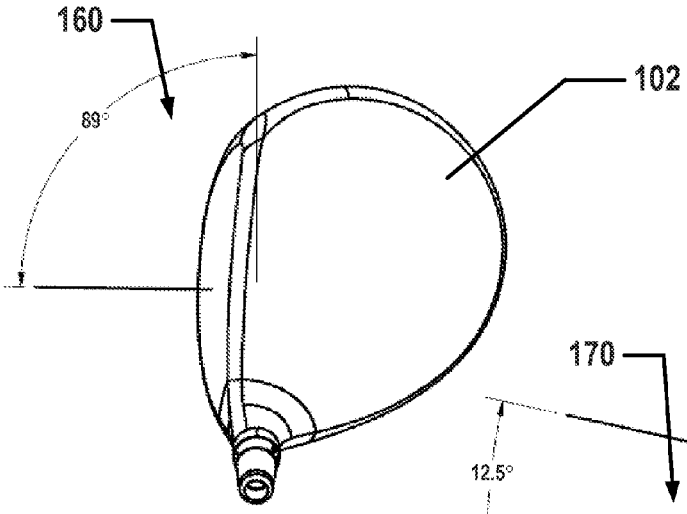
FIG. 37B illustrates an exemplary face angle of the club head for an exemplary rotational configuration in accordance with examples of this invention.
Figure 37C:
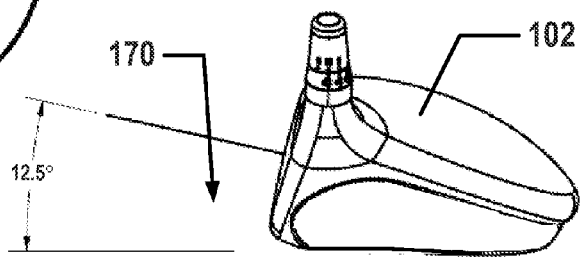
FIG. 37C illustrates an exemplary loft angle of the club head for an exemplary rotational configuration in accordance with examples of this invention.
Figure 38A:
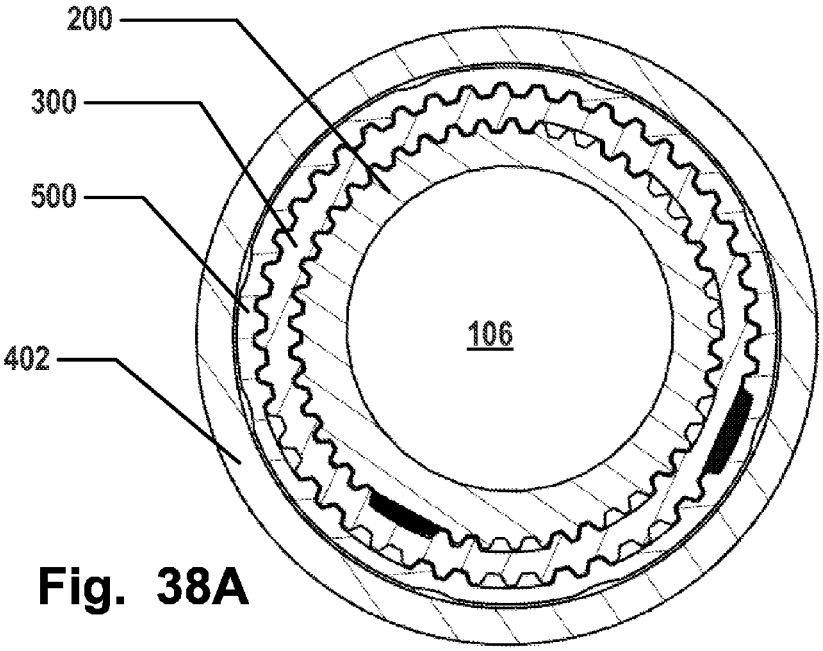
FIG. 38A illustrates a cross-sectional view of the releasable connection for an exemplary rotational configuration in accordance with examples of this invention.
Figure 38B:
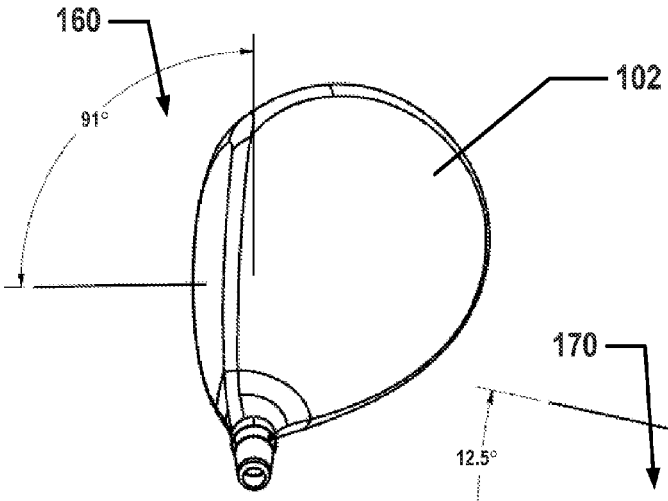
FIG. 38B illustrates an exemplary face angle of the club head for an exemplary rotational configuration in accordance with examples of this invention.
Figure 38C:
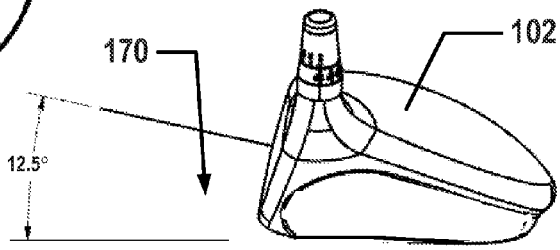
FIG. 38C illustrates an exemplary loft angle of the club head for an exemplary rotational configuration in accordance with examples of this invention.

In another embodiment without departing from this disclosure, FIGS. 23-38C illustrate another releasable connection assembly with corresponding different club head configurations with differing loft and face angle configurations. The figures includes cross-sectional views of the spline interactions of an exemplary shaft adapter 200, hosel adapter 300, and hosel ring 500. FIG. 23 illustrates a comprehensive summary chart of the cross-section view of the releasable connection and rotational configurations for each of the different club head configurations. Along the top of the summary chart is the face angle of the club head, such as open, neutral, and closed. Along the left side of the summary chart is the loft angle of the club head, such as 8.5 degrees, 9.5 degrees, 10.5 degrees, 11.5 degrees, and 12.5 degrees. The releasable connection assembly, using the different rotational spline configurations may achieve any of the listed fifteen different club head configurations creating the combinations of the various face angles and loft angles.

FIGS. 24A-38C illustrate detailed views of each individual connection assembly and rotational spline configuration with the applicable club head configuration. The various figures illustrate the possible rotational configurations and the interaction of the rotational inhibiting structures on the shaft adapter, hosel, adapter, and hosel ring. The "A" figure illustrates the cross-sectional view of the releasable connection 104 that includes an exemplary shaft adapter 200 engaged on a shaft 106, a hosel adapter 300, and a hosel ring 500 inserted in the hosel portion 402 of the club head 102. The "B" figure illustrates the exemplary face angle 160 of the club head 102. The "C" figure illustrates the exemplary loft angle 170 of the club head 102.

FIGS. 39A-44 illustrate another exemplary embodiment similar to the releasable connection as described above. Similar reference numbers have been utilized for these figures as were used for the previous figures for simplicity and understanding. The spline configurations as discussed and illustrated for FIGS. 23 through 38C may be utilized with this exemplary embodiment. Other spline configurations may be utilized without departing from this invention. In this exemplary embodiment, neither the shaft adapter 1200 nor the hosel adapter 1300 need to be removed from the club head 1102 to rotate the shaft adapter 1200 and/or hosel adapter 1300 to various configurations. The shaft adapter 1200 and hosel adapter 1300 are captive within the releasable connection 1104. In one exemplary embodiment to achieve this captive feature, the shaft adapter 1300 may include a stop ring 1205. The stop ring 1205 may be in the form of a compression o-ring. The stop ring 1205 may also be other mechanical features without departing from this invention, such as c-clips. This stop ring 1205 allows the hosel adapter 1300 to disengage from the shaft adapter 1200 without being removed from the club head 1102 and thereby allows the hosel adapter 1300 and/or the shaft adapter 1200 to be rotated without being removed from the club head 1102.

Figure 39A:
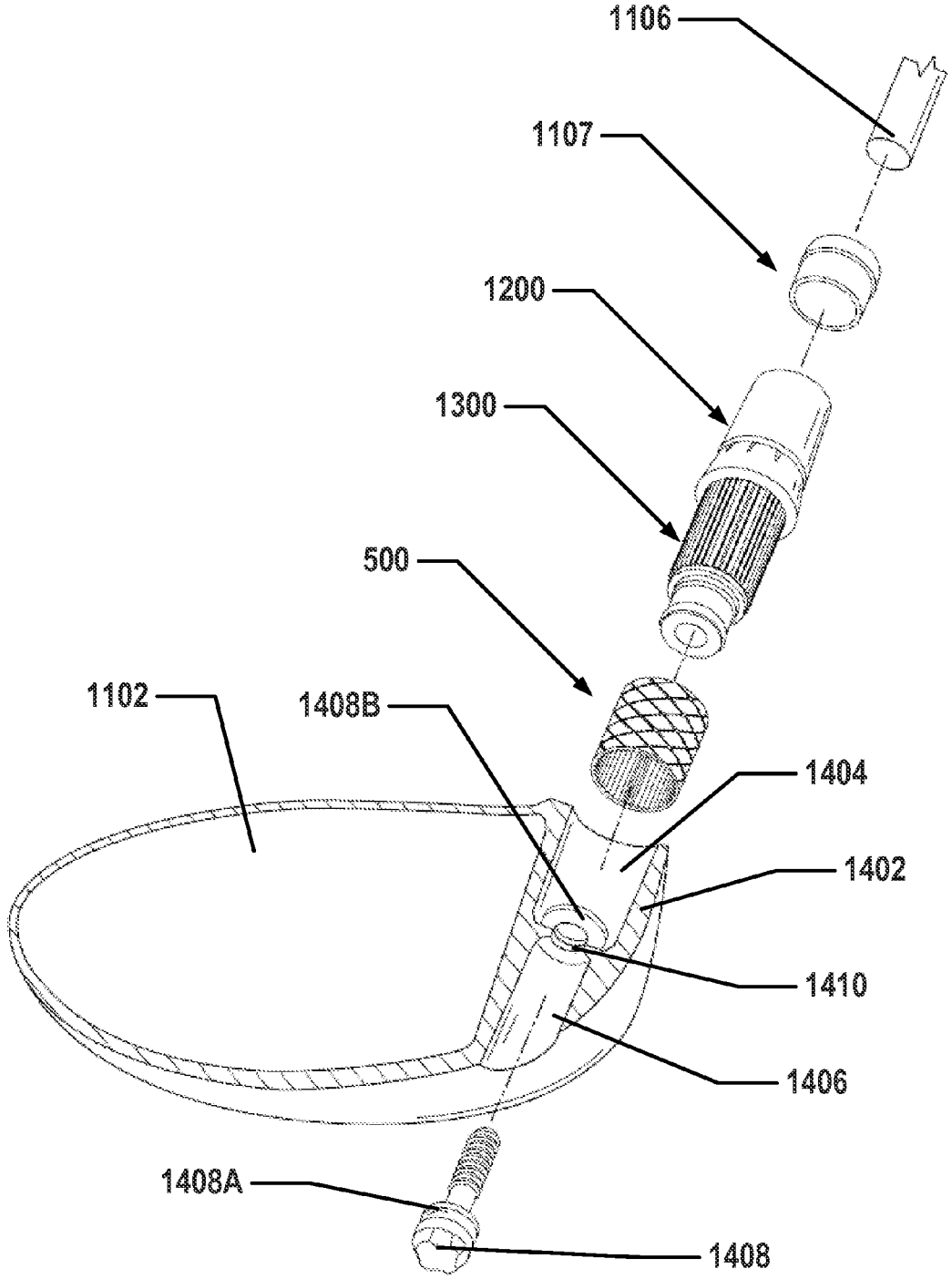
FIGS. 39A through 44 illustrated an additional embodiment of a releasable connection in accordance with examples of this invention.
Figure 39B:
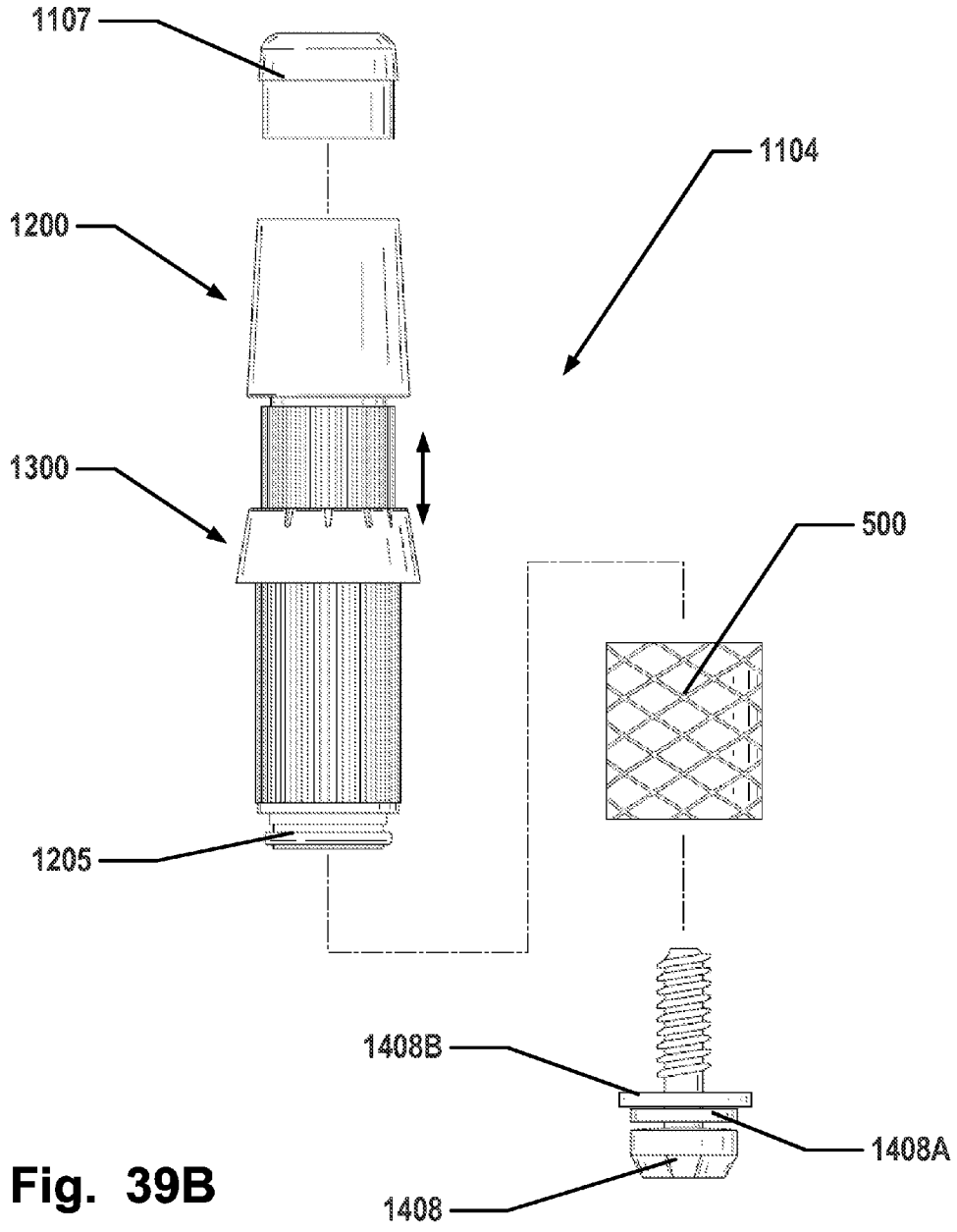

FIGS. 39A and 39B illustrate an exploded view of the releasable connection 1104. As illustrated in FIG. 39A, this releasable connection 1104 between the golf club head 1102 and the shaft 1106 includes a shaft adapter 1200, a hosel adapter 1300, and a hosel ring 500. Generally, the hosel ring 500 is configured to engage a club head chamber 1404 in the golf club head 1102, the hosel adapter 1300 is configured to engage in the hosel ring 500 and the golf club head 1102, the shaft adapter 1200 is configured to engage in the hosel adapter 1300, and the shaft 1106 is configured to engage the shaft adapter 1200. The details of the engagement of these example components/parts will be explained in more detail below.

As noted above, the releasable connection 1104 may include an example shaft adapter 1200 in accordance with this invention. As illustrated in FIGS. 40A through 40D, this example shaft adapter 1200 includes a generally cylindrical body 1202 having a first end 1204 and an opposite second end 1206. The first end 1204 defines an opening to an interior cylindrical chamber 1208 for receiving the end of a golf club shaft 1106. The second end 1206 includes a securing structure (e.g., a threaded hole 1210 in this example structure) that assists in securely engaging the shaft adapter 1200 to a club head body 1102 as will be explained in more detail below. Additionally, the second end 1206 includes a stop ring 1205. The stop ring 1205 may extend radially from the second end 1206 of the shaft adapter 1200. The stop ring 1205 may be capable of stopping and holding the hosel adapter 1300 engaged with the shaft adapter 1200, but thereby allowing the adjustment and rotation of the hosel adapter 1300 and/or the shaft adapter 1200 without being removed from the club head 1102. The stop ring 1205 may be integral to the shaft adapter 1200, i.e. formed and/or as part of the shaft adapter 1200, extending radially from the second end 1206 of the shaft adapter 1200. Additionally, the stop ring 1205 may be a separate compression o-ring that fits into a channel 1207 that extends radially around the second end 1206 of the shaft adapter 1200. The separate stop ring 1205 (compression o-ring) may be rubber or a metal material.

As shown, at least a portion of the first end 1204 of the shaft adapter 1200 includes a first rotation-inhibiting structure 1212. While a variety of rotation-inhibiting structures may be provided without departing from this invention, in this example structure, the rotation-inhibiting structure 1212 constitutes splines 1212*a* extending along a portion of the longitudinal axis 1226 of the exterior surface of the shaft adapter 1200. The splines 1212*a* of the shaft adapter 1200 may prevent rotation of the shaft adapter 1200 with respect to the member into which it is fit (e.g., a hosel adapter, as will be explained in more detail below). A variety of rotation-inhibiting structures may be used without departing from the invention. The interaction between these splines and the hosel adapter cylindrical interior will be discussed more below. Other configurations of splines may be utilized without departing from this invention.

The first rotation-inhibiting structure 1212 may extend along a length of the shaft adapter 1200 such that the hosel adapter 1300 can be disengaged from the first rotation-inhibiting structure 1212 and be rotated while still captive on the shaft adapter 1200.

FIGS. 40A and 40B further illustrate that the first end 1204 of the shaft adapter 1200 includes an expanded portion 1214. The expanded portion 1214 provides a stop that prevents the shaft adapter 1200 from extending into the hosel adapter 1300 and the club head body 1102 and provides a strong base for securing the shaft adapter 1200 to the hosel adapter 1300 and the club head body 1102. Also, the exterior shape of the first end 1204 may be tapered to provide a smooth transition between the shaft 1106, the hosel adapter 1300, and the club head 1102 and a conventional aesthetic appearance.

Figure 40C:
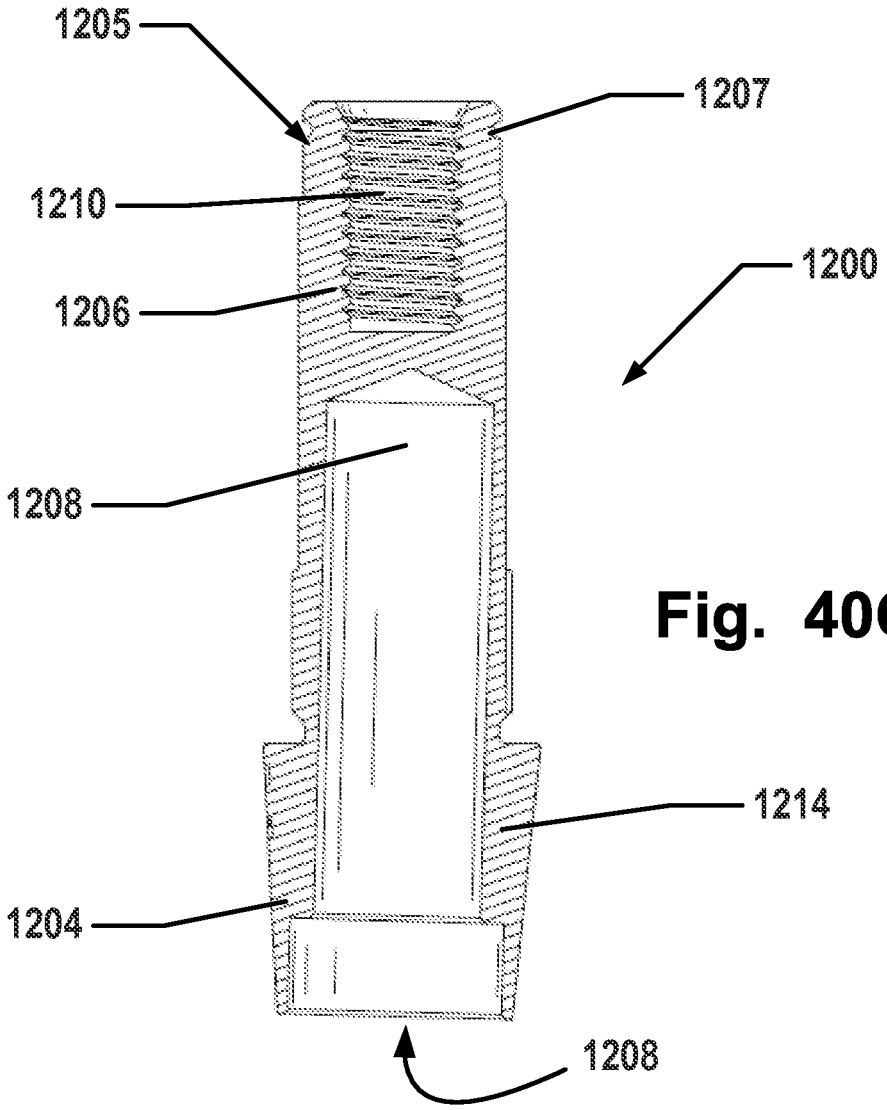
Figure 40D:
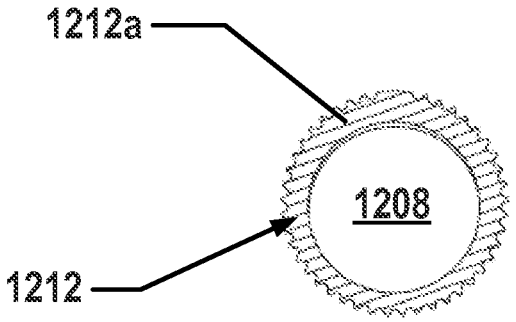

Other features of this example shaft adapter 1200 may include an "off-axis" or angled bore hole or interior chamber 1208 in which the shaft 1106 is received as illustrated for example in FIG. 40C. More specifically, in this illustrated example, the outer cylindrical surface of the shaft adapter 1200 extends in a first axial direction, and the interior cylindrical surface of the bore hole 1208 extends in a second axial direction that differs from the first axial direction, thereby creating a shaft adapter offset angle. In this manner, while the shaft adapter 1200 exterior maintains a constant axial direction corresponding to that of the interior of the hosel adapter 1300 and the openings, the shaft 1106 extends away from the club head 1102 and the hosel adapter 1300 at a different and adjustable angle with respect to the club head 1102, the hosel adapter 1300, and the club head's ball striking face. In this given example, the shaft position and/or angle corresponds to a given face angle of the golf club head 1102. One rotational position may be neutral face, one rotational position may be open face, and one rotational position may be closed face. Other rotational positions may be utilized without departing from this invention. The shaft position and/or face angle may be adjusted, for example, by rotating the shaft adapter 1200 with respect to the hosel adapter 1300 and the club head hosel.

While any desired shaft adapter offset angle may be maintained between the first axial direction and the second axial direction, in accordance with some examples of this invention, this shaft adapter offset angle or face angle adjustment may be between 0.25 degrees and 10 degrees, and in some examples between 0.5 degrees and 8 degrees, between 0.75 degrees and 6 degrees, or even between 1 degree and 4 degrees. In more specific examples of the invention, the shaft adapter offset angle or face angle adjustment may by approximately 1.5 degrees offset or 2.0 degrees offset.

The example releasable connection 1104 may further include a hosel adapter 1300. FIGS. 41A through 41E illustrate an example hosel adapter 1300 in accordance with this invention. As shown, the hosel adapter 1300 is generally cylindrical in shape. The hosel adapter 1300 has a first end 1304 and an opposite second end 1306. The first end 1304 defines an opening to a borehole 1308 for receiving the shaft adapter 1200. Within the first end 1304 and along the interior sides of the borehole 1308, the first end 1304 includes a second rotation-inhibiting structure 1312 configured to engage the first rotation-inhibiting structure 1212 on the shaft adapter 1200 (e.g., in an interlocking manner with respect to rotation).

Figure 41A:
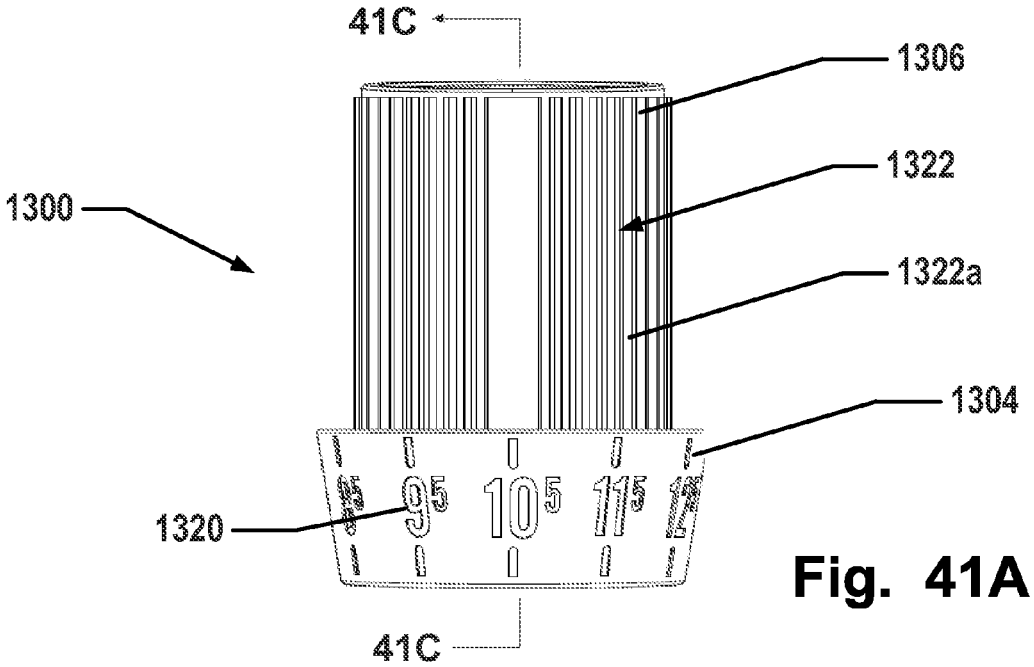
Figure 41B:
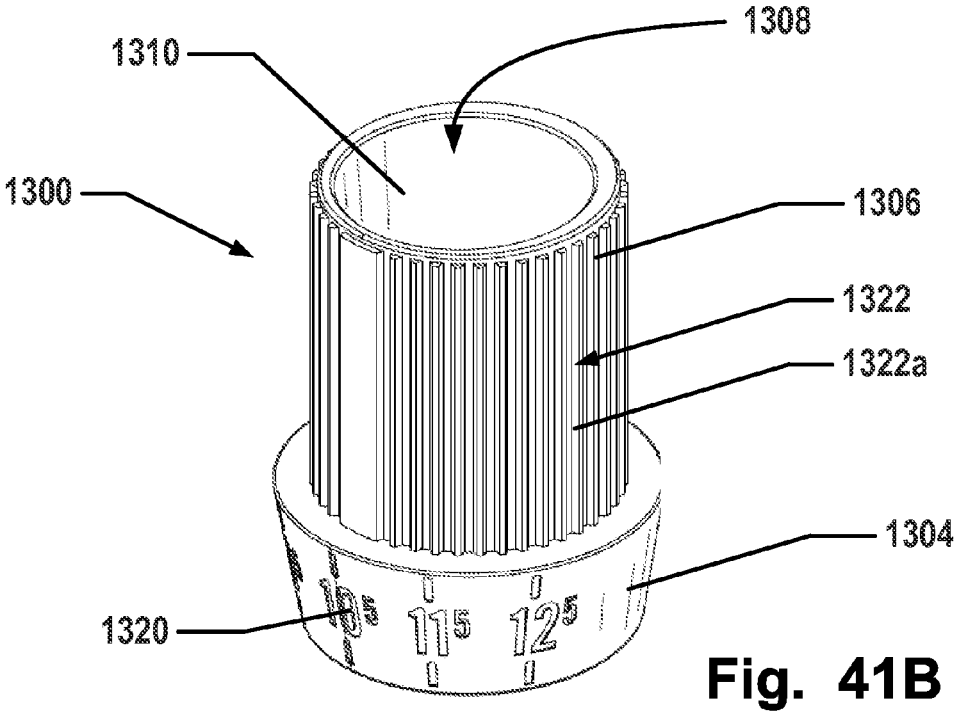
Figure 41C:
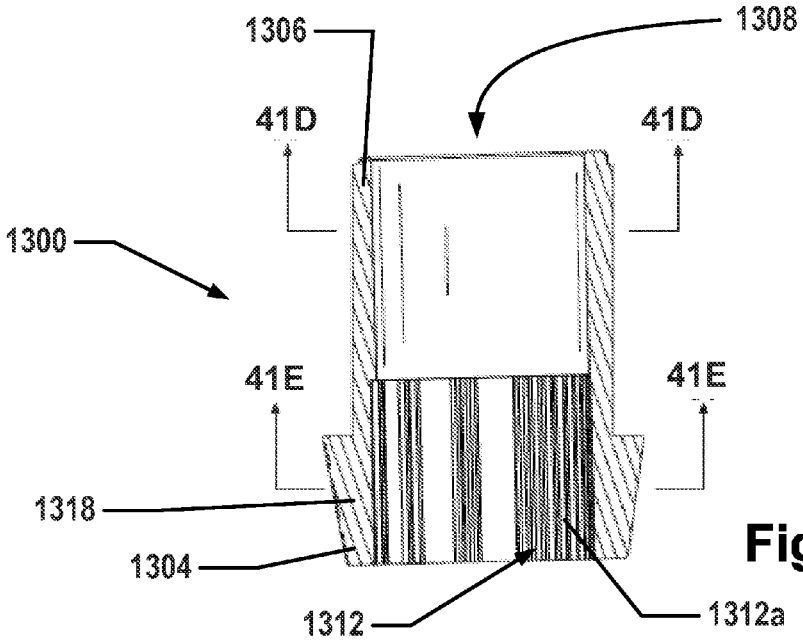
Figure 41D:
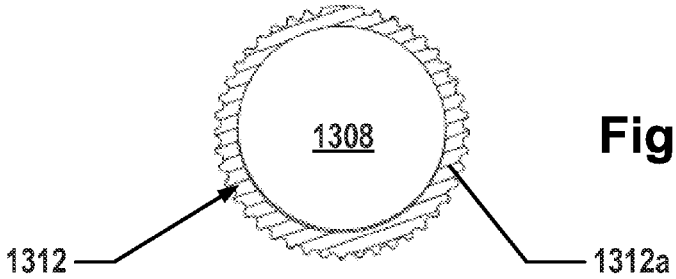
Figure 41E:
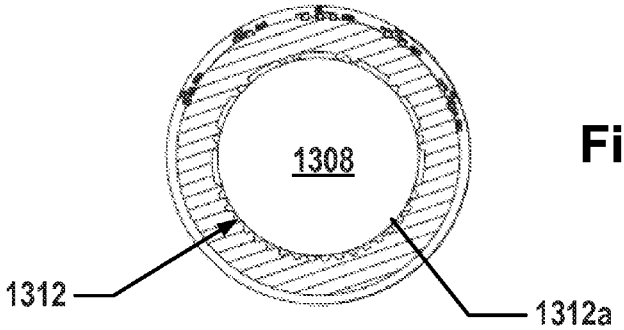

As illustrated in FIG. 41C, at least a portion of the interior of the first end 1304 of the hosel adapter 1300 includes the second rotation-inhibiting structure 1312. While a variety of rotation-inhibiting structures may be provided without departing from this invention, in this example structure, the second rotation-inhibiting structure 1312 constitutes splines 1312*a* extending along the interior longitudinal axis. The splines 1312*a* of the hosel adapter 1300 may prevent rotation of the shaft adapter 1200 with respect to the hosel adapter 1300 into which it is fit (and ultimately with respect to a golf club head). The splines 1312*a* of the hosel adapter 1300 and the splines 1212*a* of the shaft adapter 1200 may be configured to interact with each other to thereby limit the number of rotations of the shaft adapter 1200 within the hosel adapter 1300. This will be explained more below.

Other features of this example hosel adapter 1300 may include an "off-axis" or angled bore hole or interior chamber 1308 in which the shaft adapter 1200 is received as illustrated for example in FIG. 41C. More specifically, in this illustrated example, the outer cylindrical surface of the hosel adapter 1300 extends in a first axial direction, and the interior cylindrical surface of the bore hole 1308 extends in a second axial direction that differs from the first axial direction, thereby creating a hosel adapter offset angle. In this manner, while the hosel adapter 1300 exterior maintains a constant axial direction corresponding to that of the interior of the club head chamber 1404 and hosel ring 500 and the openings, the shaft adapter 1200 (and thereby the shaft 1106) extends away from the club head 1102 at a different and adjustable angle with respect to the club head 1102, the hosel adapter 1300, and the club head's ball striking face. In this given example, the shaft position and/or angle corresponds to a given loft angle. The rotational positions for loft angle may be defined by loft angles starting from approximately 7.5 degrees to 12.5 degrees. Similar configurations of loft angles starting lower and higher may also be utilized without departing from this invention. The club head position and/or loft angle may be adjusted, for example, by rotating the hosel adapter 1300 with respect to the hosel ring 500 and the club head 1102.

While any desired hosel adapter offset angle may be maintained between the first axial direction and the second axial direction, in accordance with some examples of this invention, this hosel adapter offset angle or face angle adjustment may be between 0.25 degrees and 10 degrees, and in some examples between 0.5 degrees and 8 degrees, between 0.75 degrees and 6 degrees, or even between 1 degree and 4 degrees. In more specific examples of the invention, the hosel adapter offset angle or face angle adjustment may by approximately 1 degree or one-half degree offset.

The second end 1306 of the hosel adapter 1300 defines a second opening 1310 for receiving a securing member 1408. Generally, the second opening 1310 is sized such that the securing member 1408 is able to freely pass through the second opening 1310 to engage the threaded hole 1210 in the shaft adapter 1200. Alternatively, if desired, the securing member 1408 also may engage the hosel adapter 1300 at the second opening 1310 (e.g., the second opening 1310 may include threads that engage threads provided on the securing member 1408). The securing member 1408 may also include a spherical washer 1408A and a screw retention device 1408B.

Figure 42A:
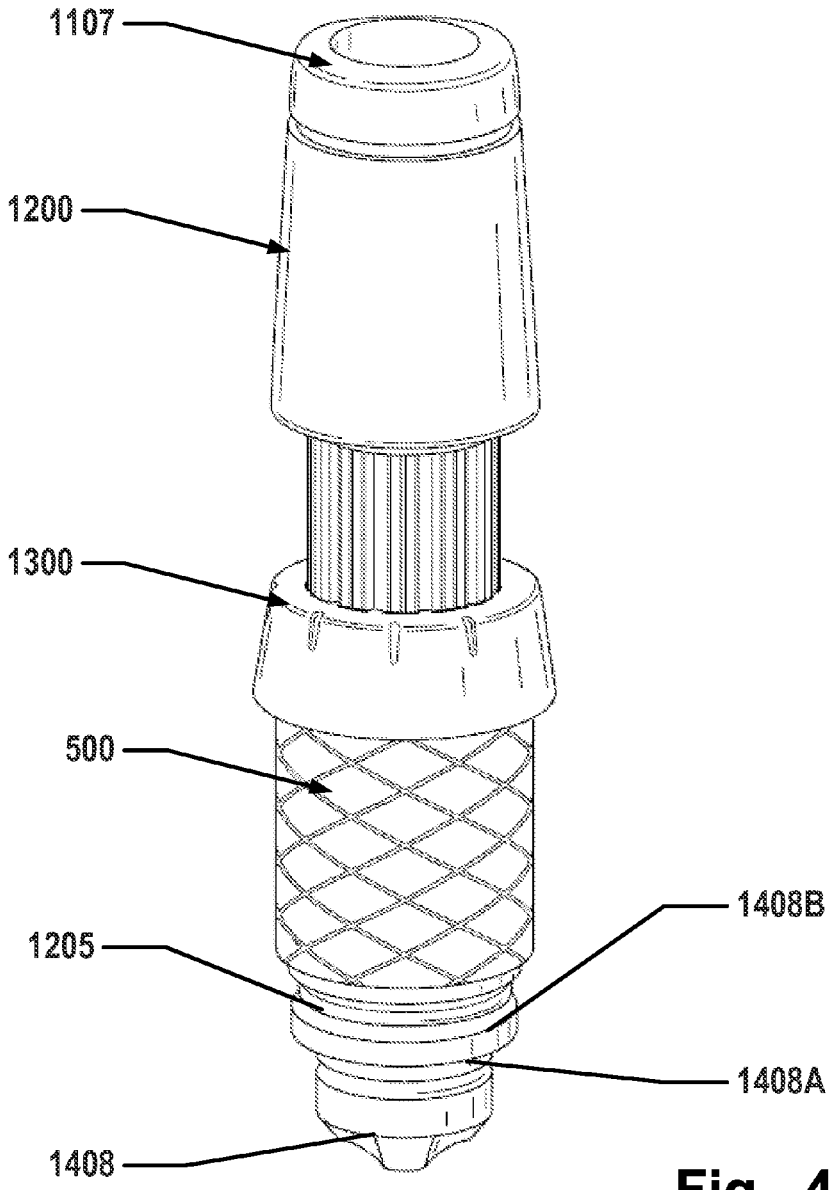
Figure 42B:
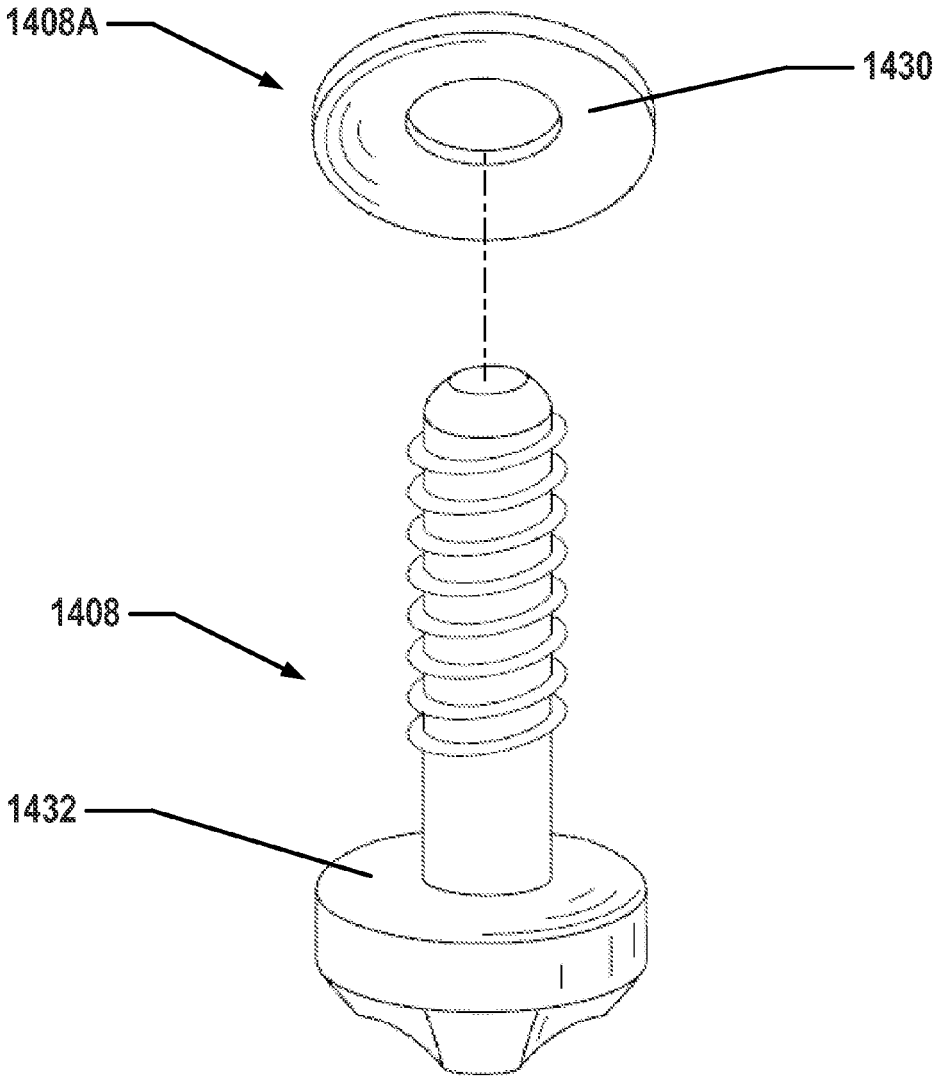
Figure 43:
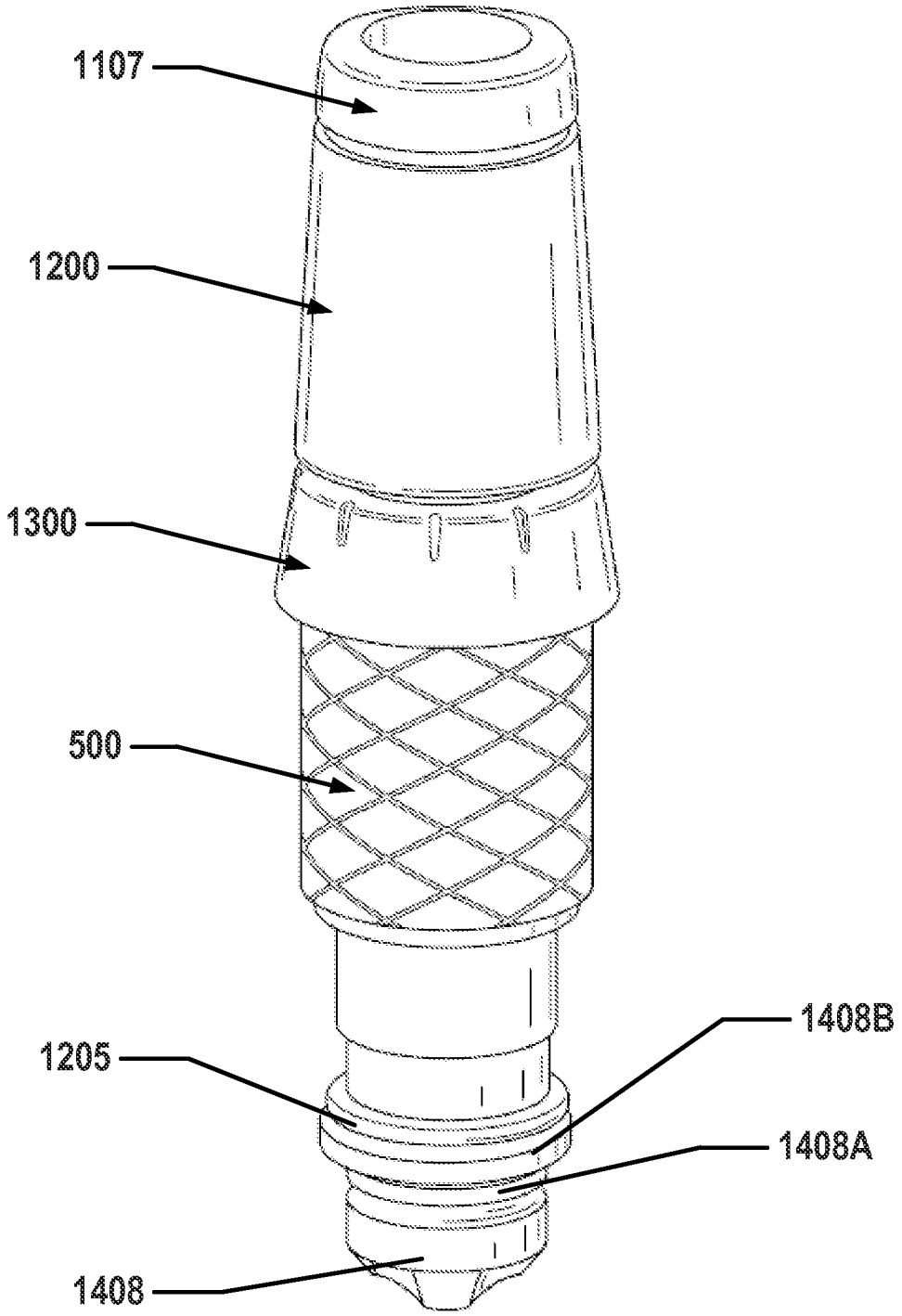
Figure 44:
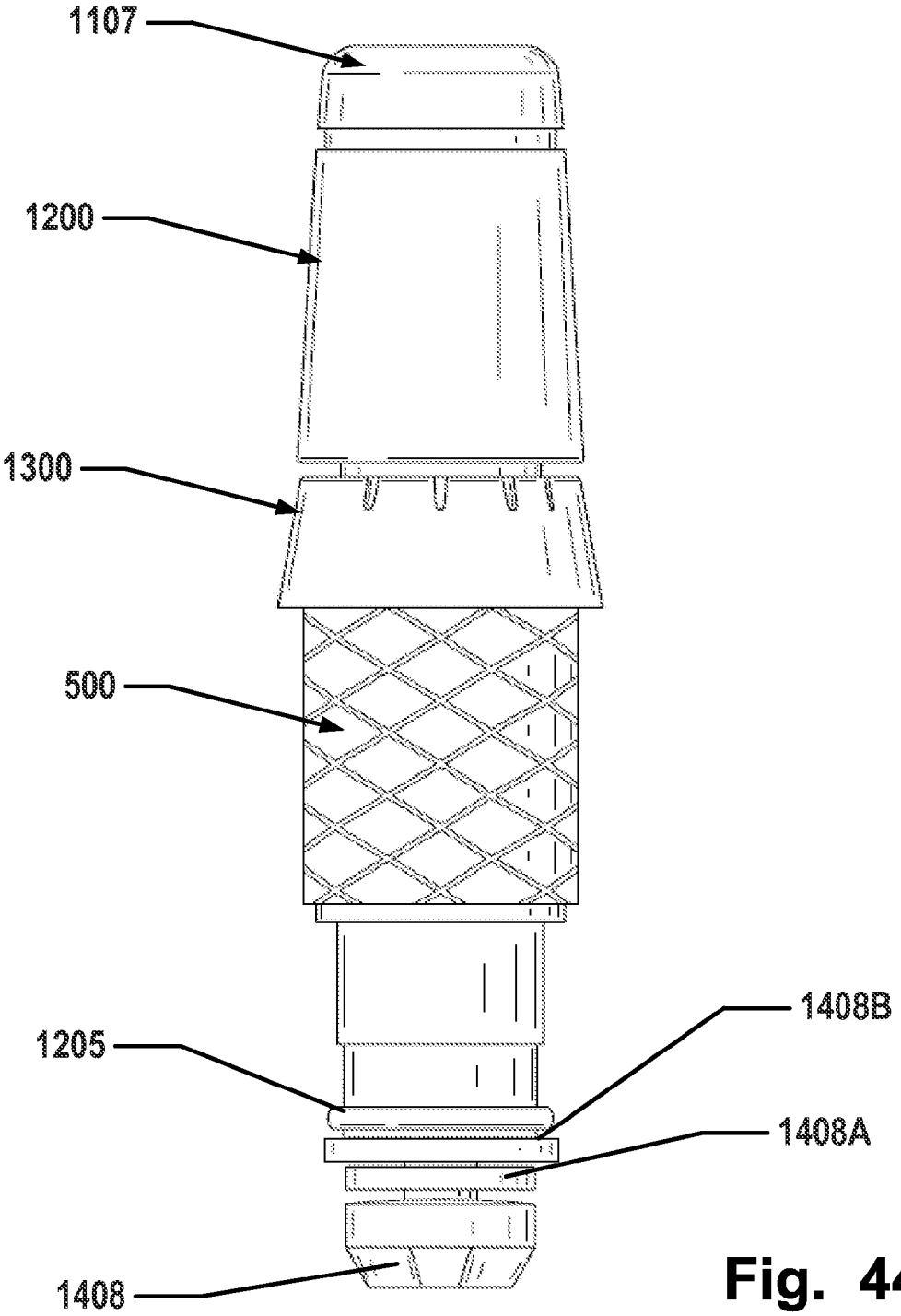

As illustrated in FIG. 42B, the spherical washer 1408A may have a convex surface 1430 on the side that mates or engages the head of the threaded bolt member 1408. Additionally, the head of the threaded bolt member 1408 may have a concave surface 1432 that mates with the convex surface 1430 of the spherical washer 1408A. This convex-concave surface 1430-1432 mating assists with and allows the misalignment from the rotation of the off-axis sleeves may cause for the threaded bolt member 1408 and the rest of the releasable connection 1104.

As illustrated in FIG. 39A, the securing system may also include a screw retention device 1408B. The screw retention device may be located in the club head chamber 1404. Additionally, the screw retention device 1408B may be sized such that the screw retention device is bigger than the mounting plate 1410. The screw retention device 1408B retains the threaded bolt member 1408 and not allowing the threaded bolt member 1408 to fall out of the club head 1102.

The hosel adapter 1300 may also be non-rotatable with respect to the golf club head 1102. As illustrated in FIGS. 41A and 41B, the exterior of the first end 1304 along an exterior surface 1302 of the hosel adapter 1300 includes a third rotation-inhibiting structure 1322 configured to engage a fourth rotation-inhibiting structure 1512 on a hosel ring 500 (e.g., in an interlocking manner with respect to rotation). As shown, at least a portion of the first end 1304 of the hosel adapter 1300 includes the third rotation-inhibiting structure 1322 on the exterior surface 1302 of the hosel adapter. While a variety of rotation-inhibiting structures may be provided without departing from this invention, in this example structure, the rotation-inhibiting structure 1322 constitutes splines 1322*a* extending along the longitudinal axis of the exterior surface of the hosel adapter 1300. The splines 1322*a* on the exterior surface of the hosel adapter 1300 may prevent rotation of the hosel adapter 1300 with respect to the member into which it is fit (e.g., a club head or hosel ring 500, as will be explained in more detail below). The third rotation-inhibiting structure 1322 may extend along the overall longitudinal length of the hosel adapter 300.

FIGS. 41A and 41B further illustrate that the first end 1304 of the hosel adapter 1300 includes an expanded portion 1318. The expanded portion 1318 provides a stop that prevents the hosel adapter 1300 from extending into the club head body and provides a strong base for securing the hosel adapter 1300 to the club head body 1102. Also, the exterior shape of the first end 1304 may be tapered to provide a smooth transition between the shaft 1106 and the club head 1102 and a conventional aesthetic appearance.

Figure 9:
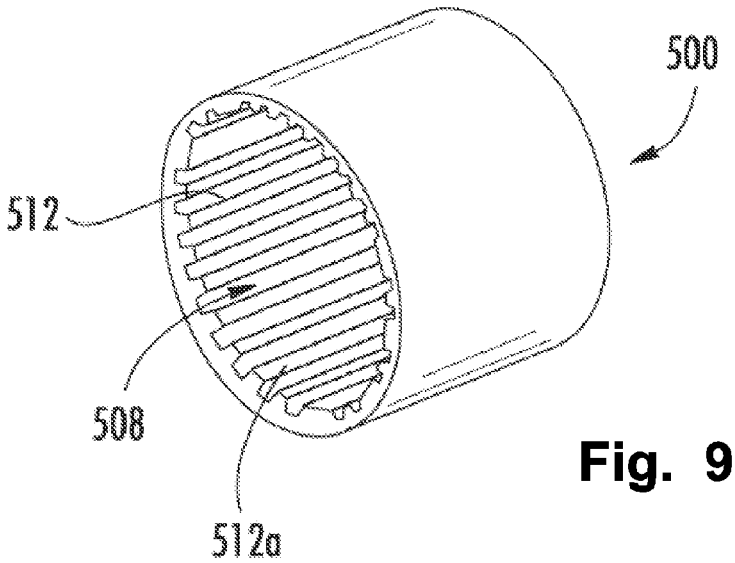
FIG. 9 illustrates a perspective view of another example hosel ring that may be used in accordance with examples of this invention.
Figure 10:
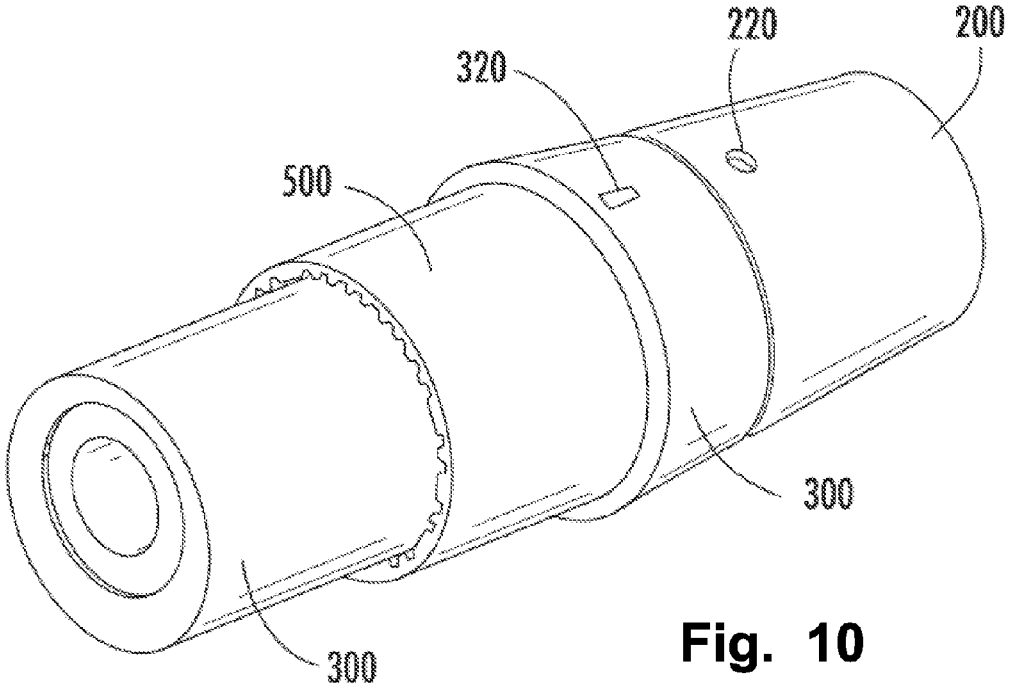
FIG. 10 illustrates another example assembled golf club head/shaft connection system in accordance with examples of this invention.

The example releasable connection 1104 may further include a hosel ring 500. Exemplary hosel rings 500 are illustrated in FIGS. 5 and 9, as well as FIGS. 39A and 39B. As shown, the hosel ring 500 is generally cylindrical in shape. Along the interior sides of the borehole 508, the hosel ring 500 includes a fourth rotation-inhibiting structure 512 configured to engage the third rotation-inhibiting structure 1322 on the hosel adapter 1300 (e.g., in an interlocking manner with respect to rotation). At least a portion of the interior of the hosel ring 500 includes the fourth rotation-inhibiting structure 512. While a variety of rotation-inhibiting structures may be provided without departing from this invention, in this example structure, the fourth rotation-inhibiting structure 512 constitutes splines 512*a* extending along the interior longitudinal axis. The splines 512*a* of the hosel ring 500 may prevent rotation of the hosel adapter 1300 with respect to the club head 1102 into which it is fit. The splines 512*a* of the hosel ring 500 and the exterior splines 1322*a* of the hosel adapter 1300 may be configured to interact with each other to thereby limit the number of rotations of the hosel adapter 1300 within the hosel ring 500. This interaction will be explained more below.

The hosel ring 500 may also be non-rotatable with respect to the golf club head 1102. In an exemplary embodiment, the hosel ring 500 may secured to the club head chamber 1404 by any means known and used in the art, such as adhesive, glue, epoxy, cement, welding, brazing, soldering, or other fusing techniques, etc.

FIGS. 42A through 44 illustrate the releasable connection 1104 showing all of the components fitted together. Additionally, as illustrated in FIGS. 39A, 39B, 42A, 43, and 44, the releasable connection 1104 may also include a shaft ring 1107. The shaft ring 1107 may provide an additional smooth transition from the shaft 1106 to the shaft adapter 1200.

Figure 45:
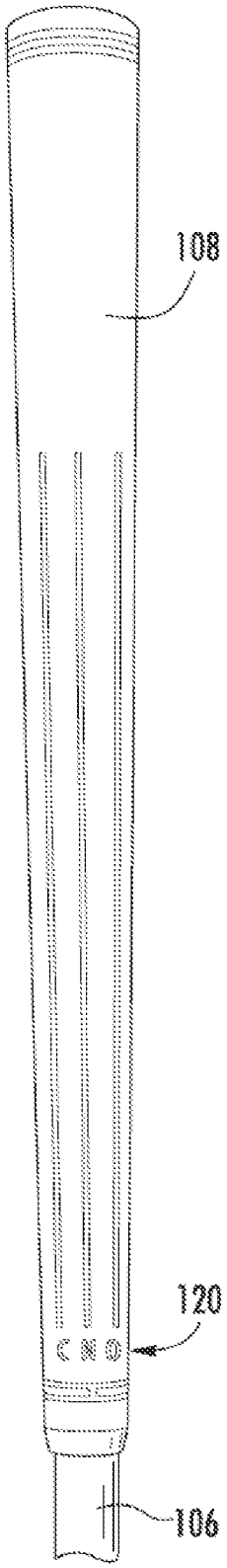
FIG. 45 illustrates a perspective view of a partial golf club shaft and grip in accordance with examples of this invention.

Additionally, FIG. 45 illustrates another method of a rotational position indicator. The rotational position indicator 120 may be located on the grip 108 of the shaft 106. As illustrated in FIG. 45, the grip rotational position indicator 120 shows face angles for "O" for open face angle, "N" for neutral face angle, and "C" for closed face angle. Other increments of more than three face angles as well as multiple lofts and/or combinations of both may be utilized without departing from this invention.

Additionally, the releasable connection assemblies may be used in any desired manner without departing from the invention. The clubs with such connection assemblies may be designed for use by the golfer in play (and optionally, if desired, the golfer may freely change shafts, heads, and/or their positioning with respect to one another). As another example, if desired, clubs including releasable connections in accordance with the invention may be used as club fitting tools and when the desired combination of head, shaft, and positioning have been determined for a specific golfer, a club builder may use the determined information to then produce a final desired golf club product using conventional (and permanent) mounting techniques (e.g., cements or adhesives). Other variations in the club/shaft connection assembly parts and processes are possible without departing from this invention.

CONCLUSION

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

I claim:

1. A golf club having a coupled head and shaft comprising:

a connection mechanism to couple the head to the shaft, the connection mechanism including a hosel adapter having an outer wall insertable into a hosel of the head and rotatable inside the hosel between a first plurality of rotational positions, the hosel adapter having a first internal inclined bore, and a shaft adapter coupled to the shaft at a distal end and having an outer wall configured to fit into the first internal inclined bore, the shaft adapter being rotatable inside the first internal inclined bore between a second plurality of rotational positions, the shaft adapter having a second internal inclined bore receiving the distal end of the shaft;

further wherein the first plurality of rotational positions is limited by the engagement between the hosel adapter and the hosel of the head and the second plurality of rotational positions is limited by the engagement between the hosel adapter and the shaft adapter, the first plurality of rotational positions changes a first angular relationship between the head and the shaft and the second plurality of rotational positions changes a second angular relationship between the head and the shaft, wherein a first spline configuration between the hosel adapter and the hosel of the head is defined by a first non-uniform rotation-inhibiting structure around the circumference of the outer wall of the hosel adapter and a second non-uniform rotation-inhibiting structure around the circumference of an interior bore of the hosel, and a second spline configuration between the hosel adapter and the shaft adapter is defined by a third non-uniform rotation-inhibiting structure around the circumference of the outer wall of the shaft adapter and a fourth non-uniform rotation-inhibiting structure around the circumference of the first internal inclined bore of the hosel adapter; and a grip member engaged with the shaft, wherein the grip member includes a rotation position indicator which includes setting adjustments for one or more of the first angular relationship and the second angular relationship.

2. The golf club of claim 1, wherein the first angular relationship and the second angular relationship are adjusted effectively independently of each other and the first angular relationship is one of a face angle or a loft angle and the second angular relationship is the other of the face angle or the loft angle.

3. The golf club of claim 2, wherein the rotation position indicator includes setting adjustments for the face angle.

4. The golf club of claim 3, wherein the engagement of the hosel adapter and the hosel of the head limits the adjustability of the face angle to three different face angles.

5. The golf club of claim 4, wherein the setting adjustments for the face angle include an "O" for open face angle, an "N" for neutral face angle, and a "C" for closed face angle.

6. The golf club of claim 2, wherein the rotation position indicator includes setting adjustments for the loft angle.

7. The golf club of claim 6, wherein the engagement of the shaft adapter and the hosel adapter limits the adjustability of the loft angle to five different loft angles.

8. The golf club of claim 7, wherein the five loft angles are 8.5 degrees, 9.5 degrees, 10.5 degrees, 11.5 degrees, and 12.5 degrees.

9. The golf club of claim 1, wherein the rotation position indicator includes a set of lines located along the grip to assist with accurate and repeatable head alignment.

10. The golf club of claim 1, wherein at least one of the shaft adapter or hosel adapter is releasably connected to either the shaft or the head.

11. The golf club of claim 1, wherein the first angular relationship is a face angle of the head and the second angular relationship is a loft angle of the head.

12. A golf club having a coupled head and shaft comprising:

a connection mechanism to couple the head to the shaft, said connection mechanism including a pair of radially nested mutually independently rotatable members, one of the rotatable members having an outer wall configured to fit inside the head and the other of the rotatable members having a bore for receiving the shaft, both members having inclined bores whereby two angular relationship parameters between the head and the shaft are adjusted effectively independently of each other, wherein the two angular relationships are a loft angle of the head and a face angle of the head, and further wherein the rotation of a first member with respect to the head is limited by the engagement between the first member and the head and the rotation of a second member with respect to the first member is limited by the engagement between the first member and the second member, wherein a first spline configuration between the first member and the head is defined by a first non-uniform rotation-inhibiting structure around the circumference of the outer wall of the first member and a second non-uniform rotation-inhibiting structure around the circumference of an interior bore of the club head, and a second spline configuration between the first member and the second member is defined by a third non-uniform rotation-inhibiting structure around the circumference of the outer wall of the second member and a fourth non-uniform rotation-inhibiting structure around the circumference of the internal inclined bore of the first member; and a grip member engaged with the shaft, wherein the grip member includes a rotation position indicator which includes setting adjustments for one or more of the two angular relationship parameters between the head and the shaft.

13. The golf club of claim 12, wherein the rotation position indicator includes setting adjustments for the face angle.

14. The golf club of claim 13, wherein the engagement of the hosel adapter and the hosel of the head limits the adjustability of the face angle to three different face angles.

15. The golf club of claim 14, wherein the setting adjustments for the face angle include an "O" for open face angle, an "N" for neutral face angle, and a "C" for closed face angle.

16. The golf club of claim 12, wherein the rotation position indicator includes setting adjustments for the loft angle.

17. The golf club of claim 16, wherein the engagement of the shaft adapter and the hosel adapter limits the adjustability of the loft angle to five different loft angles.

18. The golf club of claim 17, wherein the five loft angles are 8.5 degrees, 9.5 degrees, 10.5 degrees, 11.5 degrees, and 12.5 degrees.

19. The golf club of claim 12, wherein the rotation position indicator includes a set of lines located along the grip to assist with accurate and repeatable golf club head alignment.

* * * * *